US011234087B2

(12) United States Patent
Roeck et al.

(10) Patent No.: US 11,234,087 B2
(45) Date of Patent: Jan. 25, 2022

(54) HEARING DEVICE COMPRISING AN ACTIVE VENT AND METHOD FOR ITS OPERATION

(71) Applicant: Sonova AG

(72) Inventors: Hans-Ueli Roeck, Zurich (CH); Christian Frei, Stäfa (CH); Manuel Weibel, Ehrendingen (CH); Erwin Kuipers, Wolfhausen (CH); Maxi Susanne Moritz, Stäfa (CH); Christian Landolt, Niederurnen (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/027,737

(22) Filed: Sep. 22, 2020

(65) Prior Publication Data

US 2021/0092536 A1 Mar. 25, 2021

(30) Foreign Application Priority Data

Sep. 24, 2019 (EP) ..... 19199184

(51) Int. Cl.
*H04R 25/00* (2006.01)

(52) U.S. Cl.
CPC ..... *H04R 25/65* (2013.01); *H04R 25/48* (2013.01); *H04R 25/558* (2013.01); *H04R 25/603* (2019.05)

(58) Field of Classification Search
CPC H04R 1/1041; H04R 2460/11; H04R 25/456; H04R 2225/61; H04R 25/603
USPC ..... 381/312, 322, 324
See application file for complete search history.

(56) References Cited

U.S. PATENT DOCUMENTS

| | | | |
|---|---|---|---|
| 6,549,635 B1 | 4/2003 | Gebert | |
| 2010/0067713 A1 | 3/2010 | Boschung et al. | |
| 2017/0208382 A1* | 7/2017 | Grinker | H04R 1/1041 |
| 2019/0246219 A1 | 8/2019 | Lafort et al. | |

FOREIGN PATENT DOCUMENTS

| | | |
|---|---|---|
| EP | 2835987 A1 | 2/2015 |
| WO | 2019052715 A1 | 3/2019 |

OTHER PUBLICATIONS

European Patent Office, European Search Report for EP 19199184.3, dated Mar. 30, 2020, Munich Germany.

* cited by examiner

*Primary Examiner* — George C Monikang
(74) *Attorney, Agent, or Firm* — ALG Intellectual Property, LLC

(57) ABSTRACT

The disclosure relates to a hearing device comprising a housing surrounding a venting channel comprising a valve member moveable relative to the venting channel between different positions comprising a first valve position and a second valve position, an actuator configured to provide an actuation force with a direction and a magnitude acting on the valve member, and a controller a controller configured to provide a first control signal controlling the actuator to provide the actuation force in a first direction, and to provide a second control signal controlling the actuator to provide the actuation force in a second direction. The disclosure further relates to a method of operating such a hearing device.

20 Claims, 14 Drawing Sheets

HEARING DEVICE COMPRISING AN ACTIVE VENT AND METHOD FOR ITS OPERATION

TECHNICAL FIELD

This disclosure relates to a hearing device comprising a housing configured to be at least partially inserted into an ear canal, an active vent, and a controller configured to provide a control signal to control the active vent. The disclosure further relates to a method of operating the hearing device.

BACKGROUND

Hearing devices may be used to improve the hearing capability or communication capability of a user, for instance by compensating a hearing loss of a hearing-impaired user, in which case the hearing device is commonly referred to as a hearing instrument such as a hearing aid, or hearing prosthesis. A hearing device may also be used to produce a sound in a user's ear canal. Sound may be communicated by a wire or wirelessly to a hearing device, which may reproduce the sound in the user's ear canal. Hearing devices are often employed in conjunction with communication devices, such as smartphones, for instance when listening to sound data processed by the communication device and/or during a phone conversation operated by the communication device. More recently, communication devices have been integrated with hearing devices such that the hearing devices at least partially comprise the functionality of those communication devices.

Some types of hearing devices commonly comprise a housing configured to be at least partially inserted into an ear canal. For instance, the hearing device can include two earpieces each comprising such a housing for wearing in a respective ear canal. When the housing of a hearing device is at least partially inserted into an ear canal, it may form an acoustical seal with an ear canal wall such that it blocks the ear canal so that an inner region of the ear canal between the housing and the eardrum is acoustically insulated from the ambient environment outside the ear canal to some extent. Isolation provided by hearing devices may be desirable because it can prevent interference of ambient sound with the acoustic output of the hearing device. However, because ambient sound may be blocked from the eardrum, it may prevent a user of the hearing device from directly hearing external sounds such as someone trying to communicate with the user. In addition, sealing the ear canal can create an occlusion effect in the ear canal, whereby the hearing device wearer may perceive "hollow" or "booming" echo-like sounds, which can have a profoundly disturbing impact on the hearing experience.

An active vent may be included in the hearing device comprising a venting channel extending through the housing's inner volume by which an atmospheric connection between the inner region of the ear canal and the ambient environment outside the ear canal can be provided. The occlusion effect can thus be mitigated or circumvented by a pressure compensation between the inner region of the ear canal and the ambient environment outside the ear canal. The active vent further comprises an acoustic valve allowing to adjust the venting channel such that an effective size of the venting channel can be enlarged or reduced, for instance such that the venting channel is either in a more opened or closed state. The adjustment of the effective size may thus either allow sound to be increasingly vented from the ear canal through the housing to the ambient environment, or to restrict or prevent such transmission of sound. The adjustment can be actuated by an actuator which can be operatively coupled to a controller providing a control signal for the actuation.

Patent application publication No. US 2017/0208382 A1 describes an in-ear speaker comprising an active vent including a membrane enclosed inside an earpiece housing, wherein the active vent can be switched between an open state and a closed state of the venting channel by an actuator comprising a coil in a magnetic field. Patent application publication No. EP 2 164 277 A2 discloses an earphone device comprising an active vent with a leaf valve consisting of two conductive layers and an electroactive polymer layer. The leave valve is surrounding an opening of a sound tube enclosed by an earpiece housing. The opening can be either open or closed by providing a current to actuate the conductive layers of the leaf valve. International patent application publication No. WO 2019/056715 A1 discloses an earpiece of a hearing device including a sound conduit housing and an active vent. The active vent comprises an acoustic valve with a valve member moveably coupled with the housing and an actuator configured to provide a magnetic field. By the magnetic field, a driving force for a motion of the acoustic valve relative to the housing can be provided in order to adjust an effective size of a venting channel extending through an opening in a wall of the housing. European patent application No. EP 3 471 432 A1 discloses a sound channel housing integrated in an earpiece of a hearing device. A venting channel extends through the sound channel enclosed by the housing between an output opening at a front end of the sound channel, and a side opening provided at a side wall of the housing. An acoustic valve member is moveable relative to the side opening between a first position, in which the acoustic valve leaves the side opening open, and a second position, in which the valve member closes the side opening. The movement of the valve member can be actuated by a coil configured to produce a magnetic field interacting with a magnet fixed to the valve member.

The above mentioned constituent parts of the active vent including an acoustic valve and an actuator are required to allow a basic functionality of adjusting the effective size of the venting channel. Yet such an arrangement can be prone to operational errors. For instance, obstructions in the pathway of the valve member, such as ingress accumulating over time in the venting channel, can lead to a disfunction of the regular active vent functionality of enlarging and reducing the effective size of the venting channel A verification of a proper functioning of the active vent, however, can be rather intricate due to a rather small size and a rather hidden deployment of the constituent parts inside an ear canal.

More generally, there is an increasing demand for hearing devices which have additional functionality beyond the regular functionality of the active vent. The additional functionality may be associated with the regular active vent operation such as, for instance, a functionality allowing to increase the reliability of the active vent or a functionality allowing for a checking of the active vent's operational state. The additional functionality may also not directly be related to the regular active vent operation such as, for instance, a cleaning functionality and/or a user notification functionality. But the active vent's constituent parts require additional space. An additional functionality of the hearing device may require even more additional space. Available space, however, is limited by the ear canal dimension imposing size restrictions on the hearing device. To overcome those size limitations, it would be desirable to equip the active vent with additional functionality and/or to employ the active vent for such an additional functionality.

SUMMARY

It is an object of the present disclosure to avoid at least one of the above-mentioned disadvantages and to provide a hearing device and/or a method of operating the hearing device with improved functionality of the active vent. It is another object to equip the hearing device with an additional functionality in addition to the regular functionality of the active vent of enlarging and reducing the effective size of the venting channel. It is a further object to enhance the operational reliability and/or control options of the hearing device including the active vent. It is another object to provide a checking and/or testing functionality employing the active vent. It is another object to provide a vibration functionality employing the active vent. It is another object to provide an ear canal measurement and/or fitting functionality employing the active vent. It is another object to provide a user notification and/or sound indication functionality employing the active vent. It is yet another object to provide a repair and/or cleaning and/or maintenance functionality employing the active vent. It is a further object to equip the hearing device with multiple of those additional functionalities by complying with the rather small space requirements.

At least one of these objects can be achieved by a hearing device comprising the features of the claims. Advantageous embodiments of the invention are defined by the dependent claims and the following description.

The present disclosure proposes a hearing device comprising a housing configured to be at least partially inserted into an ear canal. The housing surrounds a volume through which a venting channel extends. The venting channel is configured to provide for venting between an inner region of the ear canal and an ambient environment outside the ear canal. The hearing device further comprises an acoustic valve comprising a valve member. The valve member is moveable relative to the venting channel between different positions including a first valve position and a second valve position such that an effective size of the venting channel can be modified by a movement of the valve member between the different positions. The hearing device further comprises an actuator configured to provide an actuation force with a direction and a magnitude acting on the valve member. The direction includes a first direction for actuating the movement of the valve member from the first valve position to the second valve position, and a second direction for actuating the movement of the valve member from the second valve position to the first valve position. The hearing device further comprises a controller configured to provide a first control signal controlling the actuator to provide the actuation force in the first direction, and to provide a second control signal controlling the actuator to provide the actuation force in the second direction. The controller is configured to provide a predetermined temporal sequence of signal pulses controlling the actuator to provide the actuation force during a duration of each signal pulse.

According to the disclosure, controlling the active vent by the temporal sequence of signal pulses can improve the regular functionality of the active vent and/or can provide additional functionality of the active vent in a number of different ways. By predetermining the temporal sequence, a time of occurrence of the subsequent signal pulses in the temporal sequence can be controlled by the controller. The subsequent signal pulses can thus be employed for operating the valve member in a reproducible way for any active vent functionality requiring more than a single provision of the actuation force at a given direction and/or magnitude. For instance, a regular functionality of the active vent may be implemented by providing the actuation force in the first or second direction controlled by the first or second control signal in order to enlarge and/or reduce the effective size of the venting channel. The subsequent signal pulses separated can be employed to improve the regular functionality of the active vent, for instance by implementing the subsequent signal pulses in the first control signal and/or in the second control signal, and/or to provide an additional functionality of the active vent, for instance by implementing the subsequent signal pulses in an auxiliary control signal.

In some implementations, an enhanced reliability of the regular functionality to modify the effective size of the venting channel can be provided by the subsequent signal pulses. In some implementations, operating noises may be optimized during the regular functionality of the active vent. In some implementations, a checking and/or testing functionality of the active vent can be provided. In some implementations, a repair and/or cleaning and/or maintenance functionality of the active vent can be provided. In some implementations, a vibration functionality of the active vent can be provided. In some implementations, a user notification functionality can be provided. In some implementations, a sound indication functionality can be provided. In some implementations, a fitting functionality can be provided. In some implementations, an ear canal measurement functionality can be provided. In some implementations, a combination of the above functionalities can be provided. Those and other implementations are described below in further detail.

Independently, the present disclosure proposes a method of operating a hearing device. The hearing device comprises a housing configured to be at least partially inserted into an ear canal. The housing surrounds a volume through which a venting channel extends. The venting channel is configured to provide for venting between an inner region of the ear canal and an ambient environment outside the ear canal. The hearing device further comprises an acoustic valve comprising a valve member moveable relative to the venting channel between different positions including a first valve position and a second valve position such that an effective size of the venting channel can be modified by a movement of the valve member between the different positions. The hearing device further comprises an actuator configured to provide an actuation force with a direction and a magnitude acting on the valve member. The direction includes a first direction for actuating the movement of the valve member from the first valve position to the second valve position, and a second direction for actuating the movement of the valve member from the second valve position to the first valve position. The method comprises providing a first control signal controlling the actuator to provide the actuation force in the first direction, and providing a second control signal controlling the actuator to provide the actuation force in the second direction. The method comprises providing a predetermined temporal sequence of signal pulses controlling the actuator to provide the actuation force to provide the actuation force during a duration of each signal pulse.

Independently, the present disclosure also proposes a non-transitory computer-readable medium storing instructions that, when executed by a processor, cause a hearing device to perform operations of the method described above.

Subsequently, additional features of some implementations of the hearing device and/or the method of operating a hearing device are described. Each of those features can be provided solely or in combination with at least another feature. The features may be correspondingly applied in some implementations of the hearing device and/or the method of operating the hearing device and/or the computer-readable medium.

An active vent may comprise the venting channel, the acoustic valve, and the actuator. The controller may include a processing unit and/or an amplifier. The predetermined temporal sequence of signal pulses may comprise a predetermined duration and/or a predetermined number of the signal pulses provided by the controller in the temporal sequence. The predetermined temporal sequence of signal pulses may further comprise a predetermined intermediate time interval separating the subsequent signal pulses. The predetermined temporal sequence of signal pulses may further comprise a predetermined signal level, in particular a predetermined absolute value and/or sign of the signal level, during the duration of the subsequent signal pulses and/or during the intermediate time interval separating the subsequent signal pulses. The temporal sequence of signal pulses can be predetermined at a time before the subsequent signal pulses are provided by the controller to the actuator. In particular, the temporal sequence of signal pulses can be predetermined by the controller depending on information gathered by the controller before providing the subsequent signal pulses to the actuator.

During the duration of the subsequent signal pulses, the direction of the activation force controlled by the signal pulses may be kept equal in the first direction or in the second direction. Correspondingly, a sign of a signal level of the signal pulses may be kept equal during the duration of the subsequent signal pulses. During the duration of the subsequent signal pulses, the magnitude of the activation force over time controlled by the signal pulses may be kept above a minimum level. Correspondingly, an absolute value of a signal level of the signal pulses and/or the duration of the signal pulses may be kept above a minimum level. For instance, the magnitude of the activation force may be kept substantially at an equal level during the duration of each signal pulse. Correspondingly, an absolute value of the signal level of the signal pulses may be kept substantially at an equal level during the duration. Substantially equal may imply noise and/or random fluctuations occurring in an electrical circuit including the controller and the actuator.

The duration of the subsequent signal pulses may depend on the functionality of the active vent provided by the subsequent signal pulses. In some implementations, the duration may be at most 100 milliseconds, in particular at most 10 milliseconds. In some implementations, the duration may be larger than 0.1 seconds, in particular larger than 0.5 seconds. The number of the subsequent signal pulses may depend on the functionality of the active vent provided by the subsequent signal pulses. In some implementations, at least two, more preferred at least four subsequent signal pulses are provided, for instance to actuate a forth and back movement of the valve member at least one or two times. In some implementations, at least five, more preferred at least ten, subsequent signal pulses are provided, for instance to provide a repeated actuation of the valve member with differing properties. In some implementations, an indefinite number of subsequent signal pulses are provided, for instance to wait for an event terminating the temporal sequence.

In some implementations, the subsequent signal pulses have a substantially rectangular shape. Substantially rectangular may imply noise and/or random fluctuations occurring in an electrical circuit including the controller and the actuator. In some implementations, the subsequent signal pulses have a short duration, in particular smaller than 1 millisecond, such that they may be approximated by a delta function. Multiple pulses of a shorter duration may be provided in a temporal sequence to approximate a pulse of a longer duration in the temporal sequence of signal pulses. In some implementations, the subsequent signal pulses may be approximated by an envelope curve. For instance, the envelope curve may be defined by a linear function, in particular having a constant slope of zero and/or larger than zero and/or smaller than zero. The envelope curve may also be defined by a nonlinear function, for instance a sinusoidal function.

A decreased level of the magnitude of the actuation force may be controlled by the subsequent signal pulses after the duration of each signal pulse. For instance, the decreased level may be substantially equal after the duration of each signal pulse. The decreased level can be lower as compared to the magnitude of the actuation force provided during the duration of the subsequent signal pulses. In particular, the decreased level may be lower by at least one third, more preferred at least one half, and even more preferred at least two third, as compared to the largest level of the magnitude of the actuation force provided during the duration of the signal pulses. For instance, the decreased level can be substantially zero. Substantially zero may imply noise and/or random fluctuations occurring in an electrical circuit including the controller and the actuator.

The controller can be configured to provide the subsequent signal pulses controlling the actuator to keep the direction of the activation force equal in the first direction or second direction and the magnitude of the activation force above a minimum level during the duration of each signal pulse, and to decrease the magnitude of the actuation force below the minimum level after the duration of the respective signal pulse and/or to change the direction of the actuation force between the first direction and the second direction after the duration of the respective signal pulse. The minimum level may be selected to correspond to a value required to effectuate a movement of the valve member between the first and second valve position, at least in a situation in which a pathway of the valve member is free from obstructions. Obstructions may occur after a prolonged usage of the active vent, for instance by ingress in the venting channel.

The subsequent signal pulses may be separated by an intermediate time interval during which the actuator is controlled to decrease the magnitude of the actuation force as compared to the magnitude controlled during the duration of each signal pulse and/or to change the direction of the actuation force between the first direction and the second direction. In particular, the intermediate time interval may have a rather short length, for instance a length of substantially zero, in order to control the change of the direction of the actuation force between the first direction and the second direction. Substantially zero may imply a time required to change the direction of the actuation force. The intermediate time interval may also have a length larger than zero, in order to control the change of the direction of the actuation force between the first direction and the second direction and/or to lower the magnitude of the actuation force as compared to the magnitude of the actuation force provided during the duration of the signal pulses. For instance, the direction of the actuation force may be changed at the beginning and/or end of the intermediate time interval and/or at any other time in the intermediate time interval. The length of the intermediate time interval may depend on the functionality of the active vent provided by the subsequent signal pulses. In some implementations, the intermediate time interval may be at most 100 milliseconds, in particular at most 10 milliseconds. In some implementations, the intermediate time interval may be larger than 0.1 seconds, in particular larger than 0.5 seconds.

The controller may be configured to control the signal level, in particular an absolute value and/or a sign of the signal level, and/or the duration of the signal pulses and/or the intermediate time interval between the subsequent signal pulses. A magnitude of the actuation force may be controlled by controlling the signal level of the signal pulses. A magnitude of the actuation force over time, in particular an activation energy, may be controlled by controlling the duration of the signal pulses. Alternatively or complementary, an inertia of the movement of the valve member and/or a time interval required for building up the activation force, for instance a magnetic and/or electrical force, may be bridged by controlling the duration of the signal pulses above a minimum time. Depending on the activation mechanism of the active vent, the minimum time of the duration can be at least one millisecond, more preferred at least ten milliseconds. In some implementations, a shorter duration of the signal pulses, such that the activation force may be controlled to fluctuate without being fully build up, can be controlled for various functionalities of the active vent, for instance for functionalities in which resonances of the valve member with the environment may be produced by the fluctuations.

The controller may be configured to control a pulse width modulation (PWM) to provide the subsequent signal pulses. PWM may be employed to provide the signal pulses with a differing duration and/or a differing intermediate time interval separating the signal pulses. PWM may also be employed to provide the signal pulses with an equal duration and/or an equal intermediate time interval separating the signal pulses. The subsequent signal pulses may thus be shaped by PWM. PWM can allow provision of the subsequent pulses at a good resolution and, at the same time, at a relatively low constructive effort when implemented in a hearing device. The controller may also be configured to control the signal level of the subsequent signal pulses, for instance as a voltage and/or a current level, in particular to provide a differing signal level. Moreover, the controller may be configured to control a delta-sigma modulation, in particular a pulse density modulation (PDM), and/or a switched modulation and/or binary weighted modulation and/or a multiplexing and/or another type of digital to analog conversion (DAC) to provide the subsequent signal pulses.

The controller may comprise a control signal generator configured to generate the subsequent signal pulses. The control signal generator may comprise a processing unit and/or an amplifier. The control signal generator may be configured to perform PWM controlled by the controller. Alternatively or complementary, the control signal generator may be configured to change the signal level of the subsequent signal pulses controlled by the controller. The control signal generator may also be configured to perform a delta-sigma modulation, in particular PDM, and/or a switched modulation and/or binary weighted modulation and/or a multiplexing and/or another type of DAC to provide the subsequent signal pulses controlled by the controller.

The hearing device may comprise an acoustic transducer configured to output an audio signal, wherein the controller is communicatively coupled to the acoustic transducer and configured to provide the audio signal to the acoustic transducer. In particular, the controller can comprise a control signal generator communicatively coupled to the acoustic transducer and configured to provide the audio signal to the acoustic transducer. The control signal generator may comprise a processing unit configured to perform a signal processing of the audio signal and to provide the subsequent signal sections and/or an amplifier configured to amplify the audio signal and to provide the subsequent signal sections. The control signal generator, in particular the processing unit and/or the amplifier, may be communicatively coupled to the acoustic transducer and the actuator. The controller may be configured to provide said subsequent signal pulses generated by the control signal generator to the actuator, and the audio signal generated by the control signal generator to the acoustic transducer. The controller may also be configured to provide both the subsequent signal pulses and the audio signal generated by the control signal generator to the acoustic transducer and/or to the actuator.

A control signal provided by the controller, in particular the first control signal and/or the second control signal and/or an auxiliary control signal, may comprise the predetermined sequence of signal pulses. The control signal may control the actuator to provide the actuation force for actuating the movement of the valve member from the first valve position to the second valve position. In some implementations, the control signal may also control the actuator to provide a subsequent actuation force for actuating the movement of the valve member from the second valve position to the first valve position. In this way, a forth and back movement of the valve member between the valve positions may be controlled. The control signal may control the actuator to provide to actuation force to repeat the forth and back movement of the valve member for a plurality of times.

In some implementations, the controller is configured to provide said subsequent signal pulses controlling the actuator to keep the direction of the activation force equal in the first direction or second direction and the magnitude of the activation force above a minimum level during the duration of each signal pulse, and to decrease the magnitude of the actuation force below the minimum level after the duration of at least one signal pulse, in some implementations after the duration of each signal pulse. In particular, the subsequent signal pulses may be separated by an intermediate time interval during which the actuator is controlled to decrease the magnitude of the actuation force as compared to the magnitude controlled during the duration of each signal pulse.

In some implementations, the controller is configured to provide said subsequent signal pulses controlling the actuator to keep the direction of the activation force equal in the first direction or second direction and the magnitude of the activation force above a minimum level during the duration of each signal pulse, and to change the direction of the actuation force between the first direction and the second direction after the duration of at least one signal pulse. In some implementations, the direction of the actuation force may be changed after the duration of each signal pulse.

The controller may be configured to provide the subsequent signal pulses controlling the actuator to successively increase the magnitude of the actuation force over time in the temporal sequence. For instance, the controller may be configured to provide the subsequent signal pulses controlling the actuator to provide the actuation force with a first magnitude during the duration of a first signal pulse of the subsequent signal pulses and with a second magnitude during a second signal pulse of the subsequent signal pulses, wherein the second signal pulse is provided temporally after the first signal pulse and the second magnitude has a larger value than the first magnitude. The controller may also be configured to provide additional subsequent signal pulses, for instance a third and/or a fourth and/or a fifth signal pulse, with a respective magnitude during the duration of the additional signal pulse, wherein the respective magnitude has a larger value than the first and second magnitude.

The successive increase of the magnitude of the actuation force over time may be defined by an envelope curve of the subsequent signal pulses. The envelope curve may be defined by integrating a signal level over the duration of each signal pulse. The envelope curve can be provided as a linear function. The signal level of the subsequent signal pulses may then successively increase by an equal amount between two consecutive signal pulses in the temporal sequence and/or the duration of the subsequent signal pulses may then successively increase by an equal amount between two consecutive signal pulses in the temporal sequence and/or a combination of both may be provided. In this way, a rather uniform increase of the magnitude of the actuation force may be provided in the temporal sequence. The controller may be configured to successively increase the duration and/or a signal level of the signal pulses in said temporal sequence, for instance to provide the increasing magnitude of the actuation force and/or to provide differing fluctuations of the actuation force.

The controlling of a successively increasing magnitude of the actuation force during the subsequent signal pulses may be employed in a reliability enhancement functionality of the active vent. In particular, an increased magnitude of the actuation force can be controlled in a signal pulse following a preceding signal pulse in which the magnitude of the actuation force has been controlled to a value too small to effectuate a movement of the valve member between the valve positions. A magnitude of the actuation force required for the movement of the valve member may thus be adjusted in a step-by-step manner starting from a small value of the magnitude during the first signal pulse and increasing the value during the subsequent signal pulses. In this way, a particular magnitude of the actuation force may be found which on the one hand is sufficient to cause the movement of the valve member between the valve positions and on the other hand minimizes an acceleration of the valve member during the movement between the valve positions. By minimizing the acceleration, operating noises of the active vent caused by the acceleration of the valve member may be minimized A functionality of the active vent optimizing the operating noise may be implemented in such a manner.

The reliability enhancement functionality and/or operating noise optimization functionality of the active vent provided by the subsequent signal pulses controlling the actuator to successively increase the magnitude of the actuation force can be implemented as the first control signal controlling the actuator to provide the actuation force in the first direction and/or as the second control signal controlling the actuator to provide the actuation force in the second direction. In this way, the reliability may be enhanced and/or the operating noises may be optimized when the active vent is controlled by the first and/or second control signal in a regular active vent functionality to modify the effective size of the venting channel. The subsequent signal pulses may control the actuator to provide the actuation force in an equal direction in the temporal sequence in which the magnitude of the actuation force is successively increased. The equal direction may be the first direction when the first control signal is implemented by the subsequent signal pulses and/or the equal direction may be the second direction when the second control signal is implemented by the subsequent signal pulses.

The reliability enhancement functionality and/or operating noise optimization functionality of the active vent may also be implemented as an additional active vent functionality by an auxiliary control signal in addition to the first control signal and the second control signal. For instance, the first control signal and/or the second control signal may be inadequate to control the movement of the valve member in the regular active vent functionality to modify the effective size of the venting channel, due to an insufficient value of the magnitude of the actuation force controlled by the first and/or the second control signal. The auxiliary control signal may then be employed to provide the regular active vent functionality with the enhanced reliability and/or optimized operating noises. In particular, a first auxiliary control signal and a second auxiliary control signal can be provided to substitute the functionality of the first control signal and the second control signal. The subsequent signal pulses may control the actuator to provide the actuation force in an equal direction in the temporal sequence in which the magnitude of the actuation force is successively increased. The equal direction may be the first direction when the first auxiliary control signal is implemented by the subsequent signal pulses and/or the equal direction may be the second direction when the second auxiliary control signal is implemented by the subsequent signal pulses.

The controlling of a successively increasing magnitude of the actuation force in the subsequent signal pulses may also be employed in a repair functionality and/or cleaning functionality and/or maintenance functionality of the active vent. For instance, obstructions may block a movement of the valve member between the different valve positions such that the actuation force controlled by the first and/or second control signal may not have a sufficient magnitude to cause a movement of the valve member between the valve positions. Moreover, ingress may accumulate in the venting channel over time leading to a clogging of the venting channel. The successively increasing magnitude of the actuation force may be employed to release the valve member from the blocking caused by the obstructions such that the active vent can be operated again by the first and/or second control signal to cause a movement of the valve member between the valve positions. In this way, the active vent can be converted from a dysfunctional state into a functional state by a repair functionality of the active vent. The successively increasing magnitude of the actuation force may also be employed to cause an acceleration of the valve member allowing to remove ingress from the venting channel, such that a cleaning functionality may be provided. The repair functionality and cleaning functionality may also be combined in a maintenance functionality. The repair and/or cleaning and/or maintenance functionality of the active vent may be implemented as an auxiliary control signal in addition to the first control signal and the second control signal.

The subsequent signal pulses may also control the actuator to change the direction of the actuation force between the first direction and the second direction in the temporal sequence in which the magnitude of the actuation force is successively increased. For instance, a first number and a second number of subsequent signal pulses may be provided in the temporal sequence. The second number may be provided after the first number. The first number may control the actuator to provide the actuation force in an equal direction in the temporal sequence in which the magnitude of the actuation force is successively increased. The second number may also control the actuator to provide the actuation force in an equal direction in the temporal sequence in which the magnitude of the actuation force is successively increased. The equal direction may be changed between the first number and the second number. In particular, the equal direction in the first number of the subsequent signal pulses may be provided as one of the first direction and the second direction, and the equal direction in the second number of the subsequent signal pulses may be provided as the other of the first direction and the second direction. As another example, the subsequent signal pulses may successively alternate in the temporal sequence in which the magnitude of the actuation force is successively increased between at least one signal pulse controlling the actuator to provide the actuation force in the first direction and at least one signal pulse controlling the actuator to provide the actuation force in the second direction. Combining the change of direction of the actuation force with the successive increase of the actuation force in such a manner can be employed to effectively release the valve member from obstructions and/or remove ingress from the venting channel.

The controlling of a change of direction of the actuation force, which may be combined with the successively increasing magnitude of the actuation force, in the subsequent signal pulses may also be employed in a checking functionality and/or testing functionality of the active vent. Controlling the change of direction of the actuation force can effectuate a forth and back movement of the valve member between the first valve position and the second valve position, if the magnitude of the actuation force is sufficient to cause the movement. However, if the magnitude of the actuation force is insufficient to cause the movement, the valve member will remain in the first valve position or in the second valve position. Thus, the functionality of the active vent for a given value of the magnitude of the actuation force can be checked and/or tested by applying the subsequent signal pulses controlling the change of direction of the actuation force and verifying the momentary position of the valve member in the first valve position or in the second valve position.

The valve member may be moveable relative to an opening provided in the housing, wherein the opening is located in the venting channel and leading to an exterior of the housing and wherein the valve member is disposed such that the valve member is visible at the opening from the exterior of the housing when the valve member is in the first valve position and/or in the second valve position. For instance, the valve member may be visible at the opening when the acoustic valve at least partially covers the opening at the interior of the housing and/or at the exterior of the housing. The valve member may be visible through the opening upon inspection of the opening by human eyes. A momentary position of the valve member in the first valve position and/or in the second valve position may then be visually verified. In this way, a checking functionality of the active vent by a visual inspection may be implemented.

The duration of the subsequent signal pulses and/or the intermediate time interval separating the subsequent signal pulses may be predetermined such that the valve member is positioned in the first valve position and/or in the second valve position for a duration in which a presence of the acoustic valve at the valve position is visually identifiable. Visual identification may imply inspection of the opening by human eyes from the exterior of the housing. For instance, a sum of the duration of the respective signal pulse and the intermediate time interval following the signal pulse may be predetermined to a combined value of at least 0.1 seconds, more preferred at least 0.5 seconds, in order to allow the visual identification of the acoustic valve in the respective valve position. On the other hand, the duration of the subsequent signal pulses and/or the intermediate time interval separating the subsequent signal pulses may be predetermined to a combined value of at most 10 seconds, more preferred at most 5 seconds, in order to avoid an overly long duration of the checking procedure.

The opening may be provided in an outer wall of the housing. The outer wall may at least partially delimit the volume surrounded by the housing to the exterior of the housing. In some implementations, the opening can be provided in a side wall of the housing. The outer wall may comprise the side wall. The side wall may extend in a direction of the ear canal when the housing is at least partially inserted into the ear canal. In some implementations, the opening can be provided in a front wall of the housing. The outer wall can comprise the front wall. The front wall may face a tympanic membrane in the ear canal when the housing is at least partially inserted into the ear canal. In some implementations, the opening can be a first opening, and the housing can be provided with a second opening located in the venting channel. The housing may comprise a contact portion configured to contact an ear canal wall of the ear canal. The contact portion may be at least partially disposed between the first opening and the second opening. For instance, the contact portion may be provided by a sealing configured to provide an acoustical isolation between the inner region of the ear canal and an ambient environment outside the ear canal.

The valve member may be moveably coupled with the housing such that the effective size of the venting channel can be adjusted by a motion of the valve member relative to the housing. For instance, the valve member may be rotationally and/or translationally moveable with respect to the opening. The moveable coupling may be provided with the outer wall and/or with an inner wall of the housing surrounded by the outer wall. The actuator can be configured to actuate the movement of the valve member. For instance, the actuator can be configured to produce a magnetic field and/or an electric field effectuating the movement of the valve member.

In some implementations, the hearing device comprises a microphone configured to detect sound and to provide an audio signal based on the detected sound. The hearing device can further comprise a processing unit communicatively coupled to the microphone, wherein the processing unit is configured to determine the position of the valve member in the first valve position and/or in the second valve position based on the audio signal. For instance, the valve position may be determined in the audio signal based on a signal to noise ratio and/or a feedback value in the audio signal. The feedback value may be indicative of an acoustic feedback between an output of an acoustic transducer of the hearing device and sound detected by the microphone. In particular, the acoustic transducer may be configured to output the sound to the inner region of the ear canal and the microphone may be acoustically coupled to the ambient environment outside the ear canal, for instance to detect the sound at an outer region of the ear canal and/or outside the ear canal. When the valve member is in a valve position corresponding to an enlarged effective size of the venting channel, an increased signal to noise ratio and/or an increased feedback value can be expected in the audio signal as compared to a valve position of the valve member corresponding to a reduced effective size of the venting channel Thus, the signal to noise ratio and/or the feedback value can indicate a momentary position of the valve member.

By determining a momentary position of the valve member when the actuation force acting on the valve member is controlled by the temporal sequence of signal pulses, the functionality of the active vent relative to the magnitude of the actuation force controlled during the signal pulses can be tested. If the magnitude of the actuation force is sufficient to cause the movement of the valve member between the valve positions, the valve member may be determined to have moved between the valve positions. If the magnitude of the actuation force is insufficient to cause the movement, the valve member may be determined to not have moved from the first valve position or the second valve position. In this way, a testing functionality of the active vent can be implemented by the evaluation of the audio signal. The controller configured to provide the temporal sequence of signal pulses may be implemented by the processing unit determining the momentary position of the acoustic valve.

In some implementations, the controller is configured to receive an input signal from a user interface and to provide the temporal sequence of signal pulses depending on the input signal. The input signal may be a signal from the user interface indicating a user interacting with the user interface. In some implementations, the user interface can be implemented with the hearing device. For instance, the user interface can comprises a manually operable member provided at a surface of the hearing device and/or a sensor of the hearing device configured to detect a user interaction. In some implementations, the user interface can be provided by a remote device connectable to the hearing device. For instance, the remote device may be a smartphone and/or a personal computer. In this way, the controller may be operated by the user and/or by another individual, such as a health care professional, to provide the subsequent signal pulses.

In some implementations, the controller is configured to provide the auxiliary control signal depending on an event. The event may be determined by the controller. The event may comprise, for instance, turning the hearing device on and/or waking the hearing device up from a stand-by mode and/or initiating a reboot of the hearing device. The event can also comprise a time determined by a clock, for instance a periodically determined time. The event can also comprise a signal received from a remote device connectable to the hearing device. For instance, the signal may comprise a notification signal, a phone call signal, an alarm signal, and/or the like. In some implementations, the controller is configured to execute a boot sequence and to provide the temporal sequence of signal pulses during executing the boot sequence. For instance, the controller may be a processing unit. The processing unit can be configured to execute the boot sequence during which a hearing device program is loaded and/or started by the processing unit. The hearing device may further comprise a memory configured to store the hearing device program.

In some implementations, the controller is configured to provide an unlimited number of signal pulses in the temporal sequence until the controller receives the input signal from the user interface and/or determines the event. After receiving the input signal from the user interface and/or after determining the event, the controller may stop to provide the subsequent signal pulses. For instance, the checking functionality may be implemented by providing the subsequent signal pulses until the user has confirmed via the user interface that the momentary position of the valve member in the first valve position and/or in the second valve position has been verified. For instance, the testing functionality may be implemented by providing the subsequent signal pulses until the momentary position of the valve member in the first valve position and/or in the second valve position has been determined by the controller based on the audio signal.

In some implementations, the controller is configured to provide the subsequent signal pulses repeatedly at a constant repetition frequency. The constant repetition frequency may be provided by a constant value of a sum of the duration of each signal pulse and the intermediate time interval following the respective signal pulse. In particular, the constant repetition frequency may be provided by a constant value of the duration of each signal pulse and a constant value of the intermediate time interval following each signal pulse. The actuation force may be thus be controlled to be repetitively provided at the repetition frequency. In some implementations, at least four subsequent signal pulses are provided at the constant repetition frequency. In some implementations, at least ten subsequent signal pulses are provided at the constant repetition frequency. In some implementations, at least fifty subsequent signal pulses are provided at the constant repetition frequency.

The repeated signal pulses may be employed in various functionalities of the active vent including, for instance, the reliability enhancement functionality and/or operating noise optimization functionality and/or repair functionality and/or cleaning functionality and/or maintenance functionality and/or checking functionality and/or testing functionality and/or a further additional functionality described below. The repeated signal pulses may be applied to produce resonances of the valve member with the environment in order to enhance the effect of the valve member movement for a respective active vent functionality. The repeated signal pulses can be provided to control the actuator to successively increase the magnitude of the actuation force at the constant repetition frequency. The repeated signal pulses can also be provided to control the actuator to provide the magnitude of the actuation force at an equal value at the constant repetition frequency.

In some implementations, the repeatedly provided subsequent signal pulses comprise first repeated signal pulses and second repeated signal pulses alternating in the temporal sequence, wherein the first repeated signal pulses control the actuator to provide the actuation force in the first direction and the second repeated signal pulses control the actuator to provide the actuation force in the second direction. Alternating in the temporal sequence may imply that each of the second repeated signal pulses temporally succeeds one of the first repeated signal pulse. The controller can be configured to provide the first repeated signal pulses at a first constant repetition frequency and to provide the second repeated signal pulses at a second constant repetition frequency. The first constant repetition frequency may correspond to the second constant repetition frequency. The constant repetition frequency, at which the subsequent signal pulses are repeatedly provided may correspond to a sum of the first constant repetition frequency and the second constant repetition frequency.

In some implementations, the first and second repeated signal pulses control the actuator to provide the actuation force with a magnitude actuating a movement of the valve member forth and back between the first valve position and the second valve position. The first repetition frequency at which the first repeated signal pulses are provided and/or the second repetition frequency at which the second repeated signal pulses are provided may correspond to a repetition frequency of the forth and back movement of the valve member. In particular, the controller can be configured to provide an auxiliary control signal controlling the actuator to repeatedly actuate the movement of the valve member from the first valve position to the second valve position and from the second valve position to the first valve position at the first and/or second repetition frequency. Thus, a forth and back movement of the valve member between the valve positions can be actuated for a number of consecutive times.

In some implementations, the forth and back movement is provided at least two times. In some implementations, the forth and back movement is provided at least ten times. In some implementations, the forth and back movement is provided an unlimited number of times until the controller receives an input signal from the user interface and/or determines an event. In this way, the checking functionality and/or the testing functionality and/or the cleaning functionality and/or the repair functionality and/or the maintenance functionality may be implemented by the repeated forth and back movement of the valve member.

In some implementations, the valve member is moveably coupled with the housing, wherein the repetition frequency of the subsequent signal pulses is provided such that the housing is caused to vibrate by the movement of the valve member. In this way, a vibration functionality of the active vent can be implemented. The repetition frequency may correspond to a sum of the first repetition frequency at which the first repeated signal pulses are provided and the second repetition frequency at which the second repeated signal pulses are provided. The magnitude of the actuation force controlled by the subsequent signal pulses may be accordingly provided to produce the vibrations of the housing by the movement of the valve member. Increasing the magnitude of the actuation force can cause an increased acceleration of the valve member which can intensify the vibrations.

In some implementations, the forth and back movement of the valve member may be provided such that the vibrations of the housing are perceivable by a user when the earpiece is at least partially inserted into the ear canal of the user. For instance, the vibrations may be transmitted from a contact portion of the housing, at which the housing is in contact with the ear, to the ear. Thus, a haptic feeling for the user may be producible by the vibrations. The haptic feeling can be employed, for instance, for a notification functionality, a sound indication functionality, and/or a fitting functionality of the active vent. Regardless of the haptic feeling perceivable by the user, the vibration functionality of the active vent may also be employed in an ear canal measurement functionality of the active vent to perform vibration measurements of the hearing device inside the ear canal including, for instance, audiological measurements and/or measurements of the ear canal geometry.

In some implementations, the repetition frequency of the subsequent signal pulses is provided such that the movement of the valve member forth and back between the first valve position and the second valve position is actuated at least 5 times per second, more preferred at least 20 times per second, even more preferred at least 100 times per second. Repetition frequencies in such a frequency range can be suitable to produce the vibrations of the housing, wherein higher frequencies may be preferred due to better noticeability by the user. A time in which the valve member is positioned in the second valve position and/or in the first valve position can be selected as rather short, in particular substantially zero, to produce the vibrations more efficiently.

Characteristics of the produced vibrations may further depend on other parameters including a direction of the movement of the valve member, a mass of the valve member, a moveable coupling of the valve member to the housing, and/or a mass and geometry of the housing. The vibrations may be producible rather effortless by providing the acoustic valve with a minimum mass required for the vibrations. A smaller mass of the valve member may be preferred, in particular to reduce the weight of the hearing device and/or the energy requirements for moving the acoustic valve. A smaller mass of the valve member may be compensated by a larger value of the magnitude of the actuation force controlled during the subsequent signal pulses. Moreover, providing the movement direction of the valve member transverse to the longitudinal axis of the housing, corresponding to the direction of extension of the ear canal, can further facilitate the generation of the vibrations. In some implementations, the subsequent signal pulses are provided to induce the vibrations for at least 100 milliseconds in order to allow an unambiguous perceptibility of the haptic feeling by the user. In some implementations, for instance when the vibrations are employed in a notification functionality for the user, the vibrations can be induced for at most 5 seconds in order to avoid an overly long disturbance of the user by the vibrations.

In some implementations, the controller is configured to provide the subsequent signal pulses at the repetition frequency depending on an audio signal. The hearing device can comprise a microphone configured to provide the audio signal. For instance, the microphone can be configured to detect sound in an ambient environment and provide the audio signal based on the detected sound. The controller may be configured to provide the subsequent signal pulses at the repetition frequency when a property of the audio signal exceeds a threshold. The property of the audio signal may comprise any property representative of the detected sound including, for instance, a sound level, in particular an envelope of a sound level amplitude, and/or a signal to noise ratio and/or a signal level at a selected frequency range. The controller can be configured to provide the subsequent signal pulses at the repetition frequency to control the actuator to cause the vibrations of the housing depending on the audio signal. In this way, a sound indication functionality can be provided by the active vent in which the user can be informed about the detection of the audio signal by the haptic feeling caused by the vibrations. The controller may be configured to provide the vibrations synchronized with the property of the audio signal over time. For instance, the vibrations may be synchronized with an envelope of a sound level amplitude of the audio signal.

In some implementations, the controller is configured to provide the subsequent signal pulses controlling the actuator to provide the actuation force with a magnitude depending on the audio signal. In particular, during the duration of the subsequent signal pulses, a larger magnitude of the actuation force may be controlled when the property of the audio signal audio signal has a larger value as compared to a smaller magnitude of the actuation force that may be controlled when the property of the audio signal audio signal has a smaller value. For instance, the magnitude of the actuation force may be controlled to increase with the sound level of the detected sound. In some implementations, the controller is configured to provide the subsequent signal pulses controlling the actuator to provide the actuation force with the repetition frequency depending on the audio signal. In particular, during the duration of the subsequent signal pulses, a larger value of the repetition frequency may be controlled when the property of the audio signal audio signal has a larger value as compared to a smaller value of the repetition frequency that may be controlled when the property of the audio signal audio signal has a smaller value. The controller may thus be configured to control the forth and back movement of the valve member with a differing repetition frequency and/or a differing acceleration of the valve member depending on the audio signal. The produced vibrations can thus be adapted to the audio signal, for example to provide a haptic feeling for the user to be more intensive at a larger level of the detected sound as compared to a smaller level of the detected sound. For instance, the vibrations can be modulated in conformity with an envelope of a sound level amplitude of the audio signal.

In some implementations, the hearing device further comprises an acoustic transducer configured to output the audio signal. Information about the audio signal may be transmitted to the user by the acoustic transducer in addition to the vibrations produced by the active vent actuation. In this way, an enhanced comprehensibility of information contained the in audio signal can be provided for the user, for instance of a speech content encoded in the audio signal.

In some implementations, the controller is configured to control the activation force such that the valve member can be moved between the first valve position and the second valve position only. In some implementations, the controller is configured to control the activation force such that the valve member can be moved between at least three valve positions including the first valve position and the second valve position. In some implementations, the controller is configured to control the activation force such that the valve member can be moved substantially continuously between different valve positions including the first valve position and the second valve position.

In some implementations, the controller is configured to provide an auxiliary control signal in addition to the first control signal and the second control signal, wherein the auxiliary control signal comprises the subsequent signal pulses. The first control signal and/or the second control signal may control a regular functionality of the active vent comprising a modification of the effective size of the venting channel by providing the actuation force in the first direction or in the second direction. The auxiliary control signal may control an additional functionality of the active vent, for instance one or more of the functionalities described above.

In some implementations, the controller is configured to provide the subsequent signal pulses in the auxiliary control signal controlling the actuator to provide the actuation force with an increased magnitude during the duration of at least one of the signal pulses as compared to the magnitude of the actuation force controlled by the first control signal and/or the second control signal. In this way, an enhanced reliability for modifying the effective size of the venting channel may be provided by the auxiliary control signal as compared to the first and/or second control signal. For instance, in a case in which the first control signal and/or the second control signal can only provide a magnitude of the actuation force insufficient for initiating a movement of the valve member between the valve positions, the auxiliary control signal may be employed to cause the movement. Thus, the reliability enhancement functionality of the active vent can be implemented by the auxiliary control signal.

In some implementations, the auxiliary control signal is a first auxiliary control signal, wherein the controller is configured to provide a second auxiliary control signal comprising a predetermined temporal sequence of signal pulses controlling the actuator to provide the actuation force in the first direction or in the second direction during a duration of each signal pulse, wherein at least one of the signal pulses of the second auxiliary control signal controls the actuator to provide the actuation force with a different magnitude and/or direction than the signal pulses of the first auxiliary control signal, and a duration of at least one of the signal pulses in the second auxiliary control signal is different than the duration of the signal pulses in the first auxiliary control signal, and/or a predetermined intermediate time interval separating at least two of the signal pulses in the second auxiliary control signal is different than the intermediate time interval separating the signal pulses in the first auxiliary control signal. For instance, the second auxiliary control signal may comprise a temporal sequence of signal pulses, at least one of the signal pulses controlling the actuator to provide the actuation force with a different magnitude and/or direction than the signal pulses of the first auxiliary control signal.

The first auxiliary control signal and second auxiliary control signal may be employed to control an additional functionality of the active vent. For instance, the controller can be configured to provide the subsequent signal pulses in the first auxiliary control signal controlling the actuator to provide the actuation force in the first direction, and to provide the subsequent signal pulses in the second auxiliary control signal controlling the actuator to provide the actuation force in the second direction. In the first auxiliary control signal, the actuation force may be controlled with an increased magnitude during the duration of at least one of the signal pulses as compared to the magnitude of the actuation force controlled by the first control signal. In the second auxiliary control signal, the actuation force may be controlled with an increased magnitude during the duration of at least one of the signal pulses as compared to the magnitude of the actuation force controlled by the second control signal. Thus, the reliability enhancement functionality of the active vent can be implemented by the first auxiliary control signal and the second auxiliary control signal, which may be employed when the first control signal and the second control signal can only provide an insufficient magnitude of the actuation force for initiating a movement of the valve member between the valve positions.

The first auxiliary control signal and the second auxiliary control signal may also be employed to each control a different additional functionality of the active vent. For instance, the repair functionality and/or cleaning functionality and/or maintenance functionality may be implemented by the first auxiliary control signal, and the checking and/or testing functionality may be implemented by the second auxiliary control signal. The controller may be configured to provide at least one additional auxiliary control signal, in which an additional functionality of the active vent may be implemented. For instance, the vibration functionality may be implemented in a third auxiliary control signal. Moreover, multiple auxiliary control signals may be employed to provide an equal additional functionality of the active vent with different properties. For instance, the repair functionality may be implemented by both the first auxiliary control signal and the second auxiliary control signal, wherein the magnitude of the actuation force controlled during the signal pulses and/or the predetermined intermediate time interval between the subsequent signal pulses and/or the duration of the signal pulses is different in the first and second auxiliary control signal.

The controller may be configured to provide the subsequent signal pulses with a signal level. The signal level, in particular an absolute value of the signal level, can be indicative for the magnitude of the actuation force controlled by the signal pulses. The signal level, in particular a sign of the signal level, can be indicative for the direction of the actuation force controlled by the signal pulses. The controller may be configured to change the signal level in between the subsequent signal pulses and the intermediate time interval separating the subsequent signal pulses. The controller may also be configured to change the signal level of different subsequent signal pulses relative to one another. The controller may also be configured to change the signal level of different intermediate time intervals relative to one another.

BRIEF DESCRIPTION OF THE DRAWINGS

Reference will now be made in detail to embodiments, examples of which are illustrated in the accompanying drawings. The drawings illustrate various embodiments and are a part of the specification. The illustrated embodiments are merely examples and do not limit the scope of the disclosure. Throughout the drawings, identical or similar reference numbers designate identical or similar elements. In the drawings.

DETAILED DESCRIPTION OF THE DRAWINGS

Figure 1:
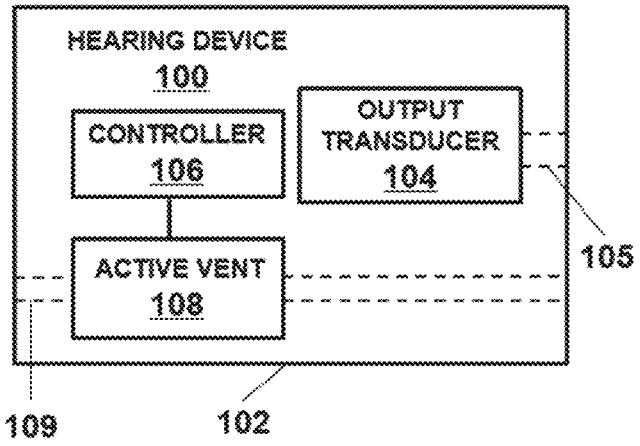
FIGS. 1-2 schematically illustrate exemplary hearing devices including an active vent.

Referring to FIG. 1, a hearing device 100 according to some embodiments of the present disclosure is illustrated. As shown, hearing device 100 includes an acoustic output transducer 104 and an active vent 108 communicatively coupled to a controller 106. Hearing device 100 may include additional or alternative components as may serve a particular implementation.

Hearing device 100 further comprises a housing 102. Housing 102 is configured to be at least partially inserted into an ear canal. After insertion, at least a portion of housing 102 can be in contact with an ear canal wall of the ear canal. Housing 102 can thus form an acoustical seal with the ear canal wall at the housing portion contacting the ear canal wall. The acoustical seal can, at least to some extent, provide acoustical isolation of an inner region of the ear canal from an ambient environment outside the ear canal.

Active vent 108 comprises a venting channel 109. Venting channel 109 extends through an inner volume surrounded by housing 102. Venting channel 109 can acoustically interconnect the inner region of the ear canal and the ambient environment outside the ear canal after insertion of housing 102 into the ear canal. Venting channel 109 is thus configured to provide for venting between the inner region of the ear canal and the ambient environment. Active vent 108 is configured to modify an effective size of venting channel 109. Modifying the effective size of venting channel 109 allows to adjust an amount of the venting between the inner region of the ear canal and the ambient environment. Controller 106 is configured to provide a control signal to control the modification of the effective size of venting channel 109 by active vent 108.

Housing 102 also surrounds a sound conduit 105. Sound conduit 105 is acoustically coupled to output transducer 104. Sound conduit 105 is configured to provide for transmission of sound waves from output transducer 104 to the inner region of the ear canal. In some implementations, as illustrated in FIG. 1, venting channel 109 and sound conduit 105 can be provided separate from one another. In some other implementations, as further exemplified below, venting channel 109 and sound conduit 105 can comprise a common pathway through which sound waves can pass through. Output transducer 104 may be implemented by any suitable audio output device, for instance a loudspeaker or a receiver.

Controller 106 can comprise a signal generator for generating the control signal provided by controller 106 to active vent 108. Controller 106 can thus be configured to control generating the control signal as a predetermined temporal sequence of signal pulses. Accordingly, at least a duration of the signal pulses and/or an intermediate time interval separating the signal pulses can be predetermined by the controller. In some implementations, a total number of the signal pulses in the control signal may be predetermined by the controller. In some implementations, a signal level of the signal pulses may be predetermined by the controller. In some implementations, the controller can be configured to provide the signal pulses with a differing duration and/or a differing intermediate time interval and/or a differing signal level, in particular a differing absolute value of the signal level and/or a differing sign of the signal level.

Controller 106, in particular the control signal generator included with controller 106, can comprise a processing unit and/or an amplifier implemented with hearing device 100. Controller 106 may be configured to generate signal pulses with a differing signal level, for instance a differing voltage or current level. Controller 106 may also be configured to generate signal pulses with a differing duration and/or a differing intermediate time interval separating the signal pulses. For instance, the control signal generator can comprise a digital amplifier, for instance a class-D amplifier. The control signal generator may also comprise a processing unit without an amplifier. Controller 106 can be configured to control a pulse width modulation (PWM), for instance to generate the signal pulses with an equal and/or differing duration and/or an equal and/or differing intermediate time interval separating the signal pulses. Generating the signal pulses with a differing signal level and/or PWM may be performed by the control signal generator. The control signal generator can also be configured to perform a delta-sigma modulation, in particular PDM, and/or a switched modulation and/or binary weighted modulation and/or a multiplexing and/or another type of DAC controlled by controller 106.

Controller 106, in particular the control signal generator included with controller 106, can be communicatively coupled to output transducer 104. Controller 106 can thus be configured to process and/or amplify an audio signal, which is output by acoustic transducer 104, and to generate a control signal for the active vent, which is transmitted to the active vent controlled by controller 106. This can allow a space saving integration of output transducer 104 and active vent 108 in hearing device 100.

Hearing device 100 may further comprise a microphone and/or may be communicatively coupled to a microphone. The microphone can be implemented by any suitable audio detection device and is configured to detect a sound presented to a user of hearing device 100. The sound can comprise audio content (e.g., music, speech, noise, etc.) generated by one or more audio sources included in the ambient environment of the user. The sound can also include audio content generated by a voice of the user during an own voice activity, such as a speech by the user. The microphone can be configured to output an audio signal comprising information about the sound detected from the environment.

Hearing device 100 may further comprise a processing unit and/or may be communicatively coupled to a processing unit. The processing unit can comprise a processor configured to access the audio signal generated by the microphone. The processor may be configured to process the audio signal and to provide the processed audio signal to output transducer 104. The processing unit may also be operative as controller 106 for active vent 108. In particular, controller 106 can be provided as a control program executable by the processor. Controller 106 may also be provided as a hardware component comprised in the processing unit. The processing unit can thus be configured to operate controller 106 in order to provide control signals to active vent 108.

Hearing device 100 may further comprise a memory and/or may be communicatively coupled to a memory. The memory may be implemented by any suitable type of storage medium and may be configured to maintain (e.g., store) data generated, accessed, or otherwise used by the processing unit. For example, the memory may maintain data representative of a sound processing program that specifies how the processor processes the audio signal. The memory may also be used to maintain data representative of a control program that specifies how the processing unit controls the active vent. The processing unit may be configured to execute a boot sequence during which a hearing device program, in particular a program including the sound processing program and/or the control program, is loaded and/or started by the processing unit.

Hearing device 100 may further comprise a user interface and/or be communicatively coupled to a user interface. The user interface may allow a user to set an output parameter of output transducer 104, such as a sound volume, and/or a sound processing parameter of the processing unit, such as a specific sound processing program and/or program parameter. The user interface may also enable a user to interact with controller 106, in particular to effectuate controller 106 to provide a control signal for active vent 108.

Hearing device 100 may be implemented by any type of hearing device configured to enable or enhance hearing of a user wearing hearing device 100. For example, hearing device 100 may be implemented by a hearing aid configured to provide an amplified version of audio content to a user, an earphone, or any other suitable hearing prosthesis. More particularly, different types of hearing devices can be distinguished by the components included in an earpiece enclosed by housing 102. Some hearing devices, such as behind-the-ear (BTE) hearing aids and receiver-in-the-canal (RIC) hearing aids, typically comprise housing 102 and an additional housing configured to be worn at a wearing position outside the ear canal, in particular behind an ear of the user. Some other hearing devices, as for instance earbuds, earphones, in-the-ear (ITE) hearing aids, invisible-in-the-canal (IIC) hearing aids, and completely-in-the-canal (CIC) hearing aids, commonly comprise housing 102 without an additional housing to be worn at the different ear position. For instance, those hearing devices can be provided as two earpieces each comprising such a housing 102 for wearing in a respective ear canal. Depending on a particular implementation of hearing device 100, controller 106 and/or output transducer 104 may be accommodated in earpiece housing 102 or in the additional housing. Housing 102 typically accommodates at least sound conduit 105 for directing sound into the ear canal, and active vent 108.

Figure 2:
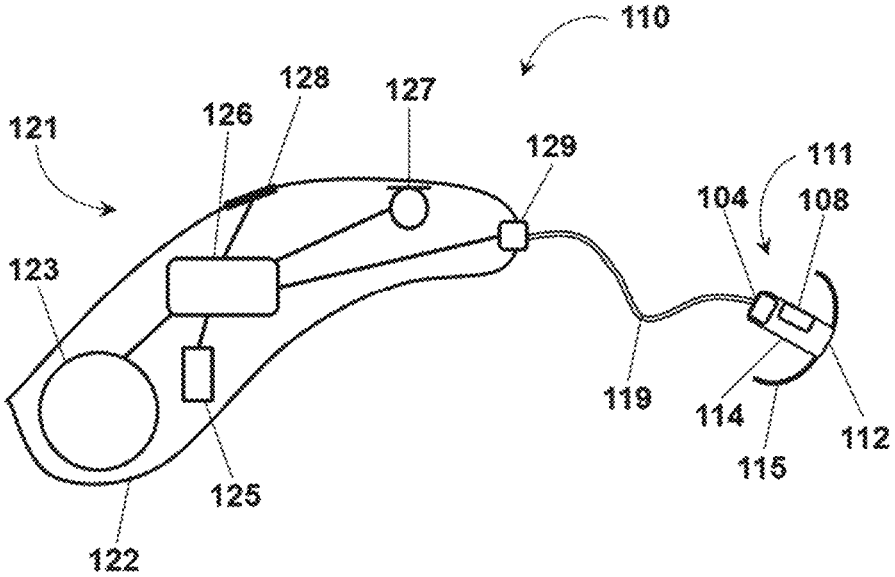

FIG. 2 illustrates exemplary implementations of a hearing device as a RIC hearing aid 110, in accordance with some embodiments of the present disclosure. RIC hearing aid 110 comprises a BTE part 121 configured to be worn at an ear at a wearing position behind the ear, and an ITE part 111 configured to be worn at the ear at a wearing position at least partially inside an ear canal of the ear. ITE part 111 is an earpiece comprising a housing 112 at least partially insertable in the ear canal. Housing 112 comprises an enclosure 114 accommodating output transducer 104 and active vent 108. Housing 112 further comprises a flexible member 115 adapted to contact an ear canal wall when housing 112 is at least partially inserted into the ear canal. In this way, an acoustical seal with the ear canal wall can be provided at the housing portion contacting the ear canal wall.

BTE part 121 comprises an additional housing 122 for wearing behind the ear. Additional housing 122 accommodates a processing unit 126 communicatively coupled to a memory 125, a microphone 127, and a user interface 128 included in BTE part 121. BTE part 121 and ITE part 111 are interconnected by a cable 119. Processing unit 126 is communicatively coupled to output transducer 104 and active vent 108 via cable 119 and a cable connector 129 provided at additional housing 122. Processing unit 126 is thus configured to access an audio signal generated by microphone 127, to process the audio signal, and to provide the processed audio signal to output transducer 104. Processing unit 126 is further configured to provide a control signal to active vent 108, in particular to perform tasks of controller 106 as described above. Microphone 127 may be implemented by any suitable audio detection device, for instance a microphone array operatively coupled to a beamformer. ITE part 111 may comprise at least one additional microphone enclosed by housing 112, in particular inside enclosure 114. User interface 128 may be provided by any suitable device allowing to determine an interaction by a user. For instance, user interface 128 may comprise a push button and/or a touch sensor and/or a tapping detector provided at a surface of additional housing 122. User interface 128 may also be provided as an inertial sensor, in particular an accelerometer, allowing to determine a motional user interaction such as a movement of additional housing 122 caused by manual tapping on additional housing 122. BTE part 121 further includes a battery 123 as a power source for the above described components including output transducer 104 and active vent 108.

Figure 3A:
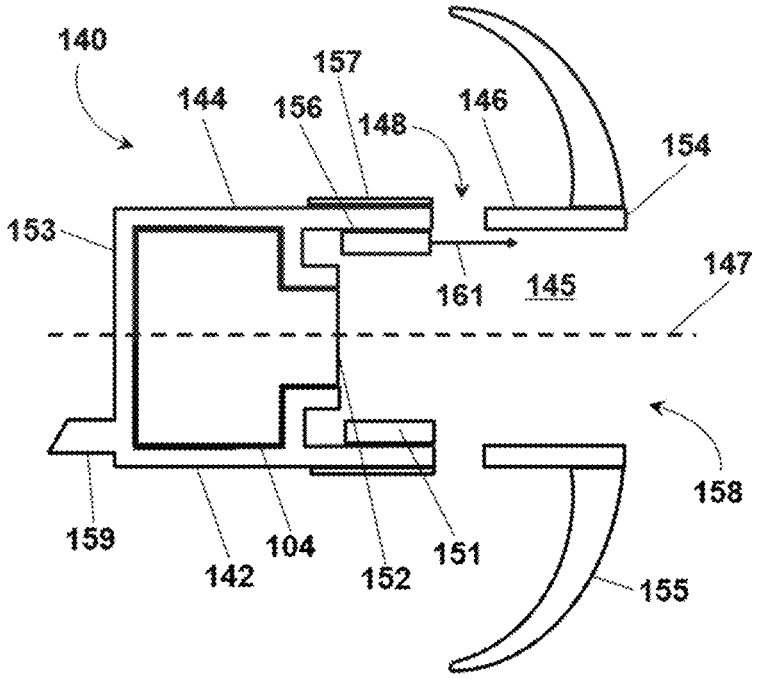
FIGS. 3A, B schematically illustrate an exemplary earpiece of a hearing device including an active vent in a longitudinal sectional view, wherein an acoustic valve of the active vent is in different valve positions.
Figure 3B:
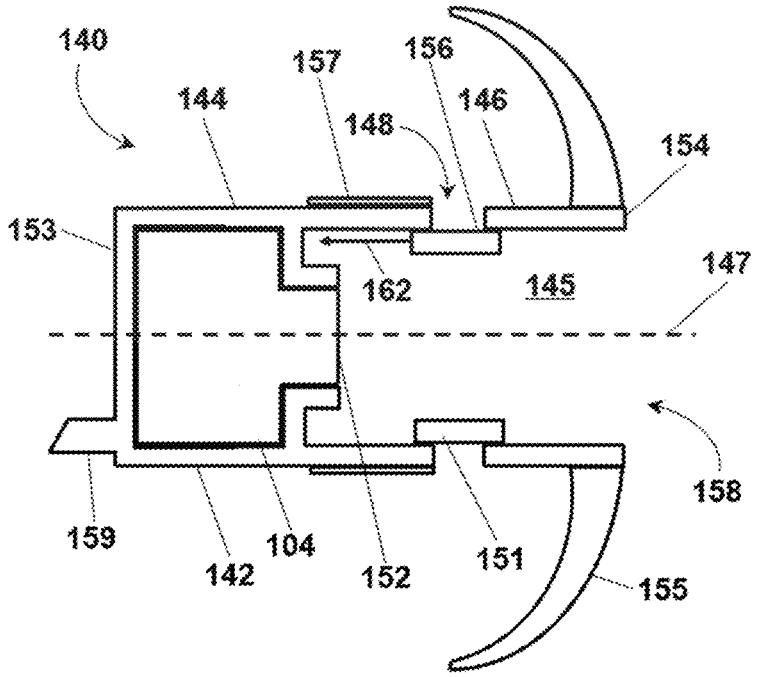

FIGS. 3A and 3B illustrate an earpiece 140 of a hearing device in accordance with some embodiments of the present disclosure. For example, earpiece 111 of hearing device 110 depicted in FIG. 2 may be implemented by earpiece 140. Earpiece 140 comprises a housing 142 configured to be at least partially inserted into an ear canal. Housing 142 comprises an outer wall 144 delimiting an inner space 145 from an exterior of housing 142. Outer wall 144 comprises a side wall 146 extending in a direction of the ear canal when housing 142 is at least partially inserted into the ear canal. Side wall 146 has a circumference surrounding a longitudinal axis 147 of housing 142. Longitudinal axis 147 extends in a direction in which housing 142 is insertable into the ear canal. Housing 142 has an opening 148. Opening 148 is provided as a through-hole in side wall 146. Opening 148 connects inner space 145 with the exterior of housing 142. Inner space 145 can thus be acoustically coupled with the exterior of housing 142 through opening 148.

Outer wall 144 further comprises a front wall 154 at a front end of housing 142. Front wall 154 faces the tympanic membrane at the end of the ear canal when housing 142 is at least partially inserted into the ear canal. Front wall 154 has an opening 158. Opening 158 connects inner space 145 with the exterior of housing 142. The first opening 148 in side wall 146 and the second opening 158 in front wall 154 are acoustically coupled through inner space 145. Inner space 145 thus provides a venting channel between first opening 148 and second opening 158.

Housing 142 further comprises a sealing member 155. Sealing member 155 is configured to contact the ear canal wall when housing 142 is at least partially inserted into the ear canal. Sealing member 155 can thus form an acoustical seal with the ear canal wall such that an inner region of the ear canal between housing 142 and the tympanic membrane is acoustically isolated from the ambient environment outside the ear canal, at least to a certain degree. For instance, sealing member 155 can be provided as an elastic member configured to conform to an individual ear canal shape. Sealing member 155 can also be provided as a contoured member having an outer shape customized to an individual ear canal shape. Sealing member 155 is disposed between first opening 148 and second opening 158 such that the venting channel extending through inner space 145 of housing 142 between first opening 148 and second opening 158 can provide for venting between the inner region of the ear canal and the ambient environment outside the ear canal.

A rear wall 153 is provided at a rear end of housing 142. Rear wall 153 is closed. Output transducer 104 is accommodated in a rear portion of inner space 145 of housing 142 in front of rear wall 153. A sound output 152 of output transducer 104 is provided at a front side of output transducer 104 opposing rear wall 153. Output transducer 104 is thus acoustically coupled to a front portion of inner space 145 surrounded by side wall 146. The front portion of inner space 145 constitutes a sound conduit through which sound can propagate from sound output 152 toward opening 158 at the front end of housing 142 along longitudinal axis 147. The venting channel provided between first opening 148 and second opening 158 extends through the sound conduit.

Earpiece 140 further comprises an acoustic valve 151. Acoustic valve 151 comprises a valve member 156 provided as a moveable mass moveably coupled with housing 142. The moveable coupling of valve member 156 is provided along an inner surface of side wall 146. Valve member 156 can thus be moved relative to opening 148 in side wall 146 between different valve positions. Valve member 156 comprises a surface adapted to cover opening 148 such that the venting channel through opening 148 can at least partially be blocked by valve member 156. In a valve position as illustrated in FIG. 3A, valve member 156 is positioned such that the venting channel through opening 148 is uncovered by valve member 156. In another valve position as illustrated in FIG. 3B, valve member 156 is positioned such that the venting channel through opening 148 is at least partially covered by valve member 156. Other valve positions are conceivable in which the venting channel through opening 148 is blocked to a larger degree as in the situation illustrated in FIG. 3A and to a smaller degree as in the situation illustrated in FIG. 3B. Valve member 156 may thus be gradually moved relative to opening 148 in order to provide an increased or decreased effective size of opening 148. A first valve position and a second valve position may correspond to two different valve positions. For instance, a first valve position may correspond to one of the valve positions illustrated in FIGS. 3A and 3B, and a second valve position may correspond to the other of the valve positions illustrated in FIGS. 3A and 3B.

FIGS. 3A, 3B illustrate a translational movement of valve member 156 in the direction of longitudinal axis 147. Further conceivable is a rotational movement of valve member 156 around longitudinal axis 147 in order to increase or decrease the effective size of opening 148, or a combination of a translational and rotational movement. For instance, the rotational movement may be provided such that valve member 156 is positioned at a surface portion of side wall 146 with a circumferential distance to opening 148 in an unblocked state of opening 148, and at a surface portion of side wall 146 including opening 148 in a blocked state of opening 148. Thus, by the movement of valve member 156 relative to the venting channel between the different valve positions, an effective size of the venting channel can be modified.

During prolonged usage of earpiece 140 inside an ear canal, ingress may accumulate in the venting channel. The ingress may enter the venting channel through first opening 148 and/or second opening 158. The ingress may comprise organic particles such as cerumen and/or loosened skin and/or dirt and/or other debris. The ingress can impede the movement of valve member 156 between the different valve positions. For instance, the ingress may accumulate in between the different valve positions and/or above and/or below valve member 156 causing an adhesion or bonding of the valve member to another component of earpiece 140. As a result, an increased magnitude of an actuation force may be required to overcome the obstruction and to move valve member 156 between the different valve positions. Moreover, the ingress may produce clogging of the venting channel, in particular at first opening 148 and/or second opening 158.

Earpiece 140 further comprises an actuator 157. Actuator 157 is configured to provide an actuation force 161, 162 with a direction and a magnitude acting on valve member 156. The direction includes a first direction for actuating the movement of valve member 156 from the first valve position to the second valve position, and a second direction for actuating the movement of valve member 156 from the second valve position to the first valve position. FIG. 3A schematically illustrates actuation force 161 having a direction for moving valve member 156 from the valve position in FIG. 3A forth to the valve position in FIG. 3B. FIG. 3B schematically illustrates actuation force 162 having a direction for moving valve member 156 from the valve position in FIG. 3B back to the valve position in FIG. 3A. One of the illustrated directions of actuation force 161, 162 is denoted as a first direction, the other as a second direction of the actuation force.

Actuation force 161, 162 can be provided by an electric and/or magnetic interaction of actuator 157 with valve member 156. For instance, actuator 157 can be configured to provide a magnetic field, by which magnetic field the actuation force acting on valve member 156 is provided. To this end, actuator 157 can comprise a first magnetic member and valve member 156 can comprise a second magnetic member configured to interact with the first magnetic member via the magnetic field. To illustrate, actuator 157 can comprise a coil. Providing a current through the coil can produce a magnetic field depending on the provided current. In particular, a magnetic flux produced in the coil by the current can thus be changed by changing the current. Changing a polarity and/or an amount of the current through the coil can thus provide the actuation force to actuate the movement of valve member 156 in the different directions between the different valve positions. Various configurations of the actuator providing the actuation force based on magnetic field interaction with the valve member are described in patent application publication Nos. WO 2019/056715 A1 and EP 3 471 432 A1 in further detail, which are incorporated herewith by reference and can be implemented correspondingly.

Actuation of the movement of acoustic valve 151 can also be based on other interaction types of actuator 157 and valve member 156 which may include, for instance, actuation by an electrical field and/or transmission of a mechanical force and/or a pressure transfer and/or an actuation of a piezoelectric force. For example, actuator 157 may comprise a micromotor mechanically coupled to valve member 156 in order to transmit a mechanical force from the micromotor to valve member 156. As another example, valve member 156 may comprise a piezoelectric element and actuator 157 may comprise a conductor connected to the piezoelectric element such that a current through the conductor can produce a movement and/or deformation of the piezoelectric element. Various configurations of those interaction types are described, for instance, in patent application publication Nos. EP 2 164 277 A2 and DE 199 42 707 A1 in further detail, which are incorporated herewith by reference and can be implemented correspondingly.

An active vent of earpiece 140 comprises acoustic valve 151, actuator 157, and the venting channel between first opening 148 and second opening 158. Earpiece 140 further comprises a connector 159. Via connector 159, a controller is connectable to actuator 157. The controller, in particular a processing unit, may also be connected to output transducer 104 via connector 159. A power source may be connected to actuator 157 and/or output transducer 104 via connector 159.

Figure 4A:
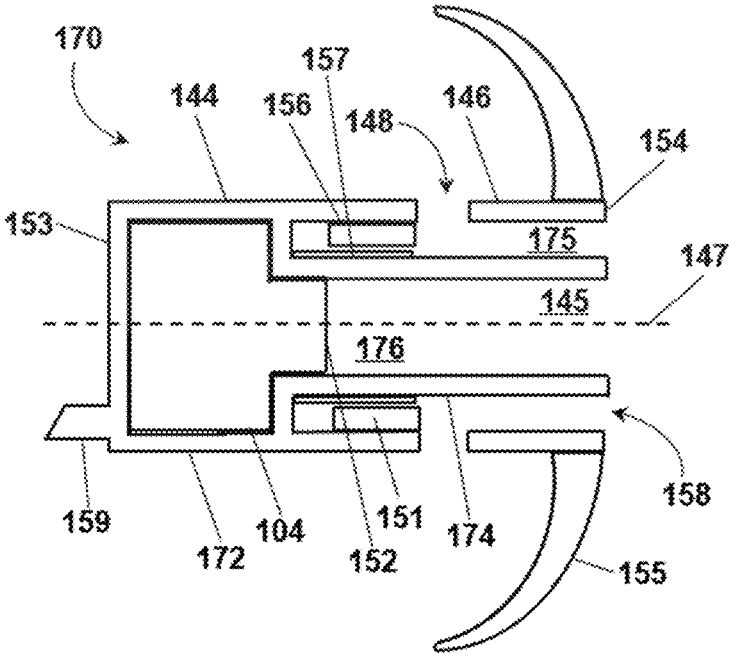
FIG. 4A, B schematically illustrate another exemplary earpiece of a hearing device including an active vent in a longitudinal sectional view, wherein an acoustic valve of the active vent is in different valve positions.
Figure 4B:
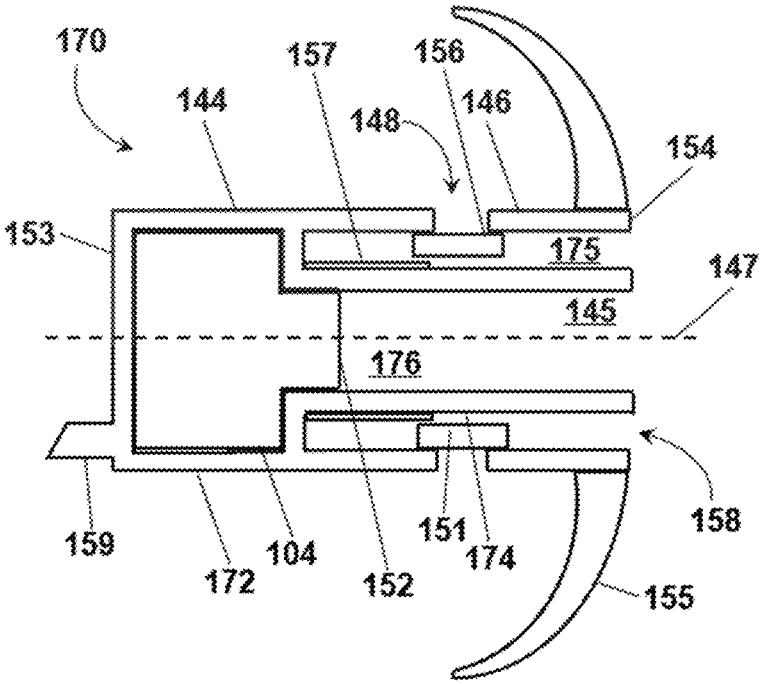

FIGS. 4A and 4B illustrate an earpiece 170 of a hearing device in accordance with some embodiments of the present disclosure. Earpiece 170 comprises a housing 172 configured to be at least partially inserted into an ear canal. Housing 172 comprises an inner side wall 174 extending through inner space 145. Inner side wall 174 is provided between side wall 146 of outer wall 144 and longitudinal axis 147. Valve member 156 can be moveably coupled with inner side wall 174 and/or outer side wall 146 of housing 172 such that it can be moved between a valve position in which opening 148 is not blocked by valve member 156, as illustrated in FIG. 4A, and a valve position in which opening 148 is blocked by valve member 156, as illustrated in FIG. 4B. Inner side wall 174 circumferentially surrounds longitudinal axis 147. Inner side wall 174 longitudinally extends from sound output 152 of output transducer 104 to opening 158 at the front end of housing 142. Along its longitudinal extension, inner wall 174 divides inner space 145 in an outer volume portion 175 adjoining outer side wall 146 and an inner volume portion 176 including longitudinal axis 147. Correspondingly, inner side wall 174 divides opening 155 at front wall 154 in an outer aperture and an inner aperture. Outer volume portion 175 forms a venting channel between first opening 148 and outer aperture of second opening 158. Inner volume portion 176 forms a sound conduit between sound output 152 of output transducer 104 and inner aperture of second opening 158. Venting channel 175 and sound conduit 176 are separate from one another.

Figure 5A:
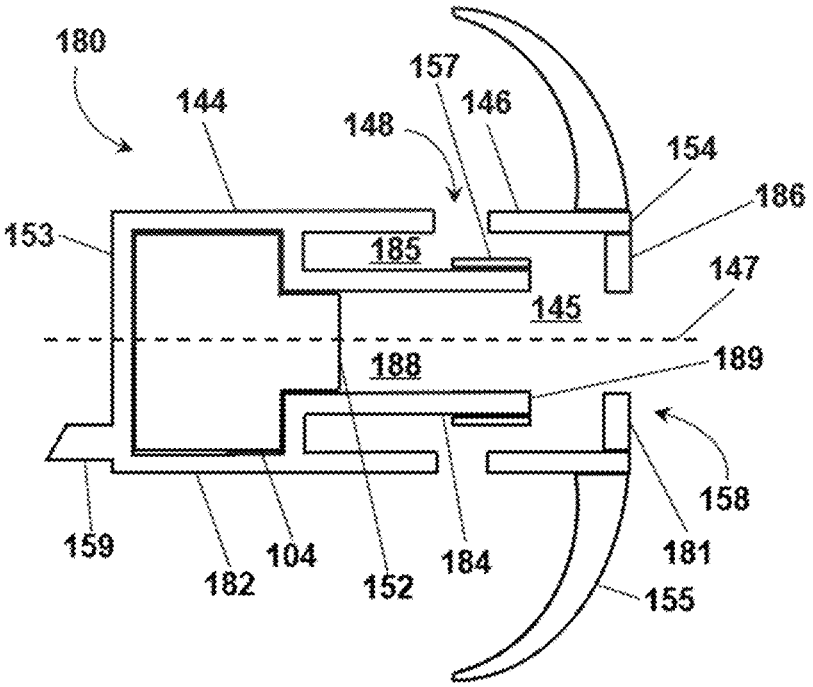
FIG. 5A, B schematically illustrate another exemplary earpiece of a hearing device including an active vent in a longitudinal sectional view, wherein an acoustic valve of the active vent is in different valve positions.
Figure 5B:
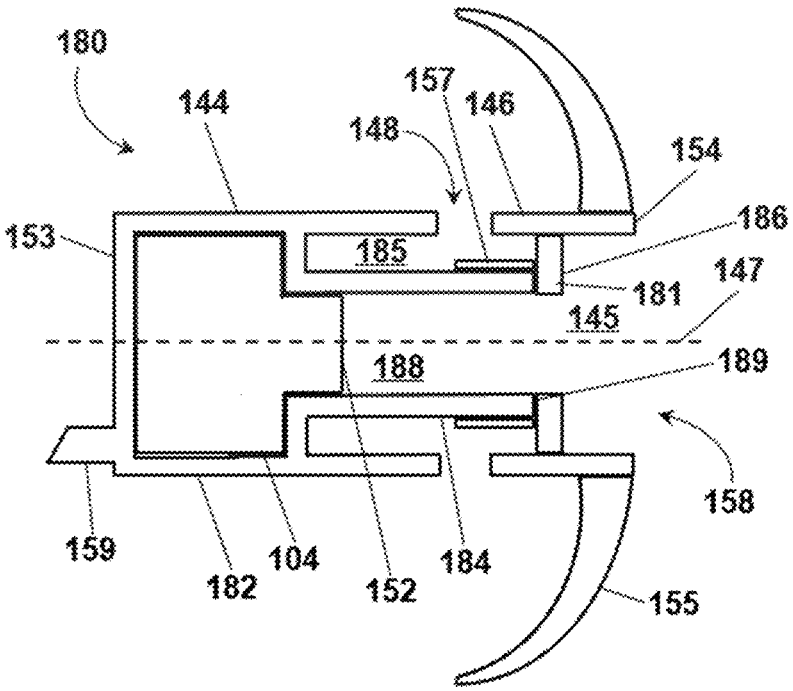

FIGS. 5A and 5B illustrate an earpiece 180 of a hearing device in accordance with some embodiments of the present disclosure. Earpiece 180 comprises a housing 182 configured to be at least partially inserted into an ear canal. An inner side wall 184 of housing 180 extends through inner space 145 in a direction of longitudinal axis 147 from sound output 152 beyond a portion of outer side wall 146 at which opening 148 is provided. The longitudinal extension of inner side wall 184 terminates at a front end 189. Front end 189 of inner side wall 184 has a longitudinal distance to opening 158 at the front end of housing 142. Along its longitudinal extension, inner side wall 184 divides inner space 145 in an outer volume portion 185 adjoining outer side wall 146 and an inner volume portion 188. A venting channel extends through outer volume portion 185 between first opening 148 and second opening 158. A sound conduit extends between sound output 152 and second opening 158. The venting channel and the sound conduit thus share a common portion of inner space 145 at second opening 158.

A valve member 186 of an acoustic valve 181 is moveably coupled with housing 182. Valve member 186 comprises a surface radially extending between a radius of outer side wall 146 and a radius of inner side wall 184. Valve member 186 is moveable between a valve position in which valve member 186 is spaced from front end 189 at a longitudinal distance, as illustrated in FIG. 5A, and a valve position in which valve member 186 abuts against front end 189, as illustrated in FIG. 5B. In the valve position depicted in FIG. 5A, the venting channel between first opening 148 and second opening 158 is open. In the valve position depicted in FIG. 5B, the venting channel between first opening 148 and second opening 158 is blocked by valve member 186, at least to a certain extent. In his way, the effective size of the venting channel can be modified by the movement of the valve member relative to the venting channel. In the valve position depicted in FIG. 5A, valve member 186 is positioned at second opening 158. In the valve position depicted in FIG. 5B, valve member 186 is positioned further apart from second opening 158.

Figure 6A:
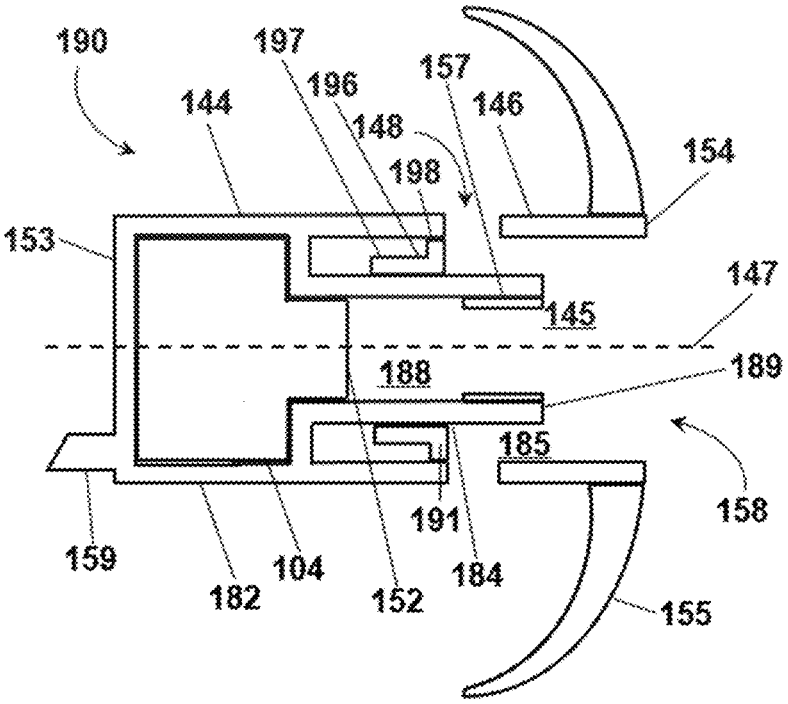
FIG. 6A, B schematically illustrate another exemplary earpiece of a hearing device including an active vent in a longitudinal sectional view, wherein an acoustic valve of the active vent is in different valve positions.
Figure 6B:
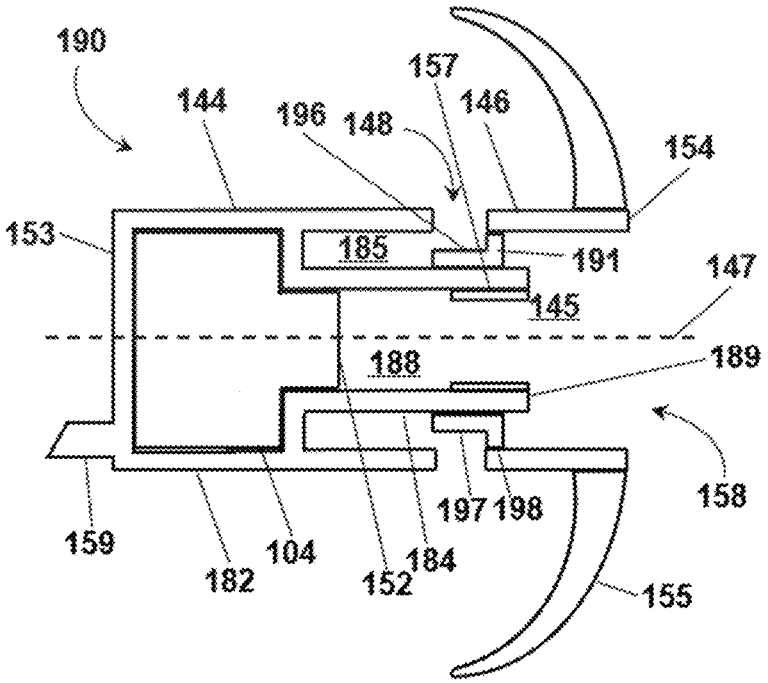

FIGS. 6A and 6B illustrate an earpiece 190 of a hearing device in accordance with some embodiments of the present disclosure. A valve member 196 of an acoustic valve 191 is moveably coupled with housing 182 in between outer side wall 146 and inner side wall 184. Valve member 196 comprises a rear portion 197 having a smaller wall thickness in a direction perpendicular to longitudinal axis 147 as compared to a front portion 198 of valve member 196. Front portion 198 radially extends between an outer surface of inner side wall 184 and an inner surface of outer side wall 146. Rear portion 197 adjoins outer surface of inner side wall 184 and is spaced from inner surface of outer side wall 146. Valve member 196 longitudinally extends in parallel to inner side wall 184. Valve member 196 is moveable between a valve position in which valve member 196 is positioned at a larger longitudinal distance from second opening 158 such that front portion 198 of valve member 196 is positioned behind first opening 148 in outer side wall 146, as illustrated in FIG. 6A, and a valve position in which valve member 196 is positioned at a smaller longitudinal distance from second opening 158 such that front portion 198 of valve member 196 is positioned in front of first opening 148, as illustrated in FIG. 6B. In the valve position depicted in FIG. 6A, the venting channel between first opening 148 and second opening 158 is open. In the valve position depicted in FIG. 6B, the venting channel between first opening 148 and second opening 158 is blocked by valve member 196, at least to some extent. In his way, the effective size of the venting channel can be modified by the movement of the valve member relative to the venting channel. In the valve position illustrated in FIG. 6B, rear portion 197 of valve member 196 is positioned at an axial position of first opening 148 in parallel to longitudinal axis 147. In this valve position, rear portion 197 of valve member 196 faces first opening 148 at a radial distance perpendicular to longitudinal axis 147. Thus, in this valve position, valve member 196 is visible at first opening 148 from the exterior of housing 182 upon inspection of first opening 148 by an individual from the exterior.

The above description of embodiments of hearing devices 100, 110 and earpieces 140, 170, 180, 190 has been carried out for illustrative purposes without the intention to limit the scope of the subsequent disclosure in which operations related to an active vent included in a hearing device are described. Those operations can also be applied in other embodiments of hearing devices comprising an active vent, for instance in the hearing devices disclosed in patent application publication Nos. WO 2019/056715 A1 and EP 3 471 432 A1, which are herewith included by reference.

Figure 7:
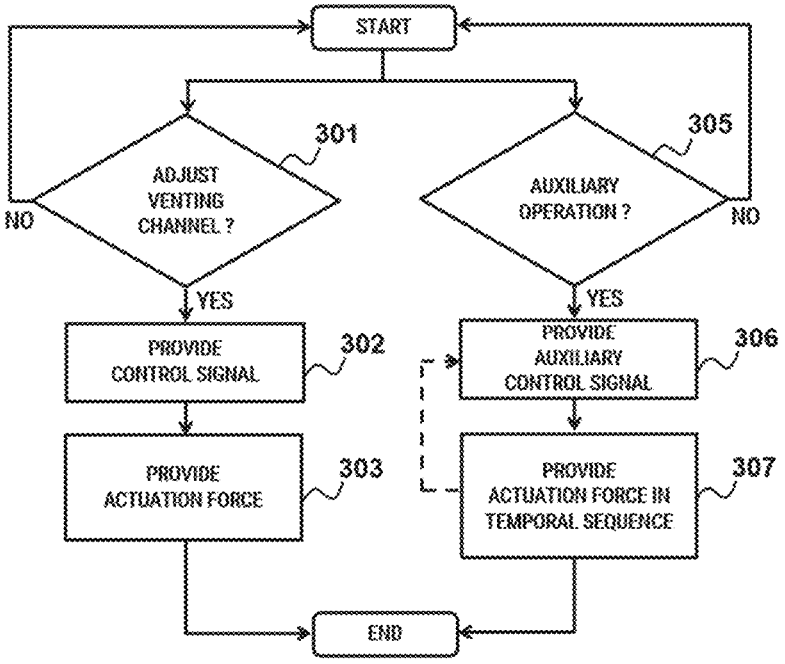
FIGS. 7-11 illustrate exemplary methods of operating a hearing device comprising an active vent.

FIG. 7 illustrates a method of operating a hearing device comprising an active vent according to some embodiments of the present disclosure. In operation 301, information is gathered whether an effective size of a venting channel of the active vent shall be modified. In some implementations, the information about a desired modification of the venting channel can be provided by a user. Gathering the information from the user can comprise receiving a user command in the form of an input signal from a user interface operated by the user. Thus, the user may adjust the venting channel according to his preferences.

In some implementations, the information about a desired modification of the venting channel can be determined depending on parameters determined by the hearing device. Those parameters may include properties of an ambient sound. The ambient sound may be detected by a microphone. Gathering the information about the properties of the ambient sound can comprise processing of an audio signal received from the microphone by a processing unit. For instance, in rather noisy and/or low input level scenes of the ambient sound, the gathered information may be interpreted by the processing unit as a command to initiate reducing the effective size of the venting channel. In acoustical environments with rather low ambient noise and/or rather high signal to noise ratio (SNR), the gathered information may be interpreted by the processing unit as a command to initiate enlarging the effective size of the venting channel. The parameters may also include properties of an own voice activity of the user. The own voice activity may be detected by a voice activity detector (VAD). Gathering the information about the properties of the own voice activity can comprise processing of an own voice detection signal received from the VAD. When the own voice detection signal exceeds a certain threshold, the gathered information may be interpreted as a command to initiate enlarging the effective size of the venting channel, for instance to reduce occlusion. The parameters may also include humidity properties of the ear canal which may detected by a humidity detector. At a certain humidity level, the gathered information may be interpreted as a command to initiate enlarging the effective size of the venting channel to reduce humidity.

In operation 302, a control signal is provided to an actuator of the active vent when the gathered information indicates that the effective size of the venting channel shall be modified. The control signal can be provided by a controller. The controller may be a processing unit operating a control program of the actuator. The control signal can be provided as a first control signal and a second control signal. The first control signal controls the actuator to provide the actuation force in a first direction for actuating a movement of the valve member from a first valve position to a second valve position. The second control signal controls the actuator to provide the actuation force in a second direction for actuating a movement of the valve member from the second valve position to the first valve position. The effective size of the venting channel can thus be modified by a movement of the valve member between the different valve positions. In particular, the effective size can be enlarged by a movement of the valve member in the direction of the actuation force controlled by one of the first and second control signal, and the effective size can be reduced by a movement of the valve member in the direction of the actuation force controlled by the other of the first and second control signal. In order to provide the respective movement of the valve member, the first control signal and second control signal control the actuator to provide the actuation force with a magnitude required for the movement.

For instance, one of the control signals can control the actuator to provide the actuation force in the direction for actuating the movement of the valve member from the valve position depicted in FIGS. 3A, 4A, 5A, 6A to the valve position depicted in FIGS. 3B, 4B, 5B, 6B. The other of the control signals can control the actuator to provide the actuation force in the direction for actuating the movement of the valve member from the valve position depicted in FIGS. 3B, 4B, 5B, 6B to the valve position depicted in FIGS. 3A, 4A, 5A, 6A. The first control signal and the second control signal can be different or equal. The first control signal and the second control signal are distinguished by their technical effect when they are provided to the actuator in that one of the control signals controls the actuator to provide the actuation force in a direction for enlarging the effective size of the venting channel, and the other of the control signals controls the actuator to provide the actuation force in a direction for reducing the effective size of the venting channel. In operation 303, after the first or second control signal has been provided to the actuator, the actuator provides the actuation force in the first direction or in the second direction, according to the control signal. Thus, the acoustic valve may be moved between the different valve positions to provide a desired reduced or enlarged effective size of the venting channel, depending on the magnitude of the actuation force being sufficient to cause the movement of the valve member.

In operation 305, information is gathered whether an auxiliary operation of the active vent shall be executed. The auxiliary operation can comprise any operation involving an actuation force acting on the valve member in a predetermined temporal sequence. For instance, the auxiliary operation can comprise a single movement of the valve member between the different valve positions which is desired to be accomplished by a sequential application of the actuation force. The auxiliary operation can also comprise a plurality of movements of the valve member between the different valve positions which is desired to be accomplished by a sequential application of the actuation force, such as a repeated forth and back movement of the valve member between the first valve position and the second valve position. A repeated displacement of the valve member between the different valve positions may be desired to take place at a rather small repetition frequency, such that a rather long-term modification of the venting channel could be steadily perceivable by a user of the hearing device. A repeated displacement of the valve member between different valve positions may also be desired to take place at a rather large repetition frequency, such that the repeated movement of the valve member may be too fast in order to provide a modification of the venting channel steadily perceivable by the user of the hearing device and/or that would be required to adjust the venting to a new hearing situation.

The auxiliary operation can provide any additional functionality of the active vent. The auxiliary operation can include, for instance, a checking and/or testing functionality of the active vent for different valve positions, a reliability enhancement functionality, an operating noise optimization functionality, a repair functionality, a cleaning functionality, a vibration functionality, a notification functionality, a sound indication functionality, a fitting functionality, and/or the like.

In some implementations, the auxiliary operation can be initiated by a user. Gathering the information from the user can comprise receiving a user command in the form of an input signal provided by a user interface operated by the user. The input signal can be different from an input signal that may be provided in operation 301 in order to allow a distinction between those operations. The user interface may be provided on the hearing device and/or by a remote device connectable to the hearing device. For instance, the remote device can be a smartphone and/or a personal computer. The user interface may also be adapted to be operated by another individual, for instance a health care professional (HCP) during a fitting of the hearing device.

In some implementations, the auxiliary operation can be initiated depending on an event determined by the hearing device. Gathering information about the event can be performed by a processing unit of the hearing device. The event can include an operational state of the hearing device such as turning the hearing device on and/or rebooting the hearing device. For instance, the event may be determined by a processing unit of the hearing device during executing a boot sequence. The event can also include receiving a notification signal by the hearing device. For instance, the notification signal may be a phone call signal. The phone call signal may be transmitted to the hearing device by an auxiliary device such as a smartphone. The notification signal may also be a signal scheduled by a user program, such as an agenda, timer, or a database application installed on a smartphone. The notification signal can also be a periodically provided signal, for instance a signal provided at a specific time per day. In some implementations, the auxiliary operation can be initiated depending on parameters determined by the hearing device. Those parameters may include properties of an ambient sound and/or an own voice activity of the user. Gathering information about the ambient sound and/or own voice activity can comprise processing of an audio signal and/or an own voice detection signal by a processing unit.

In operation 306, an auxiliary control signal is provided to the actuator of the active vent when the information gathered in operation 305 indicates that the auxiliary operation of the active vent shall be executed. The auxiliary control signal controls the actuator to provide the actuation force in a temporal sequence at a plurality of times, each time to provide the actuation force either in the first direction or in the second direction. The direction of the actuation force can be changed at different times of said temporal sequence. In addition or alternatively, the magnitude of the actuation force can be lowered between different times of said temporal sequence as compared to the magnitude of the actuation force provided at the different times. For instance, the magnitude of the actuation force may be lowered to a value of substantially zero such that the actuation force may be deactivated between the different times.

The temporal sequence of the actuation force controlled by the auxiliary control signal may be provided to control the actuator to actuate the movement of the valve member from the first valve position to the second valve position, or from the second valve position to the first valve position. The temporal sequence of the actuation force may also be provided to control the actuator to actuate the movement of the valve member from the first valve position to the second valve position, and subsequently from the second valve position to the first valve position. For instance, the auxiliary control signal can be configured to actuate the movement of the valve member from the valve position depicted in FIGS. 3A, 4A, 5A, 6A to the valve position depicted in FIGS. 3B, 4B, 5B, 6B, and subsequently back to the valve position depicted in FIGS. 3A, 4A, 5A, 6A. The auxiliary control signal can also be configured to actuate the movement of the valve member from the valve position depicted in FIGS. 3B, 4B, 5B, 6B to the valve position depicted in FIGS. 3A, 4A, 5A, 6A, and subsequently back to the valve position depicted in FIGS. 3B, 4B, 5B, 6B. The auxiliary control signal can also be configured to actuate the movement of the valve member forth and back between the different valve positions multiple times at a repetition frequency.

In operation 307, after the auxiliary control signal has been provided to the actuator, the actuator provides the actuation force in the temporal sequence as controlled by the auxiliary control signal. Thus, the acoustic valve may be moved between the different valve positions in a way to provide the auxiliary operation of the active vent, wherein the properties of the valve movement can depend on the direction and magnitude of the actuation force in the temporal sequence.

In some implementations, the auxiliary control signal can be repeatedly provided in operation 306 to control the temporal sequence of the actuation force in operation 307, as indicated in FIG. 7 by a dashed arrow. The repeated provision of the auxiliary control signal may be terminated depending on a user input from a user interface and/or on an event determined by the hearing device and/or after a predetermined number in which the auxiliary control signal has been provided. The repeated provision of the auxiliary control signal may be employed for various auxiliary operations of the active vent, for instance, to provide a checking and/or testing functionality, a reliability enhancement functionality, an operating noise optimization functionality, a maintenance functionality, a repair functionality, a cleaning functionality, a vibration functionality, a sound indication functionality, and/or a fitting functionality of the active vent, as further described below.

Operation 305 can be performed independently from operation 301. In some implementations, operations 301 and 305 can be performed simultaneously. For instance, depending on whether the respective information has been gathered first in operation 301 or in operation 305, either operations 302, 303 or operations 306, 307 may be executed. In some implementations, operations 301 and 305 can be performed in a mutually exclusive manner. For instance, the hearing device may comprise an operating mode for a venting regulation, in which operations 301, 302, and 303 can be performed, and an operating mode for an auxiliary active vent operation, in which operations 305, 306, and 307 can be performed. The respective operating mode may be selectable by a user and/or automatically selected by the hearing device depending on predetermined criteria. The criteria may comprise a momentary position of the earpiece inside or outside an ear canal, an execution of a specific sound processing program, and/or the like.

Figure 8:
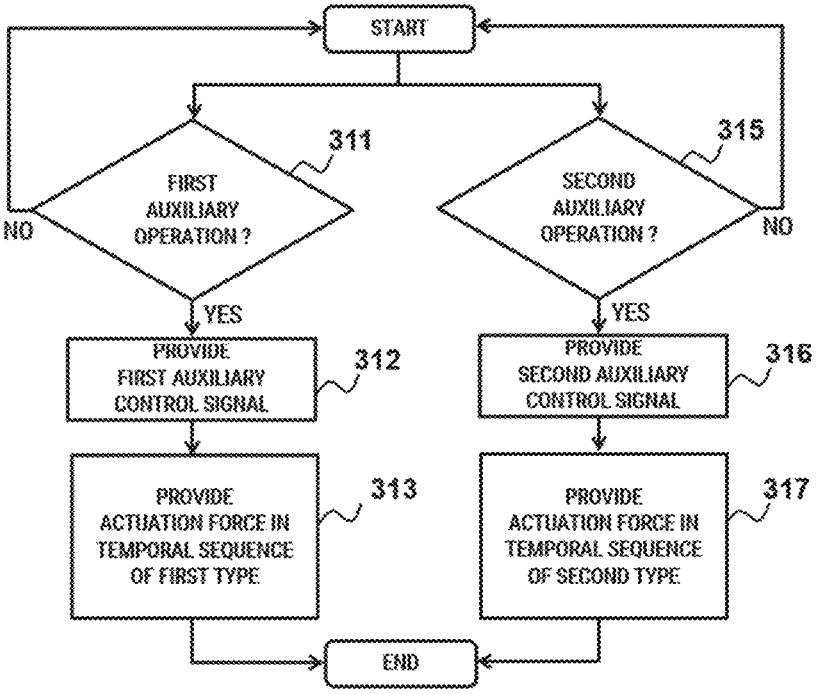

FIG. 8 illustrates a method of operating a hearing device comprising an active vent according to some embodiments of the present disclosure. In operation 311, information is gathered whether a first auxiliary operation of the active vent shall be executed. In operation 315, information is gathered whether a second auxiliary operation of the active vent shall be executed. For instance, the first auxiliary operation may be one of the above mentioned auxiliary operations of the active vent, and the second auxiliary operation another one. Thus, any additional functionality of the active vent may be provided by the first auxiliary operation and the second auxiliary operation. Operations 311, 315 can be performed independently from one another, in particular simultaneously or in a mutually exclusive manner Operations 311, 315 may be performed in the place of operation 305 of the method illustrated in FIG. 7.

A first auxiliary control signal is either provided to the actuator of the active vent in operation 312 when the information gathered in operation 311 indicates that the first auxiliary operation of the active vent shall be executed, or a second auxiliary control signal is provided to the actuator in operation 316 when the information gathered in operation 315 indicates that the second auxiliary operation of the active vent shall be executed. In particular, when operations 311, 315 are performed simultaneously, either operation 312 or operation 316 may be performed depending on whether the information has been gathered first in operation 311 or in operation 315. The first auxiliary control signal controls the actuator to provide the actuation force in a first type of a temporal sequence, and the second auxiliary control signal controls the actuator to provide the actuation force in a second type of a temporal sequence. The first type and the second type of the temporal sequence can be distinguished by controlling the actuator to provide a different direction and/or magnitude of the actuation force during at least one time of the temporal sequence of the actuation force. The first type and the second type of the temporal sequence can also be distinguished by controlling the actuator to provide a different duration of the actuation force during at least one time of the temporal sequence of the actuation force and/or a different time interval between at least two times of the temporal sequence of the actuation force.

Depending on whether the first auxiliary control signal is provided in operation 312 or the second auxiliary control signal is provided in operation 316, the actuator may actuate a first type of movement of the valve member according to the first auxiliary control signal in operation 313, or a second type of movement of the valve member according to the second auxiliary control signal in operation 313. Operations 312, 316 may be performed in the place of operation 306, and operations 313, 317 may be performed in the place of operation 307 of the method illustrated in FIG. 7. In some implementations, the auxiliary control signal may be repeatedly provided in at least one of operations 312, 316 to repeatedly control the actuation of the temporal sequence of the actuation force in operation 313, 317, correspondingly to the dashed arrow described above in conjunction with FIG. 7 with respect to operations 306, 307.

The first type of temporal sequence of the actuation force actuated in operation 313 and the second type of temporal sequence of the actuation force actuated in operation 317 can provide for a different auxiliary operation of the active vent. To illustrate, the first type of movement of the valve member may provide one of a checking and/or testing functionality, a reliability enhancement functionality, an operating noise optimization functionality, a maintenance functionality, a repair functionality, a cleaning functionality, a vibration functionality, a notification functionality, a sound indication functionality, a fitting functionality, and the second type of movement of the valve member may provide another one of these functionalities. As another example, the first type of movement of the valve member may provide one of the auxiliary functionalities with first properties defined by the first auxiliary control signal, and the second type of movement of the valve member may provide the auxiliary functionality with a second properties defined by the second auxiliary control signal.

In particular, the first type of movement of the valve member may correspond to a movement in the first direction of the actuation force and the second type of movement of the valve member may correspond to a movement in the second direction of the actuation force. Thus, the first auxiliary control signal and the second auxiliary control signal may be employed in the place of the first control signal and the second control signal in order to provide a modification of the effective size of the venting channel, for instance to enhance the reliability of the first control signal and the second control signal for the actuation of the valve member and/or to optimize the operating noise during actuation of the valve member.

An additional number of auxiliary control signals may be implemented to provide an additional number of auxiliary operations of the active vent. For instance, at least a third and/or fourth and/or fifth and/or sixth auxiliary control signal may be provided. The actuator may then be controlled to provide the actuation force in a third and/or fourth and/or fifth and/or sixth type of the temporal sequence in order to provide a third and/or fourth and/or fifth and/or sixth auxiliary operation of the active vent. Operation 312 and/or 316 may be correspondingly applied to provide the additional auxiliary control signal controlling the actuator to provide the additional type of the temporal sequence of the actuation force in an operation corresponding to operation 313 and/or 317. The additional type of the temporal sequence can be distinguished from the other types by controlling the actuator to provide a different direction and/or magnitude of the actuation force during at least one time of the temporal sequence of the actuation force and/or by controlling the actuator to provide a different duration of the actuation force during at least one time of the temporal sequence of the actuation force and/or a different time interval between at least two times of the temporal sequence of the actuation force. An operation corresponding to operation 311 and/or 315 may be correspondingly applied, in particular simultaneously with operation 311 and/or 315, or in a mutually exclusive manner, to gather information whether the additional auxiliary operation shall be executed.

Figure 9:
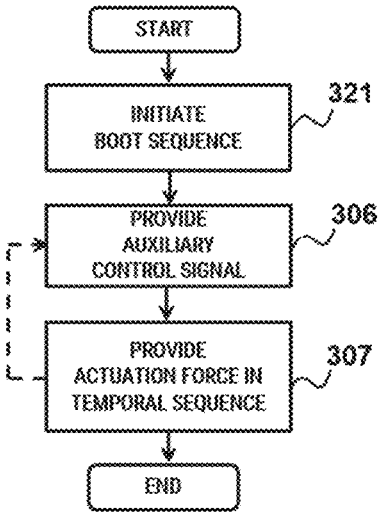

FIG. 9 illustrates a method of operating a hearing device comprising an active vent according to some embodiments of the present disclosure. In operation 321, a boot sequence is initiated. For instance, the boot sequence may be initiated after turning the hearing device on and/or waking the hearing device up from a stand by mode and/or initiating a reboot of the hearing device, in particular during execution of a hearing device program. The boot sequence can be executed by a processing unit of the hearing device. Executing the boot sequence can comprise loading a hearing device program from a memory into the processing unit and/or starting a hearing device program by the processing unit. During executing the boot sequence, operation 306 of providing the auxiliary control signal to the actuator of the active vent is performed. Subsequently, operation 307 of providing the actuation force acting on the valve member in the temporal sequence is performed.

The temporal sequence of the actuation force controlled by the auxiliary control signal may be provided such that the valve member can be moved from a first valve position to a second valve position, and subsequently the valve member can be moved back from the second valve position to the first valve position. Allowing such a movement of the valve member may require a sufficient value of a magnitude of the actuation force acting on the valve member. In this way, a checking functionality of the active vent may be implemented, for instance to verify the sufficient magnitude of the actuation force. A situation in which the position of the valve member in the second valve position cannot be observed when the auxiliary control signal has been provided may indicate a malfunction of the active vent, in particular that the actuation force has been provided with a magnitude below the sufficient value. The malfunction of the active vent may be caused by obstructions in the pathway of the valve member. For instance, ingress may have entered the venting channel and may impede a movement of the valve member from the first valve position to the second valve position, at least with a magnitude of the actuation force that has been currently employed. The checking functionality may thus allow a verification of a proper functioning of the active vent each time when the boot sequence is initiated in operation 321.

The proper functioning of the active vent may be verified by a visual inspection of the valve member from the exterior of an earpiece of the hearing device when the earpiece is not inserted into the ear canal. For instance, the auxiliary control signal may control the actuator to provide a predetermined time during which the valve member is positioned in the second valve position before the valve member is moved back to the first valve position. The predetermined time may be selected to be long enough such that the position of the valve member in the second valve position can be visually identified under inspection by human eyes. The temporal sequence of the actuation force may also be provided such that the valve member can be moved again to the second valve position from the first valve position, subsequently after it has been moved back to the first valve position from the second valve position. The auxiliary control signal may then also control the actuator to provide a predetermined time during which the valve member is positioned in the first valve position before the valve member is moved again to the second valve position to allow a corresponding visual identification of the valve member in the first valve position. The visual inspection may be carried out through an opening of the housing of the earpiece through which the valve member can be identified from the exterior.

As indicated by the dashed arrow, the auxiliary control signal may be repeatedly provided in operation 306 to control the temporal sequence of the actuation force in operation 307. The repeated provision may be terminated after a user input from a user interface has been received. The user input can enable the user or another individual to confirm a proper functioning of the active vent. The checking functionality may thus be terminated depending on whether the proper functioning of the active vent has been verified.

The checking functionality of the active vent may also be executed independently from the boot sequence initiated in operation 321. For instance, an input signal from a user interface may be provided in the place of operation 321. Depending on whether such an input signal has been received, operation 306 of providing the auxiliary control signal and operation 307 of actuating the movement of the valve member can be performed. In this way, the proper functioning of the active vent can be verified on demand by the user and/or other individuals such as an HPC. A user interface on the hearing device and/or a user interface on a remote device connectable to the hearing device may be employed to provide the input signal. In the place of operation 321, the checking functionality of the active vent may also be provided depending on another event, for instance when turning the hearing device on and/or off, and/or after a certain time of usage of the hearing device.

The hearing device may comprise a processing unit configured to determine the position of the acoustic valve in the first valve position or in the second valve position. By determining the position of the acoustic valve in the first valve position or in the second valve position, the auxiliary control signal provided in operation 306 may be employed to implement a testing functionality of the active vent. During the testing functionality, the temporal sequence of the actuation force controlled by the auxiliary control signal may be provided such that the valve member can be moved in between the first and second valve position, in particular forth and back between the valve positions, depending on a sufficient magnitude of the actuation force. Determining the position of the acoustic valve in the first valve position after the auxiliary control signal has controlled the actuator to move the acoustic valve to the second valve position can thus indicate a malfunction of the active vent, for instance caused by obstructions such as ingress in the venting channel, such that the magnitude of the actuation force may be insufficient to allow the movement of the valve member between the valve positions.

For instance, in order to determine a momentary position of the acoustic valve, the hearing device may comprise a microphone configured to detect sound and to provide an audio signal based on the detected sound. A processing unit communicatively coupled to the microphone may determine a signal to noise ratio and/or a feedback between an output transducer of the hearing device and the microphone in the audio signal. An increased value of the signal to noise ratio and/or feedback can indicate the acoustic valve in a valve position at which the effective size of the venting channel is increased as compared to another valve position at which the effective size of the venting channel is reduced. The valve position at which the effective size of the venting channel is increased may correspond to one of the first and second valve position, and the valve position at which the effective size of the venting channel is reduced may correspond to the other of the first and second valve position. In this way, the processing unit may determine a momentary position of the acoustic valve in the first valve position or in the second valve position.

The auxiliary control signal provided in operation 306 may also be employed to provide a repair functionality of the active vent. Obstructions in the pathway of the valve member may cause a malfunction of the active vent. For instance, ingress accumulated in the venting channel may impede the movement of the valve member between the different valve positions, at least for a given actuation force. To illustrate, the first or second control signal may be provided with the intention to increase or reduce the effective size of the venting channel, but the magnitude of the actuation force controlled by the first and/or second control signal may be insufficient to provide a corresponding movement of the valve member due to the ingress accumulated in the venting channel.

In the repair functionality, the auxiliary control signal can control the actuator to provide the actuation force in a temporal sequence which can allow to overcome the obstructions, for instance to detach the valve member from the ingress. In particular, the temporal sequence of the actuation force can cause a repeated agitation and/or jiggling of the valve member leading to the detachment. Moreover, the temporal sequence can give rise to resonances between the valve member and the environment to which the valve member may be coupled by the ingress, which may further enhance the detachment of the valve member from the obstructions. Detaching the valve member by the repair functionality can then allow to employ the first or second control signal to increase or reduce the effective size of the venting channel with a sufficient magnitude of the actuation force to provide the movement of the valve member.

In the repair functionality, the auxiliary control signal may also control the actuator to provide the actuation force with an increased magnitude as compared to the magnitude of the actuation force controlled by the first control signal and the second control signal. The larger magnitude of the force may further assist the detachment. Moreover, the auxiliary control signal may control the actuator to successively increase the magnitude of the actuation force, for instance starting from an initial value corresponding to the magnitude of the actuation force controlled by the first control signal and/or the second control signal to a larger value. The auxiliary control signal may also control the actuator to change the direction of the actuation force between the first direction and the second direction. As a result, a proper functionality of the active vent may be restored by the repair functionality such that the first control signal and the second control signal may be employed in their usual function to adjust the effective size of the venting channel.

The auxiliary control signal provided in operation 306 may also be employed to provide a cleaning functionality of the active vent. Accumulated ingress may produce clogging of the venting channel. The temporal sequence of the actuation force can be employed to remove the ingress from the venting channel by producing an acceleration of the ingress away from the venting channel caused by the movement of the valve member. In this respect, an increased magnitude of the actuation force and/or a changing direction of the actuation force and/or a successive increase of the magnitude of the actuation force may be employed. For instance, an air current may be produced in the venting channel by a repeated forth and back movement of the valve member which can provide a removal of the ingress from the venting channel. A maintenance functionality may be provided by combining the above described repair functionality and cleaning functionality in one auxiliary operation of the active vent.

The above described checking functionality and/or testing functionality and/or repair functionality and/or cleaning functionality of the active vent may also be provided independently from the boot sequence initiated in operation 321. For instance, an input signal from a user interface may be provided in the place of operation 321 and/or the respective functionality may be executed depending on another event in the place of operation 321.

Figure 10:
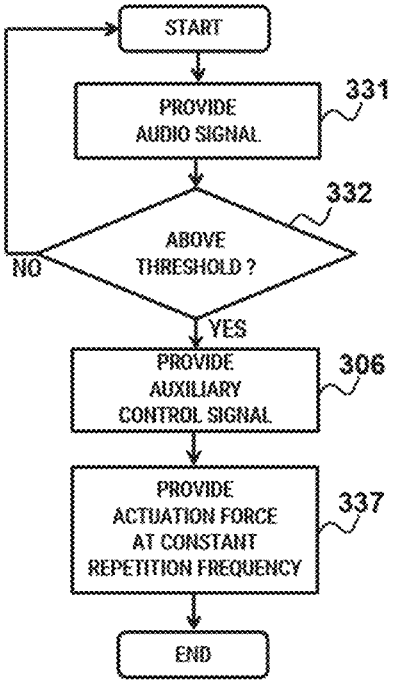

FIG. 10 illustrates a method of operating a hearing device comprising an active vent according to some embodiments of the present disclosure. In operation 331, an audio signal is provided. For instance, the audio signal can be provided by a microphone based on a sound detected by the microphone. Operation 332 determines if a property of the audio signal exceeds a threshold. For instance, the audio signal can be processed by a processing unit which evaluates the audio signal relative to the threshold. The property of the audio signal may comprise a signal level such as a sound level amplitude and/or a signal to noise ratio and/or a specific frequency content, for instance a signal level of a selected frequency range.

Depending on whether the property of the audio signal exceeds the threshold, operation 306 of providing the auxiliary control signal is performed. In operation 306, the auxiliary control signal is provided such that the actuator is controlled in operation 337 to provide the actuation force at a constant repetition frequency in the temporal sequence.

The actuator may be controlled in operation 306 to repeatedly provide the actuation force in operation 337 such that the direction of the actuation force alternates at subsequent times in the temporal sequence between the first direction and the second direction. The direction of the actuation force may alternate at the repetition frequency of the actuation force in the temporal sequence. The actuation force may thus be repeatedly provided in the same direction at a frequency corresponding to half of the repetition frequency at which the direction of the actuation force alternates.

In particular, a repetition frequency of the actuation force in the first direction, in which the actuation force is repeatedly provided in the first direction, and a repetition frequency of the actuation force in the second direction, in which the actuation force is repeatedly provided in the second direction, can correspond to half the value of the repetition frequency of the actuation force alternating between the first and second direction. In this way, a repeated movement of the valve member forth and back between the first valve position and the second valve position can be actuated by the actuation force alternating between the first and second direction.

The repeated forth and back movement of the valve member may have a frequency corresponding to half the repetition frequency of the actuation force alternating between the first and second direction. The frequency of the forth and back movement of the valve member may also correspond to the repetition frequency of the actuation force in one of the first and second direction.

The repeated forth and back movement of the acoustic valve can be exploited to provide a vibration functionality of the active vent. In the vibration functionality, vibrations can be induced from the active vent to a housing of the hearing device to which the valve member of the active vent is moveably coupled. The vibrations of the housing can be evoked by the periodic movement of a mass of the valve member at the repetition frequency relative to the housing. The vibrations of the housing may be transmitted from the housing to an ear in contact with the housing. Such a transmission of the vibrations may occur at any portion of the housing in contact with the ear. For instance, the vibrations can be transmitted at a portion of the housing in contact with the concha of the ear. The vibrations can also be transmitted at a portion of the housing inside the ear canal, for instance from a sealing member of the housing or by another portion of the housing configured to contact the ear canal. The vibrations may be exploited to produce a haptic feeling perceptible by a user wearing the hearing device. The vibration functionality may be implemented in various applications, as described below.

For instance, as illustrated in FIG. 10, the generated vibrations can be applied to inform a user about the presence of the audio signal with a signal property exceeding the threshold, as determined in operations 331, 332. To illustrate, a user having a severe hearing loss at least at one ear at which the hearing device is worn can be made aware by the generated vibrations about a sound detected by the microphone in the environment of the user. The user can thus be animated to listen with an increased effort with the impaired ear, for instance when a person talks to the user while approaching this ear. The user can also be alerted about the presence of such a sound at the impaired ear such that he can orient his head in a more appropriate way, for instance by directing his other ear to the sound which may be less severely damaged. In this way, a sound indication functionality may be provided by the active vent.

The generated vibrations may also be applied as a notification functionality of the active vent. A notification signal can be provided in the place of operations 331, 332 in the method illustrated in FIG. 10. For instance, the notification signal may be a phone call signal received by the hearing device, a signal scheduled by a user program, a periodically provided signal, or a signal produced following any other event. The user can then be notified about the event by a haptic feeling caused by the generated vibrations.

The generated vibrations may also be applied to perform vibration measurements at the ear. Vibration measurements can be employed, for instance, to check a contact portion of the housing with the ear, in particular a sealing member of the housing, with respect to a wearing comfort, a desired tightness or looseness of the contact, a desired acoustical effect of a sealing provided by the contact portion, and/or the like. For instance, the user may individually evaluate the wearing comfort of the hearing device during the generated vibrations and the resulting haptic feeling, which can allow him to estimate possible imperfections of the fitting of the housing in the ear canal during a long-term usage. In this way, an in-situ measurement functionality of the wearing comfort of the hearing device may be provided by the active vent. The in-situ measurement functionality can be executable, for instance, depending on an input signal from a user interface. The input signal may be provided in the place of operations 331, 332 in the method illustrated in FIG. 10.

The vibration measurement functionality of the active vent may also be implemented to perform mechanical and/or acoustical measurements on the ear when the housing is at least partially inserted into the ear canal. An individual such as an HCP may perform those mechanical and/or acoustical measurements during the vibrations generated by the active vent. The vibration measurements may further comprise a pressure sensor, by which a mechanical pressure of the housing exerted on the ear canal can be estimated, and/or an acoustical sensor comprising an acoustic transducer and a microphone. Sound emitted by the acoustic transducer and detected by the microphone and/or a pressure detected by the pressure sensor can be employed to estimate a quality of an acoustical sealing of the housing inside the ear canal. For instance, when the results of the vibration measurements are rather constant during generation of the vibrations, a rather tight fitting of the housing at the contact portion and/or a rather high quality of the acoustical sealing may be deduced. In this way, a fitting functionality can be provided by the active vent. The fitting functionality can be executable, for instance, depending on an input signal from a user interface. The input signal may be provided in the place of operations 331, 332 in the method illustrated in FIG. 10.

The generated vibrations may also be employed for a cleaning functionality of the active vent. In such a cleaning functionality, as described above, the temporal sequence of the actuation force can be applied to remove ingress which may cause clogging of the venting channel. In principle, the cleaning functionality may be assisted by any repeated movement of the valve member, even at a rather small repetition frequency. Larger repetition frequencies, however, can further enhance the cleaning efficiency. In particular, when the repetition frequency is provided large enough such that vibrations of the hearing device housing can be generated in the above described way, the vibrations may cause an enhanced release of the residuals from a surface portion of the housing.

The repeated movement of the valve member in operation 337 may also be applied in a checking functionality of the active vent to verify a proper functioning of the active vent, for instance by a visual inspection of the valve member by a user, as described above. The repeated movement of the valve member between the first valve position and the second valve position can help the user to confirm a proper functioning of the active vent. In a case in which the repeated forth and back movement of the valve member could not be observed by the user, a malfunction of the active vent may be deduced. After the proper functioning of the active vent has been verified, the user may terminate the checking functionality by a user input from a user interface. During the checking functionality, the repetition frequency of the movement of the valve member between the valve positions may be selected to allow the visual verification of the valve member at the respective valve positions. The repetition frequency may also be selected at a value for which the vibration functionality of the active vent may be provided, wherein the vibrations may be used as an indication of a proper functioning of the active vent.

The actuator may also be controlled in operation 306 to repeatedly provide the actuation force in operation 337, wherein the direction of the actuation force is kept in the same direction at subsequent times of the temporal sequence. For instance, the repair functionality of the active vent, as described above, may be implemented such that the actuation force is provided in the same direction at the repetition frequency. The magnitude of the actuation force may be altered in the temporal sequence. In addition, at selected times of the temporal sequence, the direction of the actuation force may also be altered. For instance, the actuation force may be kept in the first direction for a number of times in the temporal sequence, and then may be altered to the second direction for another number of times in the temporal sequence. The repetition frequency in which the direction of the actuation force is altered at a constant rate may thus be smaller than a repetition frequency in which the direction of the actuation force is kept in the first direction and/or in the second direction.

The cleaning functionality and/or checking functionality and/or maintenance and/or repair functionality can be executable, for instance, depending on an input signal from a user interface which may be provided in the place of operations 331, 332 in the method illustrated in FIG. 10. The cleaning functionality and/or checking functionality may also be executable automatically by the hearing device, for instance depending on an event. The event can comprise, for instance, an operational state of the hearing device such as turning the hearing device on and/or rebooting the hearing device. For instance, operation 321 of initiating a boot sequence may be provided in the place of operations 331, 332 in the method illustrated in FIG. 10.

Figure 11:
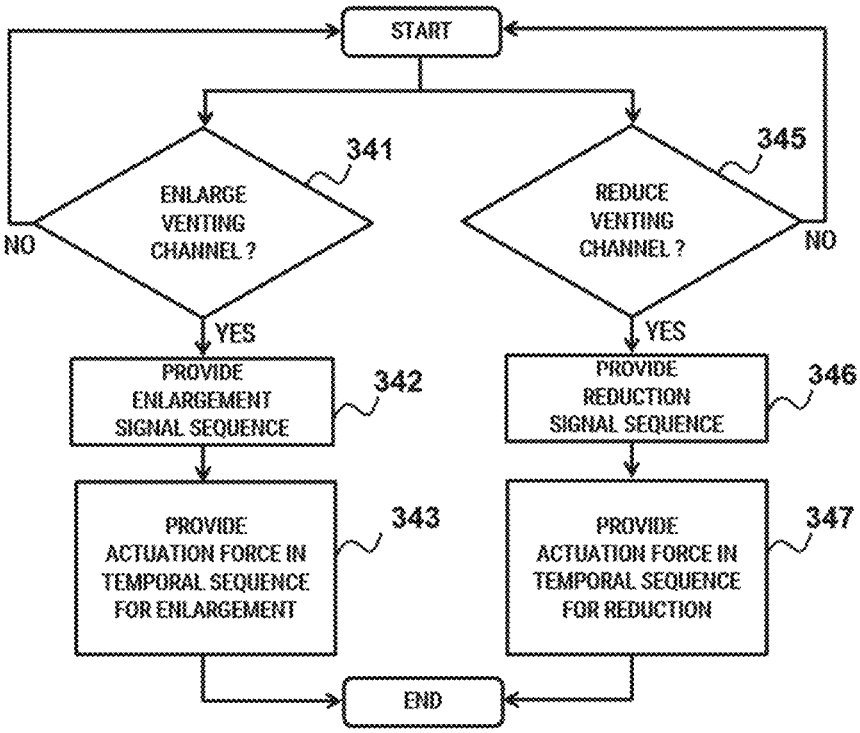

FIG. 11 illustrates a method of operating a hearing device comprising an active vent according to some embodiments of the present disclosure. In operation 341, information is gathered whether an effective size of a venting channel of the active vent shall be enlarged. In operation 345, information is gathered whether an effective size of a venting channel of the active vent shall be reduced. Operations 341, 345 can be performed independently from one another, in particular simultaneously or in a mutually exclusive manner.

When the information gathered in operation 341 indicates that an enlargement of the effective size of the venting channel shall be executed, a first temporal sequence of signal pulses is provided in operation 342. The first temporal sequence of signal pulses controls the actuator in operation 342 to provide the actuation force at subsequent times in a temporal sequence, each time to provide the actuation force either in the first direction or in the second direction, causing a movement of the valve member to enlarge the effective size of the venting channel. In a case in which the effective size of the venting channel is already in a fully enlarged state, the first temporal sequence of signal pulses may cause the valve member to remain in the current valve position.

When the information gathered in operation 345 indicates that a reduction of the effective size of the venting channel shall be executed, a second temporal sequence of signal pulses is provided in operation 346. The second temporal sequence of signal pulses controls the actuator in operation 347 to provide the actuation force at subsequent times in a temporal sequence causing a movement of the valve member to reduce the effective size of the venting channel. In a case in which the effective size of the venting channel is already in a fully reduced state, the first temporal sequence of signal pulses may cause the valve member to remain in the current valve position. In a case in which operations 341, 345 are performed simultaneously, either operation 342 or operation 346 may be performed depending on whether the information has been gathered first in operation 341 or in operation 345.

The first temporal sequence of signal pulses provided in operation 342 may be employed as the first control signal or second control signal controlling the actuator to provide the actuation force in the first or second direction in order to enlarge the effective size of venting channel. The second temporal sequence of signal pulses provided in operation 346 may be employed as the other of the first or second control signal controlling the actuator to provide the actuation force in the other direction to reduce the effective size of venting channel. For instance, operations 341, 345 may be performed in the place of operation 301 in the method illustrated in FIG. 7. Operations 342, 346 may be performed in the place of operation 302 in the method illustrated in FIG. 7. Operations 343, 347 may be performed in the place of operation 303 in the method illustrated in FIG. 7. Thus, the first and second control signal employed for an adjustment of the venting channel each may implemented by a respective temporal sequence of signal pulses.

The first temporal sequence of signal pulses provided in operation 342 may also be employed as the first auxiliary control signal or the second auxiliary control signal controlling the actuator to provide the actuation force in the first or second direction in order to enlarge the effective size of venting channel. The second temporal sequence of signal pulses provided in operation 346 may be employed as the other of the first or second auxiliary control signal controlling the actuator to provide the actuation force in the other direction to reduce the effective size of venting channel. For instance, operations 341, 345 may be performed in the place of operations 311, 315 in the method illustrated in FIG. 8. Operations 342, 346 may be performed in the place of operations 312, 316 in the method illustrated in FIG. 8. Operations 343, 347 may be performed in the place of operations 313, 317 in the method illustrated in FIG. 8. Thus, the first and second auxiliary control signals implemented by a respective temporal sequence of signal pulses may be employed for an adjustment of the venting channel.

Providing the first control signal and the second control signal and/or the first auxiliary control signal and the second auxiliary control signal comprising the respective temporal sequence of signal pulses in operations 312, 316 can be applied to provide a reliability enhancement functionality and/or an operating noise optimization functionality of the active vent. Accordingly, the magnitude of the actuation force may be controlled in the subsequent signal pulses of the temporal sequence to enable the respective functionality. Generally, the magnitude of the actuation force acting on the valve member can determine an acceleration of the valve member caused by the actuation force. The acceleration of the valve member increases the velocity and thus the kinetic energy of the valve member. On the one hand, a smaller value of the magnitude of the actuation force may be beneficial to reduce operating noises of the active vent. To illustrate, the smaller the kinetic energy of the valve member, the less pronounced may be clicking noises which may be caused by a collision of the valve member with a stopping member at the first or second valve position after the movement of the valve member between the valve positions. On the other hand, a larger value of the magnitude of the actuation force may be beneficial to increase the reliability of the active vent. To illustrate, the larger the kinetic energy of the valve member, the more easily obstacles may be overcome during the movement of the valve member between the valve positions, such as, for instance, ingress accumulated in the venting channel.

The subsequent signal pulses in the first temporal sequence provided in operation 342 and/or the subsequent signal pulses in the second temporal sequence provided in operation 346 may control the actuator to successively increase the magnitude of the actuation force in the respective temporal sequence of the actuation force. At a first time of the respective temporal sequence, the actuator may be controlled to provide the magnitude of the actuation force at a rather small value. In this way, the operating noises of the active vent may be minimized when the magnitude of the actuation force is sufficient to provide the movement of the valve member between the different valve positions. At a second time of the respective temporal sequence, the actuator may be controlled to provide the magnitude of the actuation force at an increased value. In a case in which the valve member has already been moved between the different valve positions, the magnitude of the actuation force provided at the second time may have no further impact on the movement of the valve member, since the valve member already is disposed at the target valve position. In a case in which the valve member has not yet been moved between the different valve positions, for instance because the magnitude of the actuation force provided at the earlier time has been too small to overcome obstacles between the valve positions, the magnitude of the actuation force provided at the current time may be sufficient to provide the movement of the valve member between the different valve positions. The operating noises of the active vent may then still be rather low, depending on the magnitude of the actuation force provided at the current time.

The described procedure may be continued correspondingly at subsequent times of the respective temporal sequence of the actuation force, wherein the actuator each time may be controlled to provide the magnitude of the actuation force at another increased value. In this way, the operating noise may be optimized to the lowest possible value and at the same time a high reliability of the active vent functionality can be provided.

The subsequent signal pulses provided in operation 342 may control the actuator to provide the actuation force in one of the first direction or in the second direction during each time in the temporal sequence to provide the actuation force to enlarge the effective size of venting channel. The subsequent signal pulses provided in operation 346 may control the actuator to provide the actuation force in the other of the first direction or in the second direction during each time in the temporal sequence to provide the actuation force to reduce the effective size of venting channel. The subsequent signal pulses provided in operation 342, 346 may also control the actuator to change the direction of the actuation force at least at one time in the temporal sequence, which may further increase the reliability of the movement of the valve member in the desired direction. For instance, changing the direction of the actuation force may assist to overcome obstruction in the pathway of the valve member, as described above.

As noted above, the first temporal sequence of the actuation force in operation 343 may be controlled by a first auxiliary control signal provided in operation 342, and the second temporal sequence of the actuation force in operation 347 may be controlled by a second auxiliary control signal provided in operation 346. The controller may then be configured to provide the first and second auxiliary control signal in addition to a first control signal and a second control signal to control the enlargement and reduction of the effective size of the venting channel. In these implementations, the first auxiliary control signal and the second auxiliary control signal may be employed as an additional functionality of the active vent to provide the modification of the effective size of the venting channel with a high reliability, for instance when the modification of the effective size of the venting channel controlled by the first control signal and the second control signal is insufficiently reliable. The first temporal sequence of the actuation force in operation 343 may also be controlled by the first control signal in operation 342, and the second temporal sequence of the actuation force in operation 347 may be controlled by the second control signal in operation 346. In these implementations, the first control signal and the second control signal can be equipped to provide the modification of the effective size of the venting channel with the high reliability.

Figure 12A:
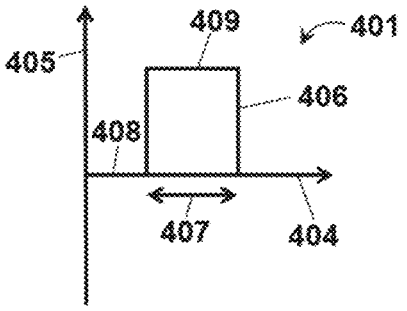
FIGS. 12A-P schematically illustrate exemplary control signals that can be provided to an actuator of an active vent.
Figure 12B:
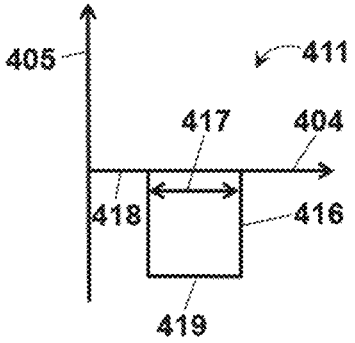

FIGS. 12A and 12B illustrate functional plots of a respective control signal 401, 411 in accordance with some embodiments of the present disclosure. Control signals 401, 411 are plotted as a function of a signal level over time. The time is indicated on an axis of abscissas 404. The signal level is indicated on an axis of ordinates 405. The signal level may indicate a current, or a voltage, or a binary value including 0 and 1 and/or −1, or any value representative of a control parameter suitable to control an actuator to provide an actuation force acting on a valve member of an acoustic valve.

A point of intersection of the signal level axis 405 with the time axis 404 designates a signal level of zero. An absolute value of the signal level can be representative for a magnitude of the actuation force provided by the actuator when controlled by control signals 401, 411. A sign of the signal level, in particular a plus sign or a minus sign, can be representative for a direction of the actuation force provided by the actuator when controlled by control signals 401, 411. The direction can include a first direction, corresponding to one of the signs, for actuating the movement of the valve member from the first valve position to the second valve position. The direction can further include a second direction, corresponding to the other sign, for actuating the movement of the valve member from the second valve position to the first valve position. For instance, one of the directions can correspond to the direction of actuation force 161 and the other direction can correspond to the direction of actuation force 162 for actuating the movement of the valve member between the valve positions depicted in FIGS. 3A, 4A, 5A, 6A and the valve positions depicted in FIGS. 3B, 4B, 5B, 6B.

Control signals 401, 411 each comprise a signal section 406, 416 of a respective duration 407, 417 over the time. Each of signal sections 406, 416 constitutes a signal pulse with a pulse duration corresponding to duration 407, 417 of the signal sections. Duration 407, 417 is predetermined by the controller. During the respective pulse duration 407, 417, control signals 401, 411 have a signal level 409, 419. Before and after the respective duration 407, 417, control signals 401, 411 have a signal level 408, 418. An absolute value of signal level 408, 418 before and after duration 407, 417 is lower than an absolute value of signal level 409, 419 during duration 407, 417. The absolute value of the larger signal level 409, 419 and pulse duration 407, 417 are provided such that the magnitude of the actuation force is kept above a minimum level during duration 407, 417. The absolute value of the smaller signal level 408, 418 is provided such that the magnitude of the actuation force is kept below the minimum level provided during duration 407, 417.

The magnitude of the actuation force can depend on the absolute value of signal level 409, 419 and/or duration 407, 417. To illustrate, the actuator may comprise a coil. When control signals 401, 411 are provided as a current, the current provided at the respective signal levels 409, 419 can produce a magnetic flux in the coil. The magnetic field energy representative for the magnitude of the actuation force applied over time can depend on both the magnitude of the current flowing through the coil, which can be controlled by signal level 409, 419, and the time during which the current flows through the coil, which can be controlled by duration 407, 417. When control signals 401, 411 are provided as a voltage, the same effect can be achieved.

The minimum level of the magnitude of the actuation force provided during duration 407, 417 can be selected to correspond to a value required to effectuate a movement of the valve member between the first and second valve position, at least in a situation in which no obstructions are present in the pathway of the valve member. The minimum level of the magnitude of the actuation force required for effectuating the movement can depend on duration 407, 417. For instance, a smaller value of the magnitude may be sufficient to effectuate the movement when duration 407, 417 is longer. A larger value of the magnitude may be required to effectuate the movement when duration 407, 417 is shorter. Depending on an amount of obstructions in the pathway, however, the minimum level and/or duration 407, 417 may not be sufficient to effectuate the movement.

In the examples illustrated in FIGS. 12A, 12B, the smaller signal level 408, 418 is zero. The larger signal level 409, 419 is provided as a constant value during duration 407, 417 of signal pulse 406, 416. Thus, signal pulses 406, 416 have a shape of a rectangular signal pulse. Other shapes of signal pulses 406, 416 are conceivable, in particular triangular or sinusoidal pulses. Pulse durations 407, 417 can be equal or different. The absolute value of signal levels 409, 419 can be equal or different. Control signals 401, 411 are distinguished by an inverse sign of signal level 409, 419 of signal pulses 406, 416 during duration 407, 417. For instance, when the control signals are provided as a voltage, signal level 419 of control signal 411 can have a polarity that is reversed with respect to a polarity of signal level 409 of control signal 401. When the signals are provided as a current, signal level 419 of control signal 411 can indicate a flow direction that is reversed with respect to a flow direction of signal level 409 of control signal 401.

Control signals 401, 411 may be provided by a controller as a first control signal 401 and a second control signal 411 to the actuator of the active vent to actuate the movement of the valve member in order to enlarge or reduce the effective size of the venting channel. For instance, control signals 401, 411 may be employed in operation 302 of the method illustrated in FIG. 7. The first control signal may control actuation of the movement of the valve member forth from the first valve position to the second valve position. The second control signal may control actuation of the movement of the valve member back from the second valve position to the first valve position. For instance, control signals 401, 411 may be employed to actuate the movement of the valve member from the valve position depicted in FIGS. 3A, 4A, 5A, 6A to the valve position depicted in FIGS. 3B, 4B, 5B, 6B. Control signals 401, 411 can also be employed to actuate the movement of the valve member from the valve position depicted in FIGS. 3B, 4B, 5B, 6B to the valve position depicted in FIGS. 3A, 4A, 5A, 6A.

To illustrate, the actuator may comprise a coil. When control signals 401, 411 are provided as a current, the current provided at the respective signal levels 409, 419 can produce a magnetic flux in the coil. The current flow at the respective signal levels 409, 419 is provided in opposite directions. Thus, the magnetic flux points produced in the coil points in an opposed direction when control signal 401 is provided to the actuator as compared to the magnetic flux produced in the coil when control signal 411 is provided to the actuator. When control signals 401, 411 are provided as a voltage, the same effect can be achieved by the reversed polarity of the respective signal levels 409, 419. The magnetic flux of the actuator in the opposed directions can produce a magnetic force in opposed directions acting on the valve member. A magnitude of the magnetic force can depend on the absolute value of signal levels 409, 419. When the magnetic force is provided in one direction by one of control signals 401, 411 and the magnitude of the magnetic force is provided large enough, the valve member can be moved from the first valve position to the second valve position. When the magnetic force is provided in the opposed direction by the other of control signals 401, 411 and the magnitude of the magnetic force is provided large enough, the valve member can be moved from the second valve position to the first valve position.

As another example, control signal 401 may be employed as a first control signal to control the actuator to provide the actuation force in the first direction, and as a second control signal to control the actuator to provide the actuation force in the second direction. For instance, the actuator may comprise a switch. In a first switching state of the switch, the actuator can be configured to provide the actuation force in the first direction in order to move the valve member from the first valve position to the second valve position. In a second switching state of the switch, the actuator can be configured to provide the actuation force in the second direction in order to move the valve member from the second valve position to the first valve position. For instance, the actuator may comprise a micromotor moving the valve member from the first valve position to the second valve position in the first switching state, and from the second valve position to the first valve position in the second switching state. As another example, the actuator may be configured to produce a magnetic flux in one direction in the first switching state, and a magnetic flux in the opposed direction in the second switching state.

When the switch is in the first switching state, control signal 401 provided to the actuator can control a change of the switch to the second switching state. When the switch is in the second switching state, control signal 401 provided to the actuator can control a change of the switch to the first switching state. For instance, signal level 409 can be provided as a binary value indicating a control command to change the switching states of the switch. Instead of control signal 401, control signal 411 may be employed as the first control signal and as the second control signal in order to change the switching states of the switch of the actuator.

Figure 12C:
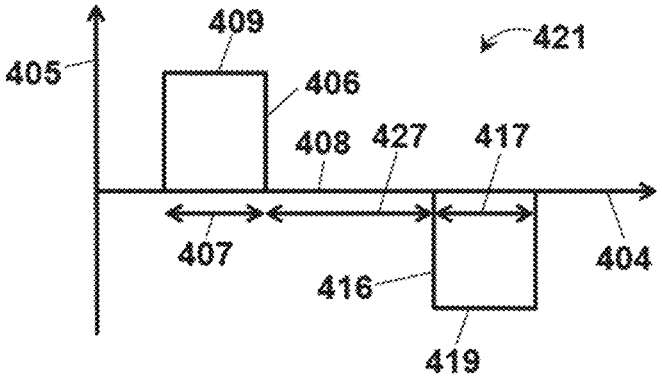

FIG. 12C illustrates a functional plot of a control signal 421 in accordance with some embodiments of the present disclosure. Control signal 421 can control the actuator to provide the actuation force in a temporal sequence, wherein the direction of the actuation force is changed at the subsequent times. For instance, control signal 421 may be employed as an auxiliary control signal in operation 306 of the method illustrated in FIG. 7 and/or in operation 312 or 316 of the method illustrated in FIG. 8 and/or in operation 306 of the method illustrated in FIG. 9.

Control signal 421 comprises signal pulse 406 at first, and signal pulse 416 at second in a temporal sequence. During first signal pulse 406, control signal 421 can control the actuator to provide the actuation force in the first direction. The direction of the actuation force is kept equal in the first direction during duration 407. Moreover, the magnitude of the actuation force is kept above the minimum level during duration 407. Depending on the magnitude of the actuation force over time, which may be controlled by the absolute value of signal level 409 and/or duration 407, first signal pulse 406 may effectuate a movement of the valve member from the first valve position to the second valve position. During second signal pulse 416, control signal 421 can control the actuator to provide the actuation force in the second direction. The direction of the actuation force is kept equal in the second direction and the magnitude of the actuation force is kept above the minimum level during duration 417. Depending on the magnitude of the actuation force over time, which may be controlled by the absolute value of signal level 419 and/or duration 417, second signal pulse 416 can effectuate a movement of the valve member from the second valve position to the first valve position.

Signal pulses 406, 416 are temporally separated by an intermediate time interval 427. During intermediate time interval 427, control signal 421 takes on signal level 408 controlling the actuation force at a lower magnitude as compared to the magnitude of the actuation force provided during duration 407, 417 of signal pulses 406, 416. The magnitude of the actuation force is decreased below the minimum level and the direction of the actuation force is changed from the first direction to the second direction during intermediate time interval. Intermediate time interval 427 is predetermined by the controller. Signal level 408 can be below the signal threshold required for controlling the actuator to provide the magnitude of the actuation force effectuating a movement of the valve member. In the illustrated example, signal level 408 is zero.

In this way, depending on the magnitude of the actuation force controlled during signal pulses 406, 416, control signal 421 can control the actuator to actuate the movement of the valve member during second signal pulse 416 from the second valve position to the first valve position after intermediate time interval 427 in which the valve member is positioned in the second valve position. A predetermined time, in which the valve member is positioned in the second valve position, can be defined by a duration including intermediate time interval 427. The predetermined time can further comprise a part of duration 407, 417 of at least one of signal pulses 406, 416 during which the valve member may already be positioned in the second valve position.

The predetermined time may be provided such that the valve member is positioned in the second valve position for a duration in which a presence of the valve member in the second valve position is visually identifiable. Thus, a checking functionality for a proper functioning of the active vent in the different valve positions, in particular in the first valve position and in the second valve position, can be provided. In some implementations, the predetermined time may be selected to be at least 0.1 seconds, more preferred at least 0.5 seconds, in order to allow an easy and/or unmistakable identification of the valve member in the second valve position upon inspection of the valve member by human eyes. In some implementations, visual identification of the valve member during the movement of the valve member between the valve positions may be employed as a criterion for a proper functioning of the active vent. Thus, a static positioning of the valve member in the second valve position may not be required such that the predetermined time may be even smaller. Moreover, the predetermined time may be selected to be at most 10 seconds, more preferred at most 5 seconds, in order to avoid an overly long duration of the checking procedure and/or a rather tedious waiting period before the active vent is ready for use in its ordinary function.

Figure 12D:
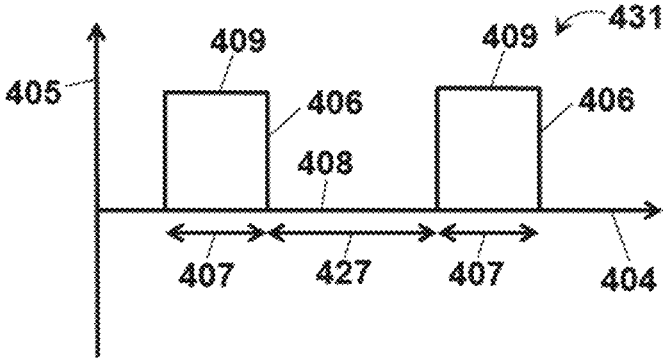

FIG. 12D illustrates a functional plot of a control signal 431 in accordance with some embodiments of the present disclosure. Control signal 431 comprises signal pulse 406 provided twice in a temporal sequence. Control signal 431 is thus composed of equal signal pulses 406. The subsequent signal pulses 406 are separated by intermediate time interval 427 in which control signal 431 takes on signal level 408. Subsequent signal pulses 406 may be employed to control the actuator to provide the actuation force in a temporal sequence, wherein the direction of the actuation force is changed at the subsequent times. During the first signal pulse 406, control signal 431 can control the actuator to provide the actuation force in the first direction. The direction of the actuation force is kept equal in the first direction and the magnitude of the actuation force is kept above the minimum level in order to actuate movement of the valve member from the first valve position to the second valve position, at least in a situation in which no obstructions are present in the pathway of the valve member. During intermediate time interval 427, the magnitude of the actuation force is decreased below the minimum level such that the valve member can remain positioned in the second valve position. Moreover, the direction of the actuation force is changed from the first direction to the second direction at the end of the intermediate time interval. During the second signal pulse 406, control signal 431 can control the actuator to provide the actuation force in the second direction. The direction of the actuation force is kept equal in the second direction and the magnitude of the actuation force is kept above the minimum level in order to actuate movement of the valve member from the second valve position to the first valve position, at least in a situation in which no obstructions are present in the pathway of the valve member. For instance, the actuator may comprise a switch and subsequent signal pulses 406 control a change of the switching state in order to change the direction of the actuation force. Thus, control signal 431 may be employed in the place of control signal 421 to provide the same technical effect. For instance, control signal 431 may be employed as an auxiliary control signal in operation 306 of the method illustrated in FIG. 7 and/or in operation 312 or 316 of the method illustrated in FIG. 8 and/or in operation 306 of the method illustrated in FIG. 9.

Subsequent signal pulses 406 may also be employed to control the actuator to provide the actuation force in a temporal sequence, wherein the direction of the actuation force is equal at the subsequent times. During the first signal pulse 406, control signal 431 can control the actuator to provide the actuation force in the first direction. The direction of the actuation force is kept equal in the first direction and the magnitude of the actuation force is kept above the minimum level. During intermediate time interval 427, the actuation force is controlled to a lower magnitude as compared to the magnitude of the actuation force provided during duration 407 of signal pulses 406. The magnitude of the actuation force is decreased below the minimum level. The direction of the actuation force remains unchanged during intermediate time interval 427. During the second signal pulse 406, control signal 431 can control the actuator again to provide the actuation force again in the first direction. The direction of the actuation force is kept equal in the first direction and the magnitude of the actuation force is kept above the minimum level. For instance, the actuator may comprise a coil and subsequent signal pulses 406 may be provided as a voltage of equal polarity controlling a magnetic flux in the coil in the same direction.

Repeated provision of the actuation force in the same direction in subsequent signal pulses 406 can be employed in a reliability enhancement functionality of the active vent. In particular, the magnitude of the actuation force controlled in first signal pulse 406 above the minimum level over duration 407 may be not sufficient to initiate a desired movement of the valve member, for instance due to obstacles in the pathway of the valve member. However, repeated actuation in the same direction, as provided by subsequent signal pulses 406, may permit the movement. For instance, obstacles may be partially overcome during the actuation controlled by the first signal pulse 406 and may be fully overcome during the actuation controlled by the second signal pulse 406. The repeated actuation may cause a shaking movement of the valve member which may allow the valve member to liberate the pathway from the obstacles. Moreover, the repeated actuation may create resonances of the valve member with the environment allowing to resolve the blocking of the valve member. Duration and/or intermediate time interval 427 may then be provided in a time range of at most 100 milliseconds, more preferred at most 10 milliseconds. At the same time, operating noises of the active vent caused by the movement of the valve member may be kept at a minimum. The repeated actuation in the same direction may be repeated for a number of additional times to increase the reliability in the above described way.

In order to provide the reliability enhancement functionality, control signal 431 may be employed, for instance, as the first control signal in operation 302 of the method illustrated in FIG. 7 and/or in operation 343 or 347 of the method illustrated in FIG. 11. In addition, a corresponding second control signal may be provided, in which signal pulses are provided in a temporal sequence to control a repeated actuation in the second direction, in order to improve the reliability of the active vent for a movement of the valve member in the second direction. The reliability enhancement functionality may also be provided as an additional functionality of the active vent employing an auxiliary control signal. For instance, control signal 431 controlling the repeated actuation in the first direction may be employed as the auxiliary control signal in operation 306 of the method illustrated in FIG. 7 and/or in operation 312 or 316 of the method illustrated in FIG. 8 and/or in operation 306 of the method illustrated in FIG. 9 and/or in operation 306 of the method illustrated in FIG. 10 and/or in operation 343 or 347 of the method illustrated in FIG. 11. The auxiliary control signal may be a first auxiliary control signal, and a second auxiliary control signal may be provided controlling the repeated actuation in the second direction.

Figure 12E:
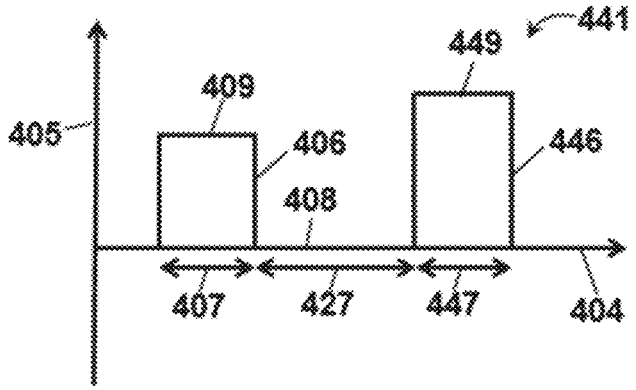

FIG. 12E illustrates a functional plot of a control signal 441 in accordance with some embodiments of the present disclosure. Control signal 441 comprises two signal pulses in a temporal sequence. At a first time, signal pulse 406 is provided. At a second time, a signal pulse 446 with a duration 447 is provided. Durations 407 and 447 may be different or equal. Durations 407, 447 are predetermined by the controller. Second signal pulse 446 has a signal level 449 with a larger absolute value as compared to signal level 409 of first signal pulse 409. Thus, second signal pulse 446 can control the actuator to provide the actuation force with a larger magnitude than first signal pulse 409. During the first signal pulse 406, control signal 441 can control the actuator to provide the actuation force in the first direction with a first magnitude. During second signal pulse 446, control signal 441 can control the actuator again to provide the actuation force in the first direction with a second magnitude larger than the first magnitude. Subsequent signal pulses 406, 446 can thus control the actuator to successively increase the magnitude of the actuation force in the temporal sequence in which subsequent signal pulses 406, 446 are provided.

The repeated provision of the actuation force in the same direction in subsequent signal pulses 406, 446 can be employed in a reliability enhancement functionality of the active vent, as described above. To this end, control signal 441 may be employed in the place of control signal 431. Successively increasing the magnitude of the actuation force, as controlled by control signal 441, can further improve the reliability of the active vent in order to enlarge or reduce the effective size of the venting channel when the valve member shall be moved in the first direction. Another control signal, by which the actuation force is controlled to be repeatedly provided in the second direction with a successively increasing magnitude, may be provided corresponding to control signal 441 with a reversed sign of subsequent signal pulses 406, 446 in order to improve the reliability of the active vent for a movement of the valve member in the second direction.

Duration 447 of second signal pulse 446 may be provided longer than duration 407 of first signal pulse 406. Thus, the actuation force can be controlled to be provided for a longer time in second signal pulse 446 as compared to first signal pulse 406. Thus, the effective actuation energy transmitted to the valve member may be further increased in order to improve the reliability of the actuation. Additionally or alternatively, at least an additional subsequent signal pulse may be provided in the temporal sequence after subsequent signal pulses 406, 446. In the additional subsequent signal pulse, a signal level and/or a duration may be further increased as compared to signal pulses 406, 446 provided before in the temporal sequence. Thus, the actuator can be controlled to further increase the actuation energy during the additional subsequent signal pulse. In this way, the reliability for the actuation of the valve member movement in the desired direction may be further improved.

Figure 12F:
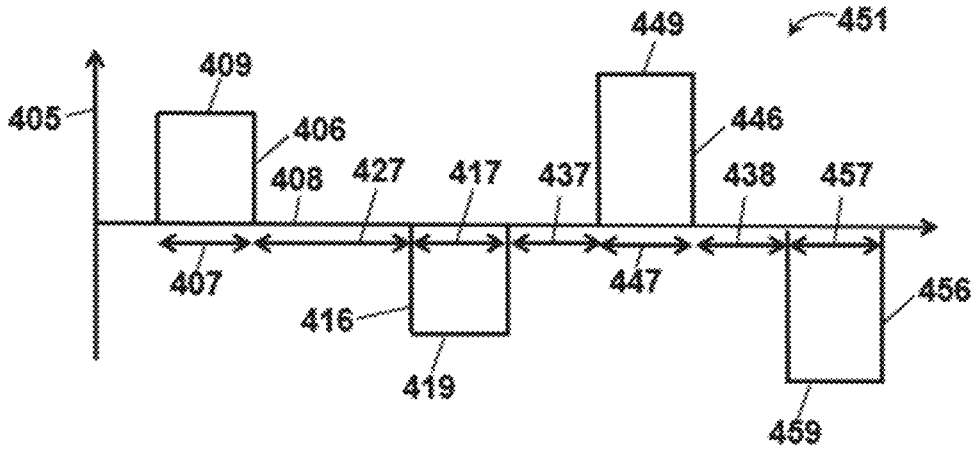

FIG. 12F illustrates a functional plot of a control signal 451 in accordance with some embodiments of the present disclosure. Control signal 451 can control the actuator to provide the actuation force in a temporal sequence, wherein the direction of the actuation force is repeatedly changed and the magnitude of the actuation force is successively increased in the temporal sequence. Control signal 451 comprises signal pulse 406 at first, signal pulse 416 at second, signal pulse 446 at third, and a signal pulse 456 with a duration 457 at fourth in a temporal sequence. Signal level 459 of fourth signal pulse 456 can have an absolute value corresponding to absolute value of signal level 449 of third signal pulse 446. The absolute value of signal level 456, 459 can thus be larger than the absolute value of signal level 409 of first signal pulse 406 and/or signal level 419 of second signal pulse 416. Signal level 459 of fourth signal pulse 456 has an opposite sign as compared to signal level 449 of third signal pulse 446. Control signal 451 can thus control the actuator to change the direction of the actuation force from the first direction, as controlled in first signal pulse 406, to the second direction, as controlled in second signal pulse 416, back to the first direction, as controlled in third signal pulse 446, and then back to the second direction, as controlled in fourth signal pulse 456.

First signal pulse 406 and second signal pulse 416 are separated by intermediate time interval 427 as a first intermediate time interval. Second signal pulse 416 and third signal pulse 446 are separated by a second intermediate time interval 437. Second intermediate time interval 437 may be different or equal to first intermediate time interval 427. Third signal pulse 446 and fourth signal pulse 456 are separated by a third intermediate time interval 438. Third intermediate time interval 438 may be different or equal to first intermediate time interval 427 and/or second intermediate time interval 437. First intermediate time interval 427, second intermediate time interval 437, and third intermediate time interval 438 are predetermined by the controller.

For instance, signal pulses 406, 416, 446, 456 may be provided at a constant repetition frequency by providing a sum of first intermediate time interval 427 and duration 407 of first signal pulse 406 equal to a sum of second intermediate time interval 437 and duration 417 of second signal pulse 416, and equal to a sum of third intermediate time interval 438 and duration 447 of third signal pulse 446. In particular, signal pulses 406, 416, 446, 456 may be provided at the constant repetition frequency by providing equal intermediate time intervals 427, 437, 438 and equal durations 407, 417, 447, 457 of signal pulses 406, 416, 446, 456. Thus, a rhythmical provision of the actuation force can be controlled which may be employed to produce resonances of the valve member movement with the environment. Signal pulses 406, 416, 446, 456 may also be provided at a varying repetition frequency by providing a sum of first intermediate time interval 427 and duration 407 of first signal pulse 406 different from a sum of second intermediate time interval 437 and duration 417 of second signal pulse 416 and/or different from a sum of third intermediate time interval 438 and duration 447 of third signal pulse 446. Thus, the actuation force can be controlled to be provided in a rather irregular manner resulting in a rather unsteady actuation of the valve member. Depending on the implementation, a constant repetition frequency and/or a varying repetition frequency of the signal pulses may be employed. In particular, resonances of the valve member movement as produced by a constant repetition frequency may be combined with an interruption of the resonances as produced by a varying repetition frequency. This can enhance a liberation of the valve member from obstructions in the venting channel. For instance, the repair and/or cleaning functionality may be provided in such a way. In particular, in order to produce resonances of the valve member with the environment, durations 407, 417, 447, 457 and/or intermediate time intervals 427, 437, 438 may be provided in a time range of at most 100 milliseconds.

Providing the actuation force such that the direction of the actuation force is repeatedly changed and the magnitude of the actuation force is successively increased in the temporal sequence may also be applied in a checking and/or testing functionality of the active vent for different valve positions, as described above. In particular, durations 407, 417, 447, 457 and/or intermediate time intervals 427, 437, 438 may then be provided in a time range between 0.1 and 10 seconds. When the actuation force has been controlled to be provided at a decreased magnitude, corresponding to signal level 409 of first signal pulse 406, and the valve member cannot be observed in the second valve position, it can be deduced that signal level 409 is not large enough to control a sufficient magnitude of the actuation force to cause a modification of the venting channel. When the actuation force has been controlled to be provided at an increased magnitude, corresponding to signal level 449 of third signal pulse 446, and the valve member can again not be observed in the second valve position, it can be deduced that signal level 449 is also not large enough to control the actuation force with the sufficient magnitude. Thus, a malfunction of the active vent when controlled by any of signal pulses 409, 419, 449, 459 may be determined.

In a situation in which the valve member can be observed in the second valve position when controlled by signal level 409 of first signal pulse 406 and/or when controlled by signal level 449 of third signal pulse 446, it can be deduced that the actuation force controlled by the respective signal pulse 409, 446 has been sufficient. The first control signal and second control signal, which is used to enlarge or reduce the venting channel during a regular operation of the active vent, may then be provided with the respective signal level 409, 449. The signal level of the first control signal and second control signal for the regular active vent operation may be selectable by the user and/or automatically selected by the controller providing the control signal.

Figure 12G:
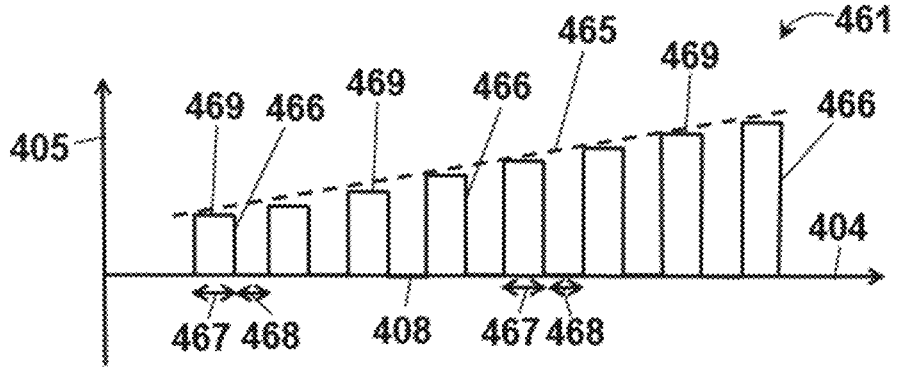

FIG. 12G illustrates a functional plot of a control signal 461 in accordance with some embodiments of the present disclosure. Control signal 461 can control the actuator to provide the actuation force in a temporal sequence, wherein the magnitude of the actuation force is successively increased and the direction of the actuation force is kept equal in the temporal sequence. Control signal 461 comprises a plurality of subsequent signal pulses 466. In the illustrated example, eight subsequent signal pulses 466 are provided. Subsequent signal pulses 466 have an equal duration 467. Duration 467 is predetermined by the controller. Signal pulses 466 are separated by an intermediate time interval 468 of an equal duration between two consecutive signal pulses 466 in the temporal sequence. Subsequent signal pulses 466 are thus provided at a constant repetition frequency in control signal 461.

During signal pulses 466, control signal 461 takes on a signal level 469 successively increasing in the temporal sequence of signal pulses 466. More particularly, an absolute value of signal level 469 successively increases in the temporal sequence of signal pulses 466. The direction of the actuation force is kept equal in the first direction and the magnitude of the actuation force is kept above the minimum level during duration 467. During intermediate time interval 468, control signal 461 takes on signal level 408 smaller than the successively increasing signal level 469 of signal pulses 466. The magnitude of the actuation force is decreased below the minimum level.

Signal level 469 successively increases along an envelope curve 465. Envelope curve 465 can be defined such that successively increasing signal level 469 integrated over duration 467 of each signal pulse 466 corresponds to a point of envelope curve 465. A slope of envelope curve 465 is thus different from zero, in particular larger than zero. For instance, as illustrated, envelope curve 465 may correspond to successively increasing signal level 469 at the beginning of duration 467 of each signal pulse 466, e.g. by setting duration 477 arbitrarily to one as the constant value. During duration 467 of signal pulses 466, signal level 469 can deviate from envelope curve 465. For instance, as illustrated, signal level 469 can be provided as a constant value during duration 467 of signal pulses 466.

In the illustrated example, envelope curve 465 is provided as a linear function. Signal level 469 thus successively increases by an equal amount between two consecutive signal pulses 466 in the temporal sequence. In other examples, envelope curve 465 can be provided as a nonlinear function, for instance having a parabolic and/or exponential dependency over time. A slope of envelope curve 465 can then determine an amount by which signal level 469 successively increases between two consecutive signal pulses 466 in the temporal sequence. Corresponding to the successive increase of signal level 469, a magnitude of the actuation force controlled by control signal 461 can be successively increased. The magnitude of the actuation force can thus increase corresponding to the shape of envelope curve 465. The actuation force can be controlled by control signal 461 to be provided in the first direction during duration 467 of each signal pulse 466, as determined by the positive sign of signal level 469 in the temporal sequence of signal pulses 466.

Figure 12H:
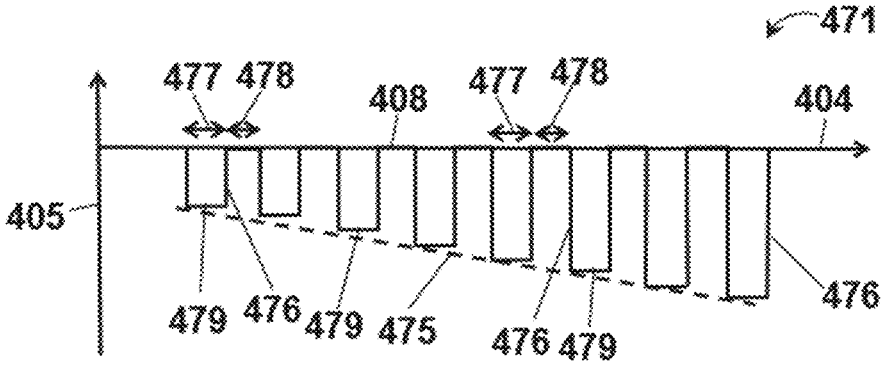

FIG. 12H illustrates a functional plot of a control signal 471 in accordance with some embodiments of the present disclosure. Control signal 471 comprises a plurality of signal pulses 476 of equal duration 476 in the temporal sequence.

Signal pulses 476 are separated by an intermediate time interval 478 of equal duration. A signal level 479 of signal pulses 476, more particularly an absolute value of signal level 479, successively increases. During intermediate time interval 478, control signal 471 takes on signal level 408 smaller than the successively increasing signal level 479 during signal pulses 476. The increase of signal level 469 is defined by an envelope curve 475. Different points on envelope curve 465 can be given by successively increasing signal level 479 integrated over duration 477 at each signal pulse 476. A slope of envelope curve 465 is thus different from zero. Increasing signal level 479 has an inverse sign as compared to increasing signal level 469 of signal pulses 466 of control signal 461. A slope of envelope curve 475 therefore also has an inverse sign as compared to the slope of envelope curve 465.

In the illustrated example, control signal 471 substantially corresponds to control signal 461, with the exception of the inverse sign of signal level 479. In particular, duration 477 of signal pulse 476 and intermediate time interval 478 may correspond to duration 467 of signal level 469 and intermediate time interval 468. Subsequent signal pulses 476 may be provided at the same constant repetition frequency in control signal 471 than subsequent signal pulses 466 in control signal 461. Envelope curve 475 may have the same shape than envelope curve 465, wherein the slope of envelope curve 475 has the inverse sign. A magnitude of the actuation force controlled by signal pulses 476 may thus correspond to the magnitude of the actuation force controlled by signal pulses 466.

The controller can thus be configured to provide signal pulses 466, 476 with differing signal level 469, 479, for instance a differing voltage or current level. In particular, subsequent signal pulses 466, 476 may be generated by an amplifier implemented in the hearing device and the controller can thus provide subsequent signal pulses 466, 476 from the amplifier to the actuator. The amplifier can be provided by an amplifier communicatively coupled to an acoustic transducer of the hearing device.

The repeated provision of the actuation force in the same direction in subsequent signal pulses 466 in control signal 461 and/or in subsequent signal pulses 476 in control signal 471 can be employed in a reliability enhancement functionality of the active vent, as described above. The successively increasing signal level 469, 479 can allow to provide the actuation force with a particular amount of magnitude that is required to permit the movement of the valve member. To illustrate, from the first to the fifth subsequent signal pulse 466 in control signal 461 and/or from the first to the fifth signal pulse 476 in control signal 471 the controlled magnitude of the actuation force may be too small to cause the movement of the valve member, for instance to overcome obstructions in the pathway of the valve member. The particular amount of the magnitude of the actuation force required to move the valve member may be reached, however, at the sixth subsequent signal pulse 466 in control signal 461 and/or at the sixth subsequent signal pulse 476 in control signal 471. After the movement of the valve member, which may be effectuated during the sixth subsequent signal pulse 466, the further seventh to eighth subsequent signal pulses 466, 476 in control signal 461 and/or in control signal 471 may have no further impact to move the valve member since the valve member has already been moved between the respective valve positions. The effect of subsequent signal pulses 466, 476 may be enhanced by providing durations 467, 477 and/or intermediate time interval 468 in a time range of at most 100 milliseconds to produce resonances of the valve member actuation.

The valve member may thus be moved between the valve positions by the particular amount of the magnitude of the actuation required for such a movement. An acceleration of the valve member can then be minimized to this particular required amount. Therefore, not only the reliability of the active vent may be enhanced to enlarge and/or reduce the effective size of the venting channel, but also operating noises of the active vent caused by the movement of the valve member may be kept at a minimum. The reliability enhancement functionality can thus be accompanied by the operating noise optimization functionality of the active vent, as described above, by employing control signal 461 and/or control signal 471.

In order to provide the reliability enhancement functionality and/or operating noise optimization functionality, control signal 461 and/or control signal 471 may be employed, for instance, as the first control signal and second control signal in operation 302 of the method illustrated in FIG. 7 and/or in operation 343 or 347 of the method illustrated in FIG. 11. In other implementations, the reliability enhancement functionality may be provided as an additional functionality of the active vent employing an auxiliary control signal. For instance, control signal 461 and/or control signal 471 may be employed as the first auxiliary control signal and second auxiliary control signal in operation 306 of the method illustrated in FIG. 7 and/or in operation 312 or 316 of the method illustrated in FIG. 8 and/or in operation 306 of the method illustrated in FIG. 9 and/or in operation 306 of the method illustrated in FIG. 10 and/or in operation 343 or 347 of the method illustrated in FIG. 11.

Figure 12I:
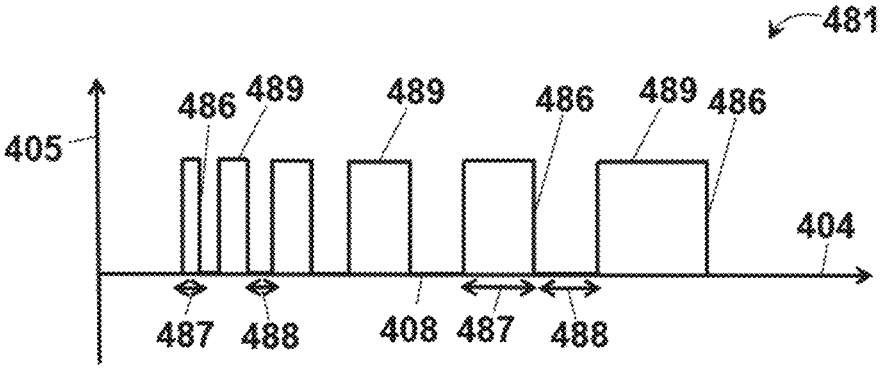
Figure 12J:
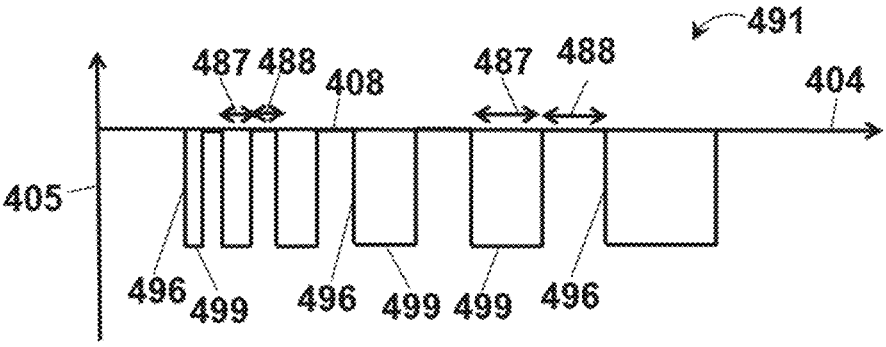

FIG. 12I, J illustrate functional plots of a respective control signal 481, 491 in accordance with some embodiments of the present disclosure. Control signals 481, 491 can control the actuator to provide the actuation force in a temporal sequence, wherein the magnitude of the actuation force over time is successively increased and the direction of the actuation force is kept equal in the temporal sequence. Control signal 481 comprises a plurality of subsequent signal pulses 486. In the illustrated example, six subsequent signal pulses 486 are provided. Subsequent signal pulses 486 have an equal signal level 489. A duration 487 of signal pulses 486 successively increases in the temporal sequence of signal pulses 486. During duration 487, the direction of the actuation force is kept equal in the first direction and the magnitude of the actuation force is kept above the minimum level. The increase of duration 487 is predetermined by the controller.

Control signal 491 comprises a plurality of subsequent signal pulses 496 having an equal signal level 499 with a reversed sign as compared to signal level 489 of control signal 481. The absolute value of signal level 499 corresponds to the absolute value of signal level 489. Moreover, subsequent signal pulses 496 have duration 487 successively increasing corresponding to subsequent signal pulses 486. Thus, control signals 481, 491 can control the actuation force in the temporal sequence in different directions with otherwise equal properties. In particular, control signal 481 may control the actuation force in the first direction and control signal 491 may control the actuation force in the second direction. In other implementations, only one of control signals 481, 491 may be employed to control the actuation force in the first direction, when provided for a first time, and in the second direction, when provided for a second time.

By successively increasing the duration 487 of subsequent signal pulses 486, 496 the actuation force can be controlled to be provided at an increasing amount in the temporal sequence. In this way, a corresponding effect on the actuation of the valve member may be achieved as compared to the increasing signal level 469, 479 of subsequent signal pulses 466, 467 in control signals 461, 471. For instance, control signals 481, 491 may be employed in the place of control signals 461, 471 to provide the reliability enhancement functionality and/or operating noise optimization functionality in the above described way. Increasing duration 487 of subsequent signal pulses 486, 496 may be selected in a similar time range than duration 467, 477 of subsequent signal pulses 466, 467. An envelope curve of control signals 481, 491 may be defined such that points on the envelope curve are determined by signal levels 489, 499 integrated over duration 477, for instance corresponding to envelope curves 465, 475 described above. Increasing duration 487, 497 thus provides an envelope curve having a slope different from zero.

Subsequent signal pulses 486, 496 are separated by an intermediate time interval 488. During intermediate time interval 488, the magnitude of the actuation force is decreased below the minimum level. In the example illustrated in FIG. 12I, J, intermediate time interval 488 successively increases in the temporal sequence of signal pulses 486, 496. For instance, intermediate time interval 488 can be controlled to increase by a corresponding amount than duration 487 of signal pulses 486, 496. Intermediate time interval 488 may also be controlled to decrease, in particular such that a sum of increasing duration 487 and decreasing intermediate time interval 488 is kept constant in the temporal sequence. In particular, a duty cycle of signal pulses 486, 496 in control signals 481, 491 may be controlled to successively increase in the temporal sequence. The effect of the actuation force on the valve member controlled by control signals 461, 471 of an increasing signal level 469, 479 separated by a constant intermediate interval 468 may be mimicked by control signals 481, 491 of an increasing duration 487, 497. Thus, control signals 481, 491 may be employed in the place of control signals 461, 471 to produce a corresponding effect, for instance in the reliability enhancement functionality and/or operating noise optimization functionality. In particular, a shaking displacement behavior of the valve member may be produced during the activation controlled by subsequent signal pulses 486, 496 which can be exploited to overcome obstacles in the pathway of the valve member.

For instance, each signal pulse 486, 496 and consecutive intermediate time interval 488 in the temporal sequence of control signal 481, 491 may control the actuation force in a way corresponding to a respective signal pulse 466, 476 and consecutive intermediate time interval 468, 478 in control signal 461, 471. Thus, envelope curve 465, 475 may be approximated by signal pulses 486, 496 in control signals 481, 491 in a corresponding way than by signal pulse 466, 476. Other shapes of an envelope curve may be implemented by a differently changing duration 487 and/or differently changing intermediate time interval 488 in control signal 481, 491. For instance, intermediate time interval 488 may be kept equal in between the successively increasing duration 487 of signal pulses 486, 496.

To provide subsequent signal pulses 486, 496 with the differing duration 487, a pulse width modulation (PWM) may be controlled by the controller. Subsequent signal pulses 486, 496 may be generated by a control signal generator, in particular a processing unit and/or an amplifier implemented in the hearing device. The controller can thus provide subsequent signal pulses 486, 496 from the control signal generator to the actuator. The control signal generator can be provided by a processing unit and/or an amplifier communicatively coupled to an acoustic transducer of the hearing device. The controller can thus be configured to process and/or amplify an audio signal which is output by the acoustic transducer. In this way, the generation of subsequent signal pulses 486, 496 can be implemented in a space saving manner in the hearing device by employing the processing unit and/or the amplifier communicatively coupled to the acoustic transducer for this purpose. Using PWM to generate the control signal for the actuator of the active vent can further allow an easy adaption of the control signal with the properties required to provide the various active vent functionalities described herein. Alternatively or complementary, the control signal may also be generated by a delta-sigma modulation, in particular PDM, and/or a switched modulation and/or binary weighted modulation and/or a multiplexing and/or another type of DAC.

Figure 12K:
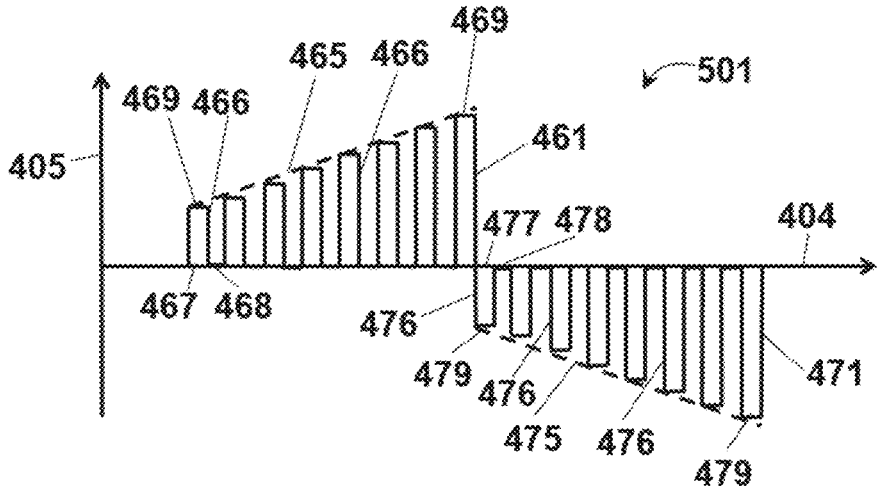

FIG. 12K illustrates a functional plot of a control signal 501 in accordance with some embodiments of the present disclosure. Control signal 501 can control the actuator to provide the actuation force in a temporal sequence in which the magnitude of the actuation force is successively increased in a first number of subsequent signal pulses during which the direction of the actuation force is kept equal in the first direction, and subsequently the magnitude of the actuation force is successively increased in a second number of subsequent signal pulses during which the direction of the actuation force is kept equal in the second direction. In the illustrated example, control signal 501 is composed of control signal 461 comprising the first number of subsequent signal pulses 466 and control signal 471 comprising the second number of subsequent signal pulses 476. Signal pulses 466 and signal pulses 476 are temporally ordered by an increasing value of signal level 466, 476, which corresponds to an increasing amount of the magnitude of the actuation force controlled by control signal 501.

Thus, a saw-tooth shape of the envelope curve 465, 475 can be provided. First number of subsequent signal pulses 466 and second number of subsequent signal pulses 476 may be repeated multiple times in the temporal sequence to continue the saw tooth shape of the signal. In other examples, different shapes and/or slopes of envelope curves 475, 465 and/or different values of signal levels 469, 479 and/or a different number of subsequent signal pulses 466, 467 may be employed. Moreover different durations than durations 467, 477 of first and second signal pulses 466, 476 and/or durations of intermediate time interval 468, 478 may be provided.

When the actuation force is controlled by control signal 501 to be repeatedly provided in the first direction during first number 461 of subsequent signal pulses 466 at a successively increased magnitude, the movement of the valve member from the first valve position to the second valve position can be provided at a high reliability, as described above. Moreover, when the actuation force is controlled by control signal 501 to be repeatedly provided in the second direction during second number 471 of subsequent signal pulses 476 at a successively increased magnitude, the movement of the valve member back from the second valve position to the first valve position can also be provided at a high reliability. A constant repetition frequency of subsequent signal pulses 466, 476 may be employed to produce resonances in the actuation of the valve member, as described above, which may further improve the movement reliability.

This can be exploited in a repair functionality and/or cleaning functionality and/or maintenance functionality of the active vent, as described above. Obstructions in the pathway of the valve member may be overcome by the valve member by providing the particular amount of magnitude that is required to permit the movement of the valve member during at least one of signal pulses 466 and/or signal pulses 476. Cleaning of the venting channel may be provided by the respective movement of the valve member forth and back in the venting channel in order to remove ingress from the venting channel.

In some implementations, a value of signal level 466, 476 which corresponds to the actuation force required for the movement of the valve member may be determined from the time at which the valve member has been moved between the valve positions when control signal 501 is applied to control the actuator. To illustrate, the valve member may be moved forth from the first valve position to the second valve position at the sixth subsequent signal pulse 466 of first number 461 of subsequent signal pulses 466, and moved back from the second valve position to the first valve position at the sixth subsequent signal pulse 476 of second number 471 of the subsequent signal pulses 476. For instance, a processing unit may be configured to determine a time required to move the valve member between the valve positions in a testing functionality of the active vent, as described above, when control signal 501 is applied. The determined required time to move the valve member, when applying the control signal 501, can indicate that the valve member has been moved when controlled by the sixth subsequent signal pulse 466 in the first direction and/or when controlled by the sixth subsequent signal pulse 476 in the second direction. Therefore, the value of signal level 466, 476 required for the movement of the valve member can be identified as the value provided at the sixth subsequent signal pulse 466, 476. After determining the value of signal level 466, 476 corresponding to the required actuation force, the first and second control signal applied during regular operation of the active vent can be provided having a signal level with a corresponding value. In this way, the reliability of the active vent may be enhanced during the regular active vent operation of enlarging or reducing the effective size of the venting channel Beyond that, the operating noise of the active vent may be optimized during the regular active vent operation.

Figure 12L:
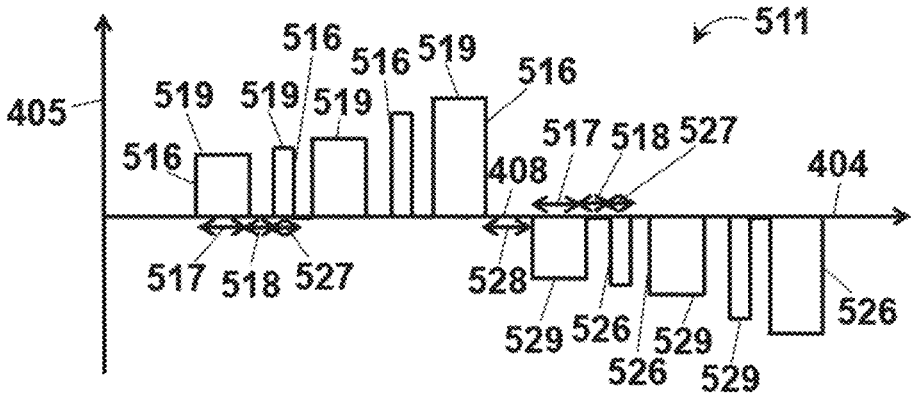

FIG. 12L illustrates a functional plot of a control signal 511 in accordance with some embodiments of the present disclosure. Control signal 501 can control the actuator to provide the actuation force in a temporal sequence in which the magnitude of the actuation force is successively altered in a first number of subsequent signal pulses during which the direction of the actuation force is kept equal in the first direction, and subsequently the magnitude of the actuation force is successively altered in a second number of subsequent signal pulses during which the direction of the actuation force is kept equal in the second direction. The first number comprises signal pulses 516 with an absolute value of a signal level 519 successively increasing in the temporal sequence. A duration of consecutive signal pulses 516 is periodically altered between a longer duration 517 and a shorter duration 528 in the temporal sequence. An intermediate time interval 518 separating signal pulses 516, during which the magnitude of the actuation force is decreased below the minimum level, is kept equal.

The second number comprises signal pulses 526 with an absolute value of a signal level 529 successively increasing in the temporal sequence, wherein signal level 529 has an inverse sign as compared to signal level 519. The absolute value of signal level 529 increases by an equivalent amount in the temporal sequence of signal pulses 526 as compared to the absolute value of signal level 519 in the temporal sequence of signal pulses 516. The duration of signal pulses 526 is also periodically altered between longer duration 517 and shorter duration 528 in the temporal sequence. Signal pulses 526 are also separated by equal intermediate time interval 518. The first number of subsequent signal pulses 516 and the second number of subsequent signal pulses 526 are separated by an intermediate time interval 528. During intermediate time interval 528, the magnitude of the actuation force is decreased below the minimum level and the direction of the actuation force is changed between the first direction and the second direction.

Successively increasing signal level 519 and alternating duration 517, 518 of signal pulses 516 can control the actuation force with an irregularly changing magnitude over time. For instance, the magnitude of the actuation force over time in the first direction can decrease between the first to the second signal pulse 516, and then increase between the second and third signal pulse 516 to a larger value as compared to the magnitude over time controlled by the first signal pulse 516, and then decrease again between the third and fourth signal pulse 516. The same irregularly changing magnitude of the actuation force over time in the second direction can be controlled by subsequent signal pulses 526. Correspondingly, an envelope curve of control signal 511, as defined by integrating successively increasing signal level 519, 529 over alternating duration 517, 518 at each signal pulse 516, 526, may have an unsteadily changing slope. Alternating duration 517, 518 and increasing signal level 519, 529 may be provided by PWM combined with a modification of signal level 519, 529 controlled by the controller.

The irregularly changing magnitude of the actuation force over time can be exploited to produce a shaking displacement behavior of the valve member during actuation. Moreover, various actuation forces can be scanned through over time in order to find a suitable actuation control for the valve member out of various possibilities. This can be exploited in a repair functionality and/or cleaning functionality and/or maintenance functionality of the active vent, as described above. To this end, control signal 511 may be applied in the place of control signal 501. Alternating duration 517, 518 of signal pulses 516, 518 of subsequent signal pulses 516, 526 may then be selected in a similar time range than duration 467, 477 of subsequent signal pulses 466, 467. First number of subsequent signal pulses 516 and second number of subsequent signal pulses 526 may also be repeated multiple times in the temporal sequence to enhance the effect on the actuation. For example, control signal 501 and/or control signal 511 may be employed as the first auxiliary control signal and second auxiliary control signal in operation 306 of the method illustrated in FIG. 7 and/or in operation 312 or 316 of the method illustrated in FIG. 8 and/or in operation 306 of the method illustrated in FIG. 9.

The first number of signal pulses 516 of control signal 511 may also be employed as a separate control signal, for instance in the place of control signal 461 or control signal 481 to provide a corresponding functionality of the active vent by repeatedly controlling the actuation force in the first direction. The second number of signal pulses 526 of control signal 511 may then be correspondingly employed as a separate control signal, in particular in the place of control signal 471 or control signal 491 to provide a corresponding functionality of the active vent by repeatedly controlling the actuation force in the second direction. In particular, the reliability enhancement functionality and/or operating noise optimization functionality may be implemented in such a manner.

Figure 12M:
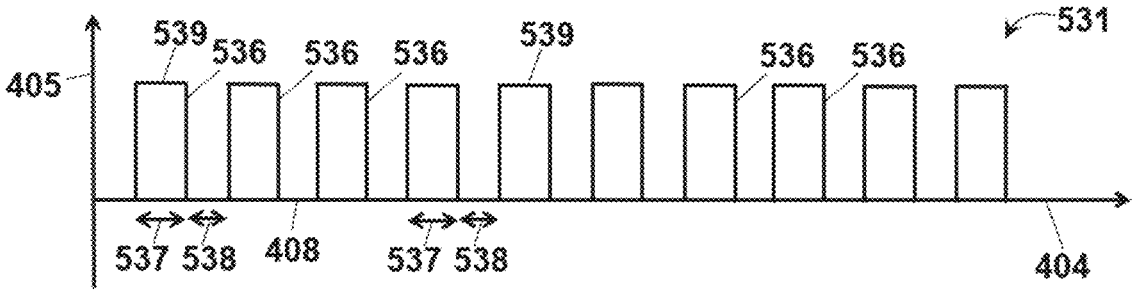

FIG. 12M illustrates a functional plot of a control signal 531 in accordance with some embodiments of the present disclosure. Control signal 531 can be employed to control an actuator of an active vent to provide the actuation force in a temporal sequence at a constant repetition frequency, wherein the magnitude of the actuation force is kept equal in the subsequent signal pulses. Control signal 531 comprises a plurality of subsequent signal pulses 496 at a constant repetition frequency. The constant repetition frequency may be provided by an equal duration 537 of signal pulses 496 and an equal duration of an intermediate time interval 538 separating signal pulses 496. Intermediate time interval 538 and duration 537 are predetermined by the controller.

In the illustrated example, control signal 531 comprises ten subsequent signal pulses 496. In other examples, control signal 531 may comprise a larger number of subsequent signal pulses 496. For instance, the controller may be configured to provide control signal 531 with an unlimited number of subsequent signal pulses 496 until the controller determines a certain event and/or receives an input signal from a user interface. In other examples, control signal 531 may comprise a smaller number of subsequent signal pulses 496, for instance at least three subsequent signal pulses 496. Subsequent signal pulses 496 are provided with an equal signal level 539.

Control signal 531 can control the actuation force during duration 537 of subsequent signal pulses 496 at a magnitude above the minimum level for effectuating a movement of the valve member between the valve positions, wherein the direction of the actuation force is switched between the first direction and the second direction in consecutive signal pulses 496. Control signal 531 can thus control the actuator to repeatedly actuate the movement of the valve member from the first valve position to the second valve position and from the second valve position to the first valve position. Subsequent signal pulses 496 may thus be distinguished as first repeated signal pulses and second repeated signal pulses alternating in the temporal sequence of signal pulses 496 such that the first repeated signal pulses control the actuator to provide the actuation force in the first direction and the second repeated signal pulses control the actuator to provide the actuation force in the second direction. The repetition frequency of the repeated forth and back movement of the valve member may correspond to half the repetition frequency of subsequent signal pulses 496. In particular, the valve member movement may have a repetition frequency corresponding to the multiplicative inverse of the twice the sum of duration 537 and intermediate time interval 538.

Figure 12N:
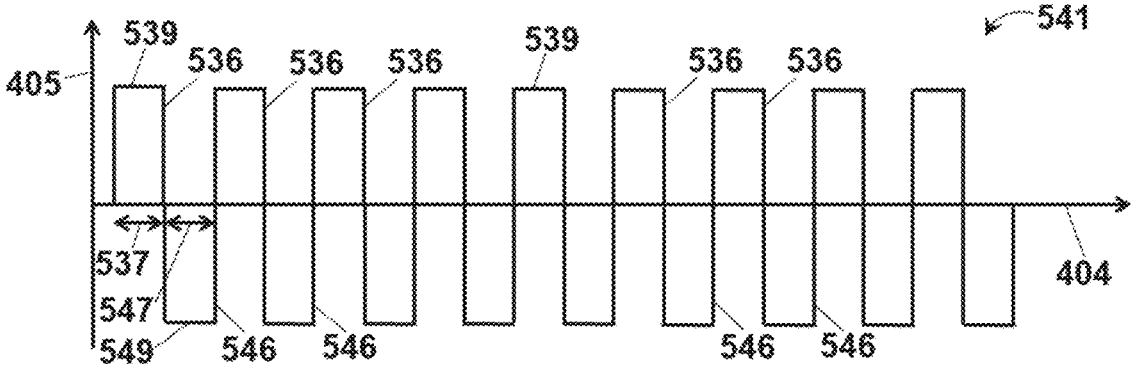

FIG. 12N illustrates a functional plot of a control signal 541 in accordance with some embodiments of the present disclosure. Control signal 541 can also be employed to control an actuator of an active vent to provide the actuation force in a temporal sequence at a constant repetition frequency, wherein the magnitude of the actuation force is kept equal in the subsequent signal pulses. Control signal 541 comprises a plurality of subsequent signal pulses 496 at a constant repetition frequency. In addition, control signal 541 comprises another plurality of subsequent signal pulses 546 at a constant repetition frequency. Signal pulses 546 also have an equal duration 547. Duration 547 may be equal to duration 539 or different from duration 539. Durations 537, 547 are predetermined by the controller. A signal level 549 of signal pulses 546 has an inverse sign as compared to signal level 539 of signal pulses 496. An absolute value of signal level 549 may correspond to the absolute value of signal level 539 in order to control an actuation force of the same magnitude.

Control signal 541 includes signal pulses 496 and signal pulses 546 in a pairwise succession in the temporal sequence. In this way, the actuation force can be controlled to change between the first direction and the second direction by a respective pair of signal pulses 496 and signal pulses 546. In intermediate time interval, during which the change of the actuation force is controlled, is substantially zero. The valve member can thus be controlled to be displaced back and forth between the two valve positions by a respective signal pulse pair 496, 546. Subsequent signal pulses 496, 546 may be distinguished as first repeated signal pulses and second repeated signal pulses alternating in the temporal sequence such that the first repeated signal pulses 496 control the actuator to provide the actuation force in the first direction, and the second repeated signal pulses 546 control the actuator to provide the actuation force in the second direction.

Control signal 541 may comprise a number of subsequent signal pulses 496, 546 corresponding to the number of subsequent signal pulses 496 in control signal 531, in order to provide a corresponding technical effect. The repetition frequency of the repeated forth and back movement of the valve member may correspond to the repetition frequency of subsequent signal pulses 496 and the repetition frequency of subsequent signal pulses 546. The repetition frequency of the repeated forth and back movement of the valve member may also correspond to half the repetition frequency of subsequent signal pulses 496, 546 taken together. In particular, the valve member movement may have a repetition frequency corresponding to the multiplicative inverse of the sum of durations 537 and 547. Subsequent signal pulses 496, 546 of control signal 541 are provided in an immediate temporal succession such that the intermediate time interval between subsequent signal pulses 496, 546 is substantially zero. Thus, control signal 541 may be employed to provide a faster forth and back movement of the valve member between the valve positions as compared to control signal 531.

Figure 12O:
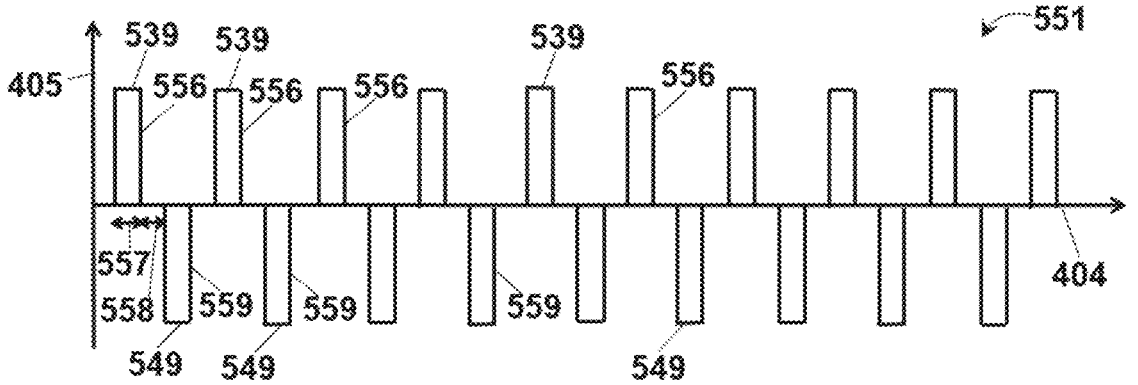

FIG. 12O illustrates a functional plot of a control signal 551 in accordance with some embodiments of the present disclosure. Control signal 551 can also be employed to control an actuator of an active vent to provide the actuation force in a temporal sequence at a constant repetition frequency, wherein the magnitude of the actuation force is kept equal in the subsequent signal pulses. Control signal 551 comprises a plurality of subsequent signal pulses 556 at a constant repetition frequency. Subsequent signal pulses 556 have an equal duration 557 and an equal signal level 539. Control signal 551 further comprises a plurality of subsequent signal pulses 559 at a constant repetition frequency. Subsequent signal pulses 559 also have an equal duration. Signal level 549 of signal pulses 559 has an inverse sign as compared to signal level 539 of signal pulses 556. The duration of signal pulses 559 may correspond to duration 557, or may be different. Duration 557 is predetermined by the controller.

Control signal 551 includes signal pulses 556 and signal pulses 559 in a pairwise succession in the temporal sequence. Subsequent signal pulses 556, 559 of control signal 551 are separated by an intermediate time interval 558. During intermediate time interval 558, the actuation force is controlled to a lower magnitude as compared to the magnitude of the actuation force provided during duration 557 of signal pulses 556. In particular, the magnitude of the actuation force is decreased below the minimum level during intermediate time interval 558 and increased above the minimum level during duration 557. Moreover, the direction of the actuation force is changed between the first direction and the second direction during intermediate time interval 558. Intermediate time interval 558 is predetermined by the controller. Intermediate time interval 558 has an equal duration between each pairwise succession from signal pulse 556 to signal pulse 559. Intermediate time interval 558 also has an equal duration between each pairwise succession from signal pulse 559 to signal pulse 556.

Control signal 551 can be employed correspondingly to control signal 541 to provide a forth and back movement of the valve member between the valve positions. A sum of duration 557 of signal pulses 556, 559 and intermediate time interval 558 in control signal 551 may correspond to duration 537, 547 of signal pulses 496, 546 in control signal 541 to control the actuation force at an equal repetition frequency of the forth and back movement of the valve member.

Figure 12P:
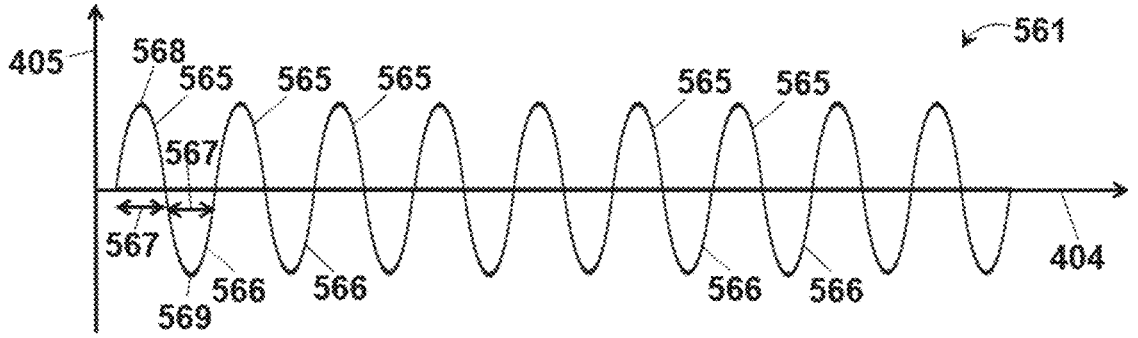

FIG. 12P illustrates a functional plot of a control signal 561 in accordance with some embodiments of the present disclosure. Control signal 561 can also be employed to control an actuator of an active vent to provide the actuation force in a temporal sequence at a constant repetition frequency, wherein the magnitude of the actuation force is equally applied in the subsequent signal pulses. Control signal 561 comprises a plurality of subsequent signal pulses 565, 566 with a respective duration 567. Duration 567 is predetermined by the controller. Control signal 561 is provided by a sine function with a period corresponding to twice the duration 567 of signal pulses 565, 566. The sine function intersects time axis 404 at the beginning and end of duration 567 of signal pulses 565, 566. Thus, signal pulses 565, 566 are provided in a pairwise succession, wherein signal pulses 565 represents a positively valued sinusoidal signal pulse and signal pulses 566 represents a negatively valued sinusoidal signal pulse.

Positively valued sinusoidal signal pulse 565 has a peak signal level 568, and negatively valued sinusoidal signal pulse 566 has a peak signal level 569. Peak signal levels 568, 569 can be each above a signal threshold required for controlling the actuator to provide the actuation force with a magnitude effectuating the movement of the valve member between the valve positions. Positively valued sinusoidal signal pulse 565 may thus control the actuation of the movement of the valve member in the first direction. Negatively valued sinusoidal signal pulse 566 may thus control the actuation of the movement of the valve member in the second direction. During each pairwise succession of signal pulses 565, 566, the actuator can thus control to actuate the movement of the valve member forth and back between the two valve positions. The valve member movement may have a repetition frequency corresponding to the multiplicative inverse of twice the duration 567. Positively valued sinusoidal signal pulse 565 and negatively valued sinusoidal signal pulse 566 may also be provided as an envelope curve of a plurality of subsequent signal pulses. For instance, subsequent signal pulses with a differing signal level, as described in conjunction with FIGS. 12G, H, and/or subsequent signal pulses with a differing duration, as described in conjunction with FIGS. 12I, J, may be employed to produce such a sinusoidal envelope curve.

Any of control signals 531, 541, 551, 561 may be provided by a controller to an actuator of an active vent to repeatedly actuate the movement of the valve member forth and back between the two valve positions at the repetition frequency. For instance, control signals 531, 541, 551, 561 can be employed in operation 306 of the method illustrated in FIG. 7 and/or operation 312 or 316 of the method illustrated in FIG. 8 and/or operation 306 of the method illustrated in FIG. 9 and/or operation 306 of the method illustrated in FIG. 10. Control signals 531, 541, 551, 561 can be employed to provide a checking and/or testing functionality of the active vent, as described above. In control signals 531, 551, for instance, a predetermined time interval including intermediate time interval 538, 558 and/or part of signal pulse durations 537, 557 can be selected such that the valve member is positioned in the second valve position and/or in the first valve position for a duration in which a presence of the valve member in the respective valve position is visually identifiable. Correspondingly, in control signals 551, 561, at least part of signal pulse durations 537, 547, 567 may be selected to provide a predetermined time interval in which the valve member is positioned in the second valve position and/or in the first valve position for a duration allowing visual identification of the valve position. For instance, duration 567 of sinusoidal signal pulses 565, 566 in control signal 561 may be provided rather long in order to provide the predetermined time interval allowing visual identification of the valve position. Control signals 531, 541, 551, 561 may also be employed to provide a repair functionality and/or cleaning functionality and/or maintenance functionality of the active vent in the above described way.

Control signals 531, 541, 551, 561 can also be employed to provide a vibration functionality of the active vent, as described above. The vibrations may be produced by providing a rather large repetition frequency of the respective signal pulses in the control signals. Moreover, signal levels 539, 549, 568, 569 may be provided rather large to cause a rather large acceleration of the valve member in order to induce vibrations into the housing moveable coupled with the valve member. As a concrete example, the control signal may control a forth and back movement of the valve member at a repetition frequency between 10 Hz and 100 Hz for a time period of one second or more to produce vibrations of the housing of the hearing device.

The vibrations may be applied in a notification functionality and/or to perform vibration measurements at the ear, for instance during a fitting of the hearing device at the ear, as described above. When applied as a notification functionality, the produced vibrations may not exceed a time period of five seconds to avoid an overlong disturbance of the user. The time period of the produced vibrations may also be adjustable, for instance by a user interface. Generally, the properties of the produced vibrations can depend on multiple factors including not only the repetition frequency and the duration of the control signal but also mechanical properties such as the mass of the valve member movable between the valve positions and properties of the moveable coupling with the housing, in particular the bearings of the valve member.

Figure 13A:
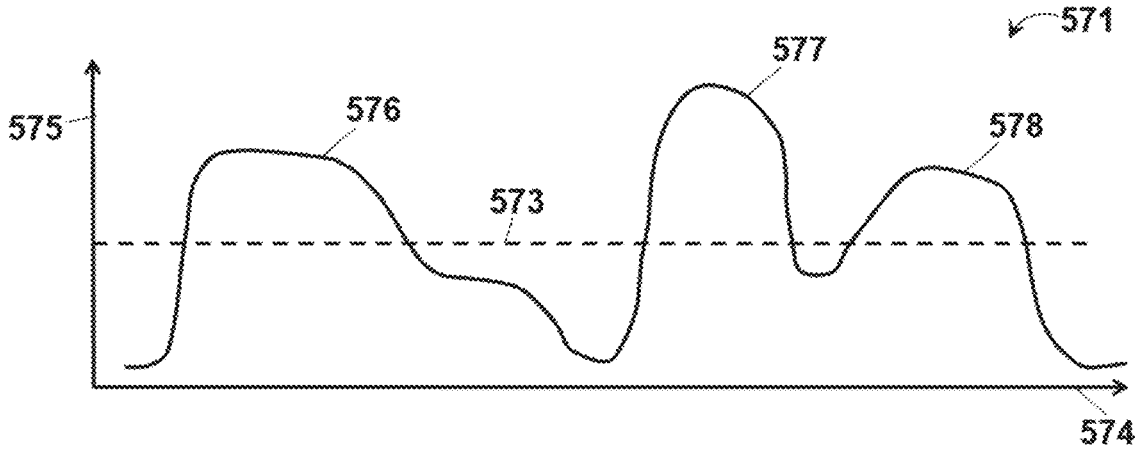
FIG. 13A schematically illustrates an exemplary audio signal.

FIG. 13A illustrates a functional plot of an audio signal 571 in accordance with some embodiments of the present disclosure. Audio signal 571 is plotted as a function of a signal level indicating a sound level amplitude over time. The time is indicated on an axis of abscissas 554. The signal level is indicated on an axis of ordinates 575. Audio signal 571 may be provided by a microphone of the hearing device based on sound detected by the microphone from an environment of the user. Audio signal 571 is plotted relative to a threshold signal level 573. In the illustrated example, audio signal 571 comprises three signal portions 576, 577, 578 above the threshold signal level 573. Audio signal 571 may be evaluated relative to threshold signal level 573 by a processing unit.

Figure 13B:
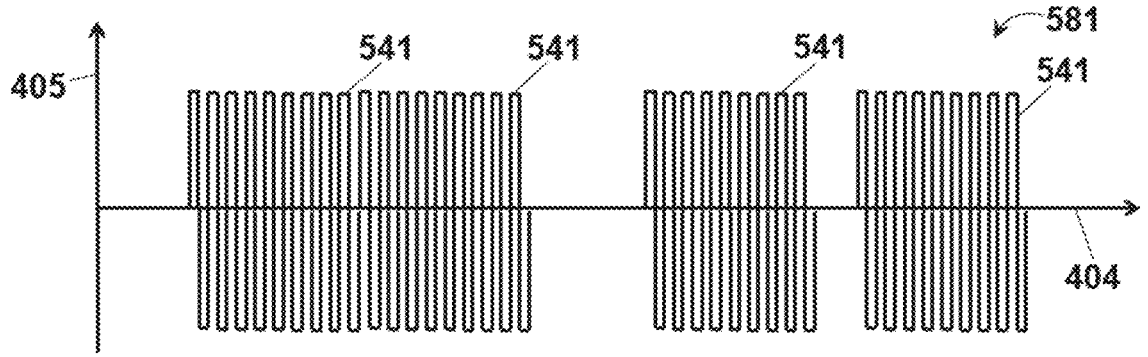
FIGS. 13B, C schematically illustrate exemplary auxiliary control signals that can be provided to an actuator of an active vent depending on the audio signal illustrated in FIG. 13A.

FIG. 13B illustrates a functional plot of a sequence 581 of control signals 541 provided to an actuator of an active vent by a controller. Control signals 541, as described in conjunction with FIG. 12K, can control the actuator to provide a vibration functionality of the active vent. For illustrative purposes, control signals 541 are only schematically shown in FIG. 13B at a slower time progression of the subsequent signal pulses such that they can be compared relative to a timescale of typical variations of audio signal 571 depicted in FIG. 13A. At a time at which audio signal 571 is determined to exceed threshold signal level 573 at the beginning of first signal portion 576, control signal 541 is provided for a first time in order to produce vibrations of the housing moveably coupled to the active vent. Thus, a user wearing the housing inside the ear canal can notice a haptic feeling caused by the vibrations. In this way, as described above, a sound indication functionality can be provided by the active vent.

At a time at which the provided control signal 541 is terminated, audio signal 571 is determined to be still above the threshold signal level 573 within first signal portion 576. In consequence, control signal 541 is provided for a second time such that the vibrations of the housing can continue in order to haptically inform the user about the sound. At a time at which the control signal 541 provided the second time is terminated, audio signal 571 is determined to be below the threshold signal level 573. Thus, control signal 541 is not provided for a third time, at least for the time being, in order to stop the vibrations of the housing. The vibrations controlled by control signal 541 provided the second time, however, slightly outlast the end of first signal portion 576 at which audio signal 571 is below threshold 573. At a time at which audio signal 571 is determined to exceed threshold signal level 573 again at the beginning of second signal portion 577, control signal 541 is provided for a third time in order to produce vibrations of the housing moveably coupled to the active vent. Similarly, at a time at which audio signal 571 is again determined to exceed threshold signal level 573 again at the beginning of third signal portion 578, control signal 541 is provided for a fourth time. The vibrations produced by the active vent can thus be employed to approximate an envelope of a sound level amplitude detected by the microphone.

Figure 13C:
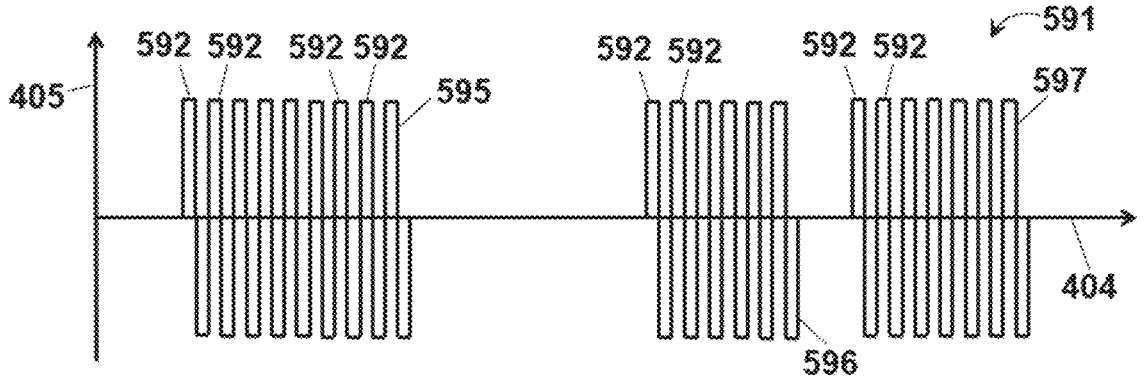

FIG. 13C illustrates a functional plot of another sequence 591 of control signals provided to an actuator of an active vent by the controller. Short control signals 592 are provided to the actuator of the active vent in rapid succession once the audio signal 571 is determined to exceed threshold signal level 573 at the beginning of first signal portion 576. Each control signal 592 can control actuation of at least one forth and back movement of the valve member between the two valve positions. Control signals 592 are continuously provided in the temporal succession until the audio signal 571 is determined to fall below threshold signal level 573 at the end of first signal portion 576. In this way, a control signal 595 consisting of a group of control signals 592 is provided to the actuator of the active vent. Similarly, another control signal 596 is formed by a group of subsequent control signals 592 for the duration at which audio signal 571 is determined to exceed threshold signal level 573 during second signal portion 577. Another control signal 597 consists of a number of subsequent control signals 592 for the duration of audio signal 571 exceeding threshold signal level 573 during third signal portion 578. Control signal 592 when provided on its own, for instance when provided at a large temporal distance from another control signal, may be too short to produce vibrations of the housing. However, when provided in signal group 595, 596, 597, the repeated provision of control signal 592 at the temporal sequence can produce the vibrations depending on the number of successions of control signals 592. The number of successions of control signals 592 in each signal group 595, 596, 597 depends on the respective durations of audio signal 571 above threshold signal level 573 in the respective signal portions 576, 577, 578. In this way, the vibrations produced by the active vent may provide an enhanced approximation of an envelope of a sound level amplitude detected by the microphone.

The controller may be configured to provide the subsequent signal pulses with a repetition frequency depending on the audio signal. Different control signals may be provided depending on the amount by which threshold signal level 573 is exceeded by audio signal 571. The different control signals may differ by the repetition frequency at which the forth and back movement of the valve member between the two valve positions is actuated. For instance, the different control signals may comprise a first control signal and a second control signal which are distinguished by a differing value of the duration of the subsequent signal pulses and/or a differing value of the intermediate time interval separating the signal pulses. In this way, a different value of the repetition frequency may be provided in the first and second control signal. When audio signal 571 exceeds threshold signal level 573 only by a small amount, the first control signal may be provided such that it controls the forth and back movement of the valve member between the two valve positions at a smaller repetition frequency. When audio signal 571 exceeds threshold signal level 573 by a larger amount, the second control signal may be provided such that it controls the forth and back movement of the valve member between the two valve positions at a larger repetition frequency. The controller may thus be configured to provide the control signal with a varying repetition frequency of the repeated actuation. The produced vibrations can then be provided with a vibration frequency depending on the audio signal level. The produced vibrations can thus be frequency modulated depending on the audio signal level. The haptic feeling caused by the vibrations may thus be perceptible more intensive by the user at a larger audio signal level as compared to a smaller audio signal level.

The controller may be configured to provide the subsequent signal pulses controlling the actuator to provide the actuation force with a magnitude depending on the audio signal. Different control signals depending on the audio signal may differ by controlling a different acceleration of the valve member during the forth and back movement between the two valve positions. The different control signals may comprise a first control signal and a second control signal which are distinguished by a differing value of signal level during the subsequent signal pulses. The differing signal level of the control signals can cause the different acceleration of the valve member. The different acceleration can affect the amplitude of the produced vibrations. When audio signal 571 exceeds threshold signal level 573 only by a small amount, the first control signal may be provided such that it controls the forth and back movement of the valve member between the two valve positions at a smaller signal level to produce a smaller acceleration of the valve member.

When audio signal 571 exceeds threshold signal level 573 by a larger amount, the second control signal may be provided such that it controls the forth and back movement of the valve member between the two valve positions at a larger signal level to produce a larger acceleration of the valve member. The controller may thus be configured to provide the control signal with a varying value of the signal level during the subsequent signal pulses. The produced vibrations can then be controlled with an acceleration of the valve member depending on the audio signal level. The produced vibrations can thus be modulated depending on the audio signal level. The haptic feeling caused by the vibrations may thus be perceptible more intensive by the user at a larger audio signal level as compared to a smaller audio signal level.

The sound indication functionality of the active vent illustrated above may be particularly advantageous when employed for speech recognition. A speech signal may be encoded by audio signal 571. For instance, the microphone may detect speech of a person talking to the user and provide the speech signal based on the detected speech signal. By modulating the vibrations of the housing depending on a sound level of a speech signal, the user may get a haptic input stimuli in addition to an acoustic one, which may be provided by an acoustic output transducer. The haptic and the acoustic input stimuli can be correlated with each other by the user and both contain relevant information to understand speech. In particular, an envelope of the speech signal can contain sufficient and/or at least highly helpful information to understand the speech. For example, modulating white noise with the sound level envelope of a speech signal can render the white noise understandable as speech. In addition, the modulation of the vibrations of the housing can get synchronized with the speech signal, e.g. with a pitch frequency of the speech signal, thus providing even further information. As the brain is highly adaptable, it can learn to interpret the haptic feedback provided by the vibration functionality of the active vent and integrate it with the acoustic input from the acoustic transducer into a better speech understanding.

Figure 14A:
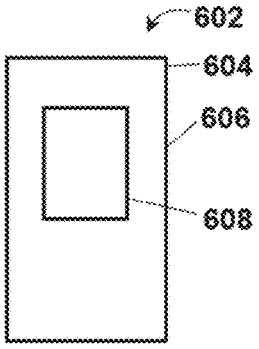
FIGS. 14A-E schematically illustrate various views of an exemplary hearing device housing and an acoustic valve of an active vent at different positions of the acoustic valve, in accordance with some embodiments of the present disclosure.
Figure 14B:
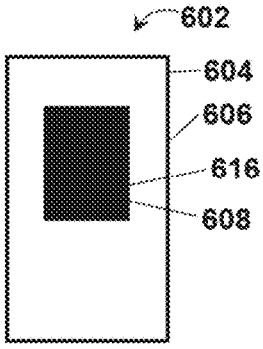
Figure 14C:
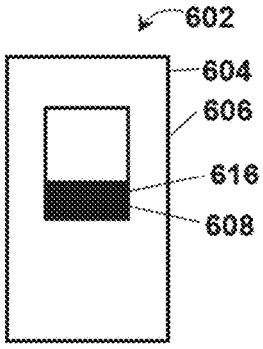

FIGS. 14A, 14B, and 14C schematically illustrate a portion of a housing 602 of a hearing device configured to be at least partially inserted into an ear canal according to some embodiments of the present disclosure. Housing 602 comprises an outer wall 604 delimiting an inner volume surrounded by housing 602 from the exterior. Outer wall 604 comprises a side wall 606 extending in a direction of the ear canal when housing 602 is at least partially inserted into the ear canal. FIGS. 14A, 14B, 14C depict side wall 606 from a viewing angle exterior from housing 602. Housing 142 has an opening 608 leading from the inner volume to the exterior of the housing. Opening 608 is provided as a through hole in side wall 606. Opening 608 forms part of a venting channel of an active vent. The venting channel extends through the inner volume of housing 602. A valve member 616 of an acoustic valve of the active vent is moveably coupled with housing 602 such that valve member 616 is moveable relative to opening 608 between different valve positions.

FIG. 14A illustrates housing 602 in a situation in which valve member 616 is positioned at a valve position in which valve member 616 is not visible at opening 616 from the exterior of housing 602. FIGS. 14B and 14C illustrate housing 602 in a situation in which valve member 616 is positioned at a respective valve position in which valve member 616 is visible at opening 616 from the exterior of housing 602. For instance, outer wall 604 and valve member 616 may be implemented by outer wall 144 and valve member 156, 196 of earpiece 140 illustrated in FIGS. 3A, 3B, or earpiece 170 illustrated in FIGS. 4A, 4B, or earpiece 190 illustrated in FIGS. 6A, 6B. The valve position illustrated in FIG. 14A may correspond to the position of valve member 156, 196 depicted in FIGS. 3A, 4A, 6A in which the venting channel through opening 148 is uncovered by valve member 156. The valve position illustrated in FIG. 14B may correspond to the position of valve member 156, 196 depicted in FIGS. 3B, 4B, 6B in which the venting channel through opening 148 is covered by valve member 156, 196. The valve position illustrated in FIG. 14C may correspond to an intermediate position of valve member 156, 196 in between the positions depicted in FIGS. 3A, 4A, 6A and FIGS. 3B, 4B, 6B such that the venting channel through opening 148 is partially covered by valve member 156, 196. Any of the valve positions illustrated in 14A, 14B, and 14C can correspond to a first valve position, and any other of the valve positions illustrated in 14A, 14B, and 14C can correspond to a second valve position. A control signal can thus be provided to the actuator of the active vent in the above described way to actuate the movement of the valve member from the first valve position to the second valve position, and subsequently from the second valve position to the first valve position. In this way, a checking functionality of the active vent can be provided. As described above, obstacles in the venting channel may prevent the active vent from a proper functioning, for instance by blocking the movement of the valve member. The checking functionality can then be applied to determine such a malfunction of the active vent. The checking functionality may be applied when the housing is not inserted into the ear canal in order to evaluate the different valve positions by a visual inspection of opening 608 from the housing exterior.

Figure 14D:
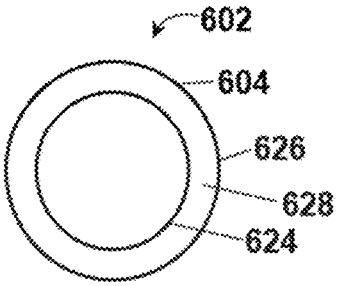
Figure 14E:
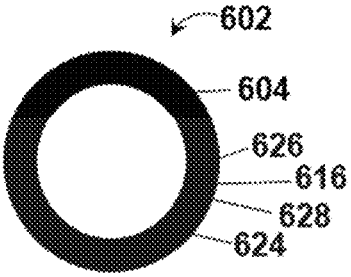

FIGS. 14D and 14E schematically illustrate another portion of housing 602 from a different viewing angle from the exterior of housing 602. Outer wall 604 comprises a front wall 626 facing a tympanic membrane at the end of the ear canal when housing 602 is at least partially inserted into the ear canal. Front wall 626 has an opening 628 connecting the inner volume with the exterior of housing 142. Opening 628 forms part of a venting channel of an active vent. Housing 602 further comprises an inner wall 624 surrounded by outer wall 604. In the examples illustrated in FIGS. 14D and 14E, valve member 616 of the acoustic valve of the active vent is moveably coupled with housing 602 such that valve member 616 is moveable relative to opening 628 between different valve positions.

FIG. 14D illustrates housing 602 in a situation in which valve member 616 is positioned at a valve position in which valve member 616 is not visible at opening 628 from the exterior of housing 602. FIG. 14E illustrates housing 602 in a situation in which valve member 616 is positioned at a valve position in which valve member 616 is visible at opening 628 from the exterior of housing 602. For instance, outer wall 604 and valve member 616 may be implemented by outer wall 144 and valve member 186, 196 of earpiece 180 illustrated in FIGS. 5A, 5B, or of earpiece 190 illustrated in FIGS. 6A, 6B. The valve position illustrated in FIG. 14D may correspond to the position of valve member 186, 196 depicted in FIG. 5B, 6B in which the venting channel through opening 158 is blocked by valve member 186, 196. The valve position illustrated in FIG. 14E may correspond to the position of valve member 186, 196 depicted in FIG. 5A, 6B in which the venting channel through opening 158 is not blocked by valve member 186, 196. Any of the valve positions illustrated in FIG. 14D and in FIG. 14E can correspond to a first valve position, and the other to a second valve position. In this way, a checking functionality of the active vent can be provided allowing to evaluate the different valve positions by a visual inspection of opening 628 from the housing exterior when the auxiliary control signal is provided to the actuator of the active vent.

Figure 15:
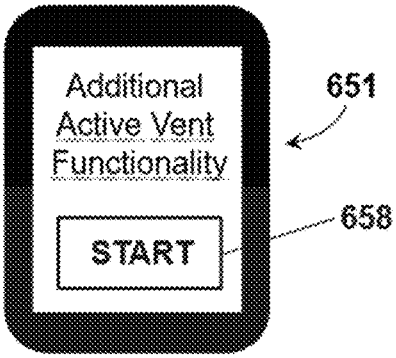
FIG. 15 schematically illustrates an exemplary remote device connectable to a hearing device.

FIG. 15 schematically illustrates a remote device 651. Remote device 651 is connectable to a hearing device comprising an active vent. Remote device 651 can thus be communicatively coupled to a controller controlling an actuator of the active vent. For instance, remote device 651 may be implemented as a smartphone, a personal computer, and/or the like. In some implementations, as illustrated in FIG. 15, remote device 651 comprises a user interface 658. By user interface 658, an input signal can be provided to the controller to command the controller to provide an auxiliary control signal to the actuator of the active vent. In this way, the user and/or another individual such as an HCP may initiate any of the additional functionalities of the active vent, as described above. In some implementations, remote device 801 may be configured to provide a notification signal to the hearing device, such as a phone call signal, a timer signal, an alarm signal, and/or the like. The notification signal can then be employed to command the controller to provide a control signal, in particular an auxiliary control signal, to the actuator of the active vent to initiate the additional vent functionality.

Figure 16A:
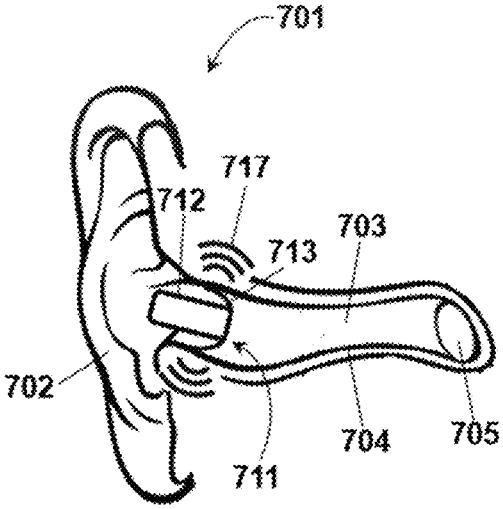
FIGS. 16A, B schematically illustrate an exemplary earpiece inserted into an ear canal comprising an active vent providing an additional active vent functionality.

FIG. 16A schematically illustrates an ear 701 comprising a concha 702, an ear canal 703 delimited by an ear canal wall 704, and a tympanic membrane 705. An earpiece 711 of a hearing device comprises a housing 712 which is at least partially inserted into ear canal 703. Housing 712 may be implemented, for instance, by any of housings 102, 112, 142, 172, 182, 292, 602 described above. Vibrations 717 of housing 712 can be generated by a vibration functionality of an active vent implemented in earpiece 711, as described above. At a portion of housing 712 contacting ear canal wall 704, those vibrations can be transferred to the skin of the user such that they are perceptible by the user as a haptic feeling. The vibration functionality of the active vent can be further employed, for instance, in a notification functionality, in a sound indication functionality, in an ear canal measurement functionality and/or in a fitting functionality.

Figure 16B:
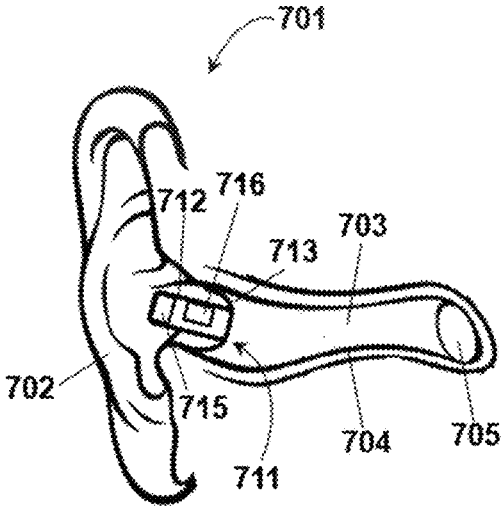

As schematically illustrated in FIG. 16B, an acoustic transducer 715 and a microphone 716 may be implemented with earpiece 711. Acoustic transducer 715 can be acoustically coupled to the inner region of the ear canal. For instance, a sound conduit may be provided between an output of acoustic transducer 715 and a front wall of the earpiece housing facing the tympanic membrane when earpiece 715 is at least partially inserted into the ear canal. Microphone 716 can be acoustically coupled to the ambient environment outside the ear canal when earpiece 715 is at least partially inserted into the ear canal. For instance, microphone 716 may be positioned between a rear wall of the earpiece housing facing away from the tympanic membrane and a contact portion of the earpiece housing configured to contact an ear canal wall of the ear canal when earpiece 715 is at least partially inserted into the ear canal.

The sound indication functionality of the active vent may be based on an audio signal provided by microphone 716. Microphone 716 may be employed to detect sound in an environment of the user which is then converted in vibrations of the housing, as described above. The ear canal measurement functionality of the active vent may be based on an audio signal provided by microphone 716. Microphone 716 may then be employed to detect sound related to audiological measurements in the ear canal during vibrations of the housing effectuated by the active vent, as described above. The testing functionality of the active vent may be based on an audio signal provided by microphone 716. Microphone 716 may then be employed to detect sound in the ear canal when the auxiliary control signal controlled the actuator to move the acoustic valve to the second valve position. A signal to noise ratio and/or a feedback value between output transducer 715 and microphone 716 determined in the audio signal provided by microphone 716, for instance by a processing unit, may then indicate if the acoustic valve has been moved to the second valve position or if the acoustic valve is still positioned in the first valve position. In this way, a malfunction of the active vent may be determined by the testing functionality, as described above.

While the principles of the disclosure have been described above in connection with specific devices and methods, it is to be clearly understood that this description is made only by way of example and not as limitation on the scope of the invention. The above described preferred embodiments are intended to illustrate the principles of the invention, but not to limit the scope of the invention. Various other embodiments and modifications to those preferred embodiments may be made by those skilled in the art without departing from the scope of the present invention that is solely defined by the claims. In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A hearing device comprising:

a housing configured to be at least partially inserted into an ear canal, the housing surrounding a volume through which a venting channel extends, the venting channel configured to provide for venting between an inner region of the ear canal and an ambient environment outside the ear canal;

an acoustic valve comprising a valve member moveable relative to the venting channel between different positions including a first valve position and a second valve position such that an effective size of the venting channel is modifiable by a movement of the valve member between the different positions;

an actuator configured to provide an actuation force with a direction and a magnitude acting on the valve member, wherein said direction includes a first direction for actuating the movement of the valve member from the first valve position to the second valve position, and a second direction for actuating the movement of the valve member from the second valve position to the first valve position;

a controller configured to provide a first control signal controlling the actuator to provide the actuation force in the first direction, and to provide a second control signal controlling the actuator to provide the actuation force in the second direction, wherein the controller is configured to provide a predetermined temporal sequence of signal pulses controlling the actuator to provide the actuation force during a duration of each signal pulse, and the predetermined temporal sequence of signal pulses includes a plurality of consecutive signal pulses of a same polarity to provide the actuation force in the first direction.

2. The hearing device according to claim 1, wherein subsequent signal pulses included in the predetermined temporal sequence of signal pulses are separated by an intermediate time interval during which the actuator is controlled to decrease the magnitude of the actuation force as compared to the magnitude controlled during the duration of each signal pulse and/or to change the direction of the actuation force between the first direction and the second direction.

3. The hearing device according to claim 1, wherein the hearing device further comprises an acoustic transducer configured to output an audio signal, wherein the controller is communicatively coupled to the acoustic transducer and configured to provide the audio signal to the acoustic transducer.

4. The hearing device according to claim 1, wherein the controller is configured to provide subsequent signal pulses included in the predetermined temporal sequence of signal pulses to control the actuator to successively increase the magnitude of the actuation force over time in the predetermined temporal sequence.

5. The hearing device according to claim 1, wherein the controller is configured to successively increase the duration and/or a signal level of the signal pulses in the predetermined temporal sequence.

6. The hearing device according to claim 1, wherein the valve member is moveable relative to an opening provided in the housing, the opening located in the venting channel and leading to an exterior of the housing, wherein the valve member is disposed such that the valve member is visible at the opening from the exterior of the housing when the valve member is in the first valve position and/or in the second valve position.

7. The hearing device according to claim 1, wherein the controller is configured to receive an input signal from a user interface and to provide subsequent signal pulses included in the predetermined temporal sequence of signal pulses based on the input signal.

8. The hearing device according to claim 1, wherein the controller is configured to execute a boot sequence and to provide said predetermined temporal sequence of signal pulses during executing the boot sequence.

9. The hearing device according to claim 1, wherein the controller is configured to provide subsequent signal pulses included in the predetermined temporal sequence of signal pulses repeatedly at a constant repetition frequency.

10. The hearing device according to claim 9, wherein the repeatedly provided subsequent signal pulses comprise first repeated signal pulses and second repeated signal pulses alternating in said predetermined temporal sequence, the first repeated signal pulses controlling the actuator to provide the actuation force in the first direction and the second repeated signal pulses controlling the actuator to provide the actuation force in the second direction.

11. The hearing device according to claim 10, wherein the repetition frequency is provided such that the housing is caused to vibrate by a movement of the valve member forth and back between the first valve position and the second valve position.

12. The hearing device according to claim 1, wherein the controller is further configured to provide subsequent signal pulses included in the predetermined temporal sequence of signal pulses to control the actuator to keep the direction of the actuation force equal and the magnitude of the actuation force above a minimum level during the duration of each signal pulse and to decrease the magnitude of the actuation force below the minimum level after the duration of the signal pulse and/or to change the direction of the actuation force between the first direction and the second direction after the duration of the signal pulse.

13. The hearing device according claim 1, wherein the controller is configured to provide an auxiliary control signal in addition to the first control signal and the second control signal, wherein the auxiliary control signal comprises subsequent signal pulses included in the predetermined temporal sequence of signal pulses.

14. The hearing device according to claim 13, wherein the auxiliary control signal is a first auxiliary control signal, wherein the controller is further configured to provide a second auxiliary control signal comprising an additional predetermined temporal sequence of signal pulses controlling the actuator to provide the actuation force during a duration of each signal pulse included in the additional predetermined temporal sequence, wherein:

at least one of the signal pulses of the second auxiliary control signal controls the actuator to provide the actuation force with a different magnitude and/or direction than the signal pulses of the auxiliary control signal, and/or a duration of at least one of the signal pulses in the second auxiliary control signal is different than the duration of the signal pulses in the first auxiliary control signal, and/or an intermediate time interval separating at least two of the signal pulses in the second auxiliary control signal is different than the intermediate time interval separating the signal pulses in the first auxiliary control signal.

15. A method of operating a hearing device, the method comprising:

providing a first control signal to control an actuator of a hearing device to provide an actuation force in a first direction, wherein the first control signal is associated with the first direction and a magnitude for acting on a valve member of the hearing device;

providing a second control signal to control the actuator to provide an actuation force in a second direction; and providing a predetermined temporal sequence of signal pulses to control the actuator to provide the actuation force during a duration of each signal pulse, wherein the predetermined temporal sequence of signal pulses includes a plurality of consecutive signal pulses of a same polarity to provide the actuation force in the first direction.

16. The method according to claim 15, wherein subsequent signal pulses included in the predetermined temporal sequence of signal pulses are separated by an intermediate time interval.

17. The method according to claim 15, wherein subsequent signal pulses included in the predetermined temporal sequence of signal pulses are associated with control of the actuator to successively increase the magnitude of the actuation force over time in the predetermined temporal sequence.

18. The method according to claim 15, wherein the duration and/or a signal level of the signal pulses is successively increased in the predetermined temporal sequence.

19. The method according to claim 15, wherein subsequent signal pulses included in the predetermined temporal sequence of signal pulses are repeatedly provided at a constant repetition frequency.

20. A non-transitory computer-readable medium storing instructions that when executed by a processor cause a hearing device to perform operations, the operations comprising:

providing a first control signal to control an actuator of a hearing device to provide an actuation force in a first direction, wherein the first control signal is associated with the first direction and a magnitude for acting on a valve member of the hearing device;

providing a second control signal to control the actuator to provide an actuation force in a second direction; and providing a predetermined temporal sequence of signal pulses to control the actuator to provide the actuation force during a duration of each signal pulse, wherein the predetermined temporal sequence of signal pulses includes a plurality of consecutive signal pulses of a same polarity to provide the actuation force in the first direction.

* * * * *